US005983055A

United States Patent [19]

Bito et al.

[11] Patent Number: 5,983,055

[45] Date of Patent: Nov. 9, 1999

[54] PHOTOSENSITIVE ELEMENT FOR ELECTROPHOTOGRAPHY

[75] Inventors: Takahiro Bito, Yamatokoriyama; Syouichi Fujita, Kashiba; Kouichi Takenouchi, Nabari; Teruhiko Noguchi, Sakai; Yukihisa Imaue; Tatsuya Itou, both of Nara; Ken Yamagishi, Yamatotakada; Keizo Kitamura; Tadayuki Sawai, both of Yamatokoriyama, all of Japan

[73] Assignee: Sharp Kabushiki Kaisha, Osaka, Japan

[21] Appl. No.: 08/818,675

[22] Filed: Mar. 14, 1997

[30] Foreign Application Priority Data

| | | | |
|---|---|---|---|
| Mar. 19, 1996 | [JP] | Japan | 8-90067 |
| Mar. 19, 1996 | [JP] | Japan | 9-90068 |
| Mar. 19, 1996 | [JP] | Japan | 8-90069 |
| Mar. 19, 1996 | [JP] | Japan | 8-90070 |

[51] Int. Cl.[6] ..... G03G 15/00

[52] U.S. Cl. ..... 399/159

[58] Field of Search ..... 399/130, 159, 399/167; 430/32, 56, 127

[56] References Cited

U.S. PATENT DOCUMENTS

| | | | |
|---|---|---|---|
| 4,326,793 | 4/1982 | Buholtz | 399/159 X |
| 5,019,861 | 5/1991 | Surti | 399/167 X |
| 5,371,576 | 12/1994 | Gonda | 399/167 |
| 5,436,699 | 7/1995 | Komaki | 399/159 |
| 5,461,464 | 10/1995 | Swain | 399/159 |
| 5,579,093 | 11/1996 | Wagner et al. | 399/159 |
| 5,652,077 | 7/1997 | Obinata | 430/56 |

FOREIGN PATENT DOCUMENTS

A 7-152194 6/1996 Japan .

*Primary Examiner*—Sandra Brase
*Attorney, Agent, or Firm*—Nixon & Vanderhye PC

[57] ABSTRACT

A photosensitive element is produced with a minimum amount of a conductive synthetic resin material. A draft for injection molding is formed in the inner circumferential surface as a supporting body, and a driven member provided with a gear is fixed to the end of the supporting body with a smaller inner diameter, that is, the thicker end. A driven portion in which a plurality of projections and depressions are formed alternately to be adjacent to each other in the circumferential direction is arranged on an axial end of a cylindrical supporting body made of a conductive synthetic resin, including a photosensitive layer on the outer circumferential surface. By a joint member removably engaged with the driven portion, the supporting body is rotated around the axis. In one arrangement, only the end of the supporting body is solid. In another arrangement, the supporting body is solid in the almost entire length in the axial direction.

55 Claims, 55 Drawing Sheets

FIG. 36A
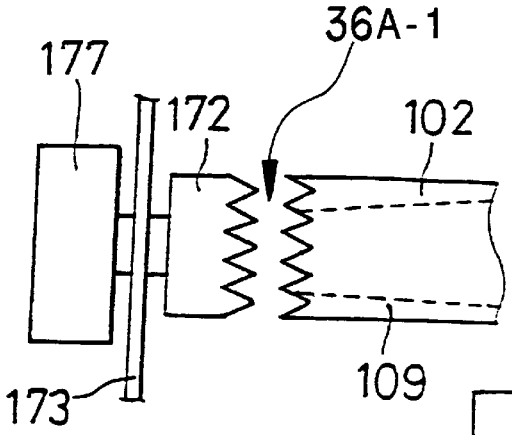
FIG. 36B
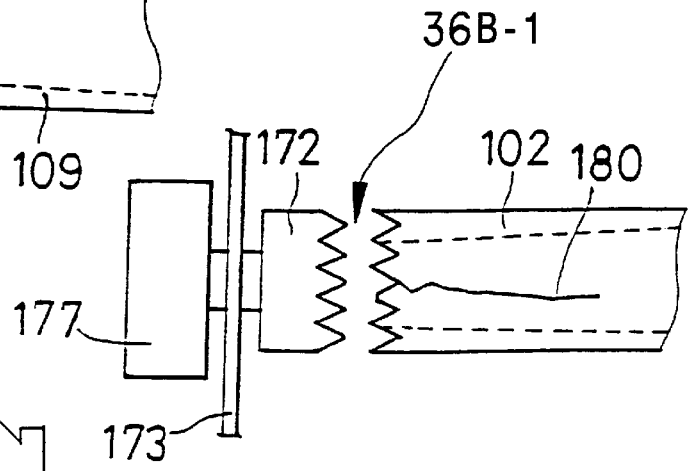
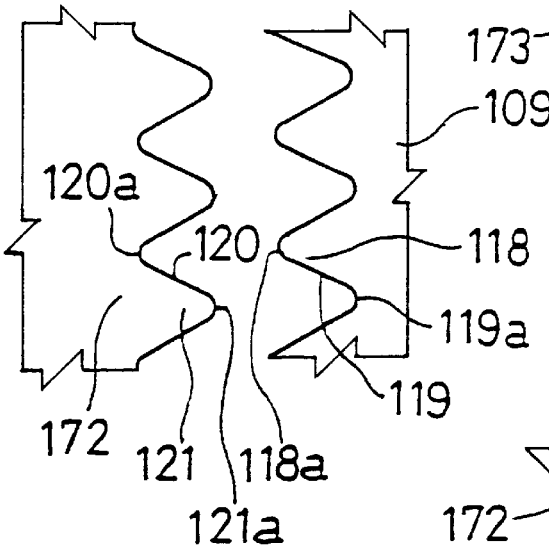
FIG. 36A-1
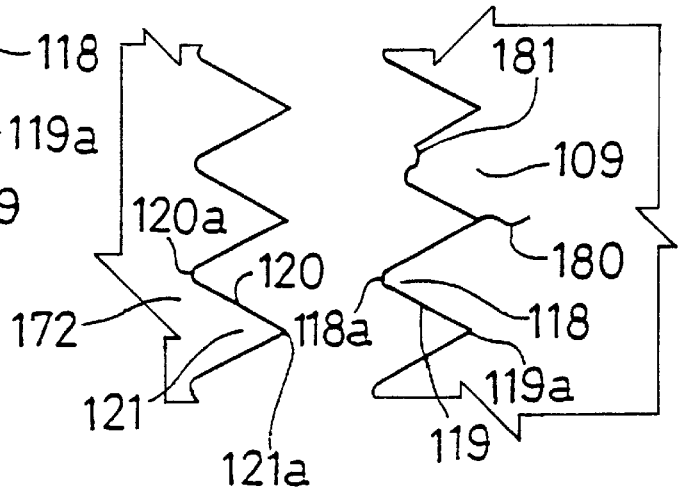
FIG. 36B-1

FIG. 69A
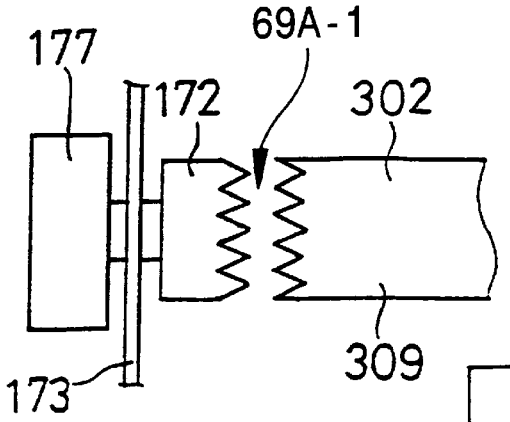
FIG. 69B
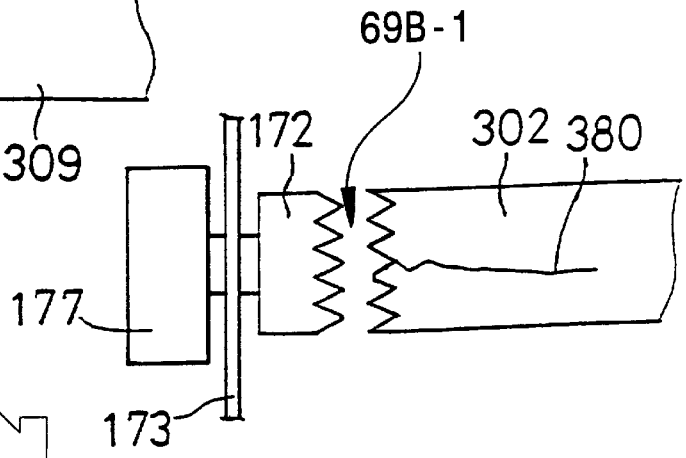
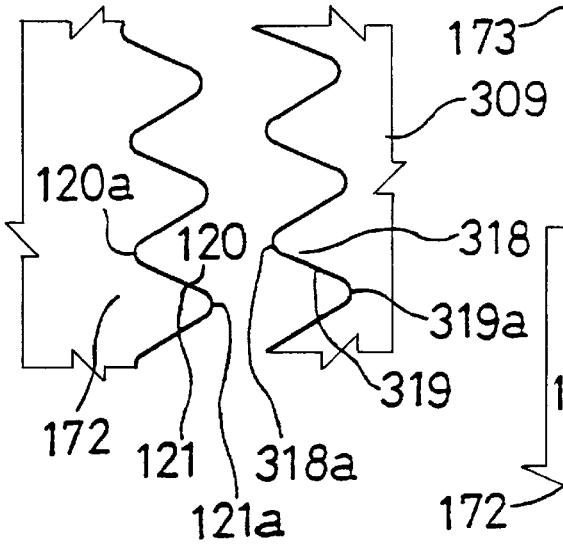
FIG. 69A-1
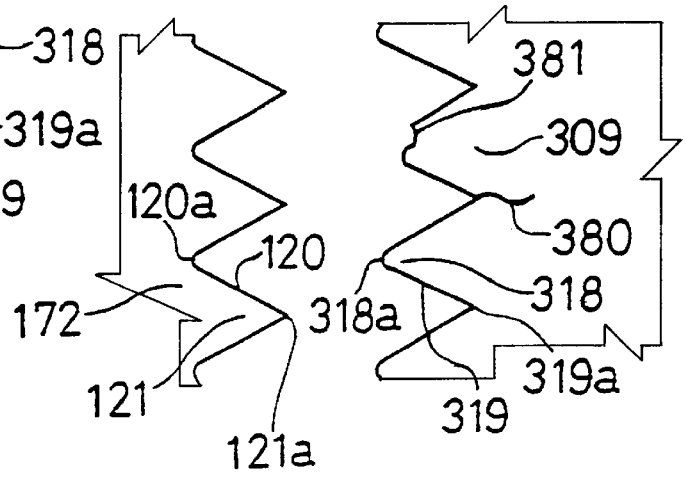
FIG. 69B-1

FIG. 69A
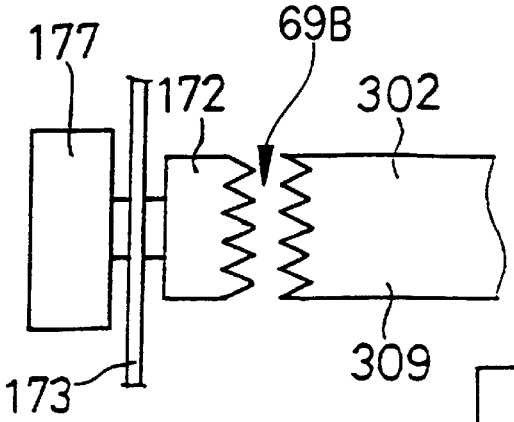
FIG. 69C
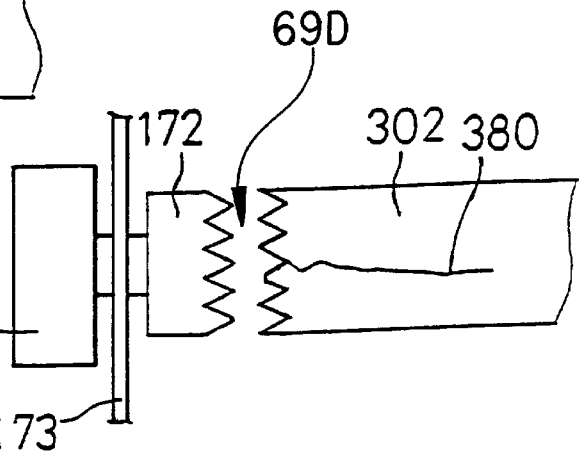
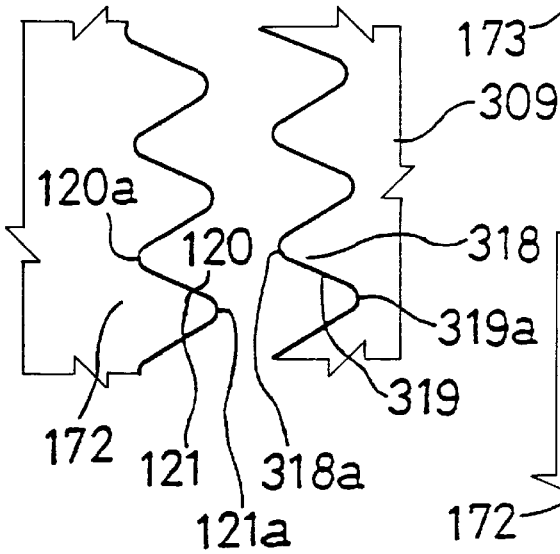
FIG. 69B
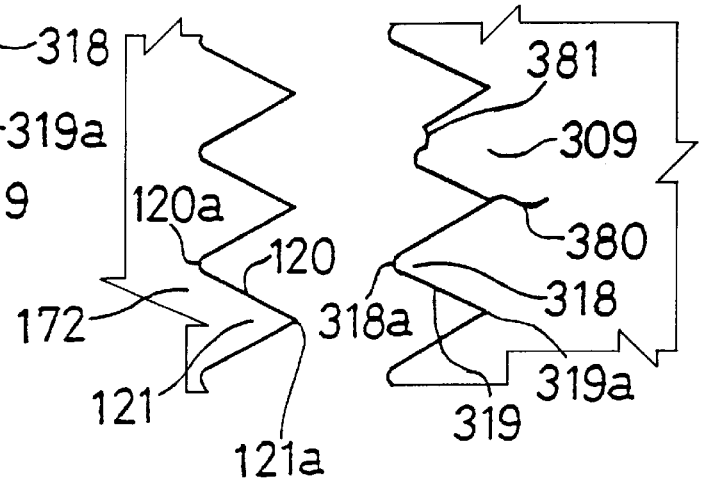
FIG. 69D

PHOTOSENSITIVE ELEMENT FOR ELECTROPHOTOGRAPHY

BACKGROUND OF THE INVENTION

1. Field of the Invention

The invention relates to a photosensitive element for electrophotography, provided for electrostatic latent image formation used in electrophotography apparatuses such as copying machines and laser printers, to a photosensitive device for electrophotography and to an electrophotography apparatus comprising the photosensitive element.

2. Description of the Related Art

A photosensitive element for electrophotography conventionally used in electrophotographic process in copying machines or laser printers comprises a conductive base tube having a photosensitive laser of an organic material formed thereon. The conductive base tube is prepared by processing an aluminum pipe by cutting in an appropriate length followed by abrading the surface thereof to be availed for the use as a photosensitive element for electrophotography.

The base tube of the conventional photosensitive element requires an expensive aluminum material, and a time-consuming processes such as cutting-off and abrading. Furthermore, since the photosensitive element is an expendable part, it requires a lot of labor in collection and classification for reuse of the metallic parts.

As a method for solving the problems, another related art disclosed in the Japanese Unexamined Patent Publication JP-A 7-152194 (1995) has been proposed. In this related art, a drum served as a base tube is made of a synthetic resin. The cost of molded products depends on the amount of the resin. In particular, in the case of a resin drum to be used as a photosensitive element, an expensive resin is used. Accordingly, a thin drum is preferable with respect to the cost reduction. On the other hand, however, a thin drum is weak with respect to shock. Furthermore, a resin drum tends to weaken the adherence in the fitting portion of a drum base tube and a flange compared with the aluminum tube conventionally used.

SUMMARY OF THE INVENTION

Objects of the invention are to provide a photosensitive element for electrophotography, capable of solving problems in recycling at a low cost with a minimum amount of a material, but with an improved strength, and further to provide a photosensitive device and an electrophotograpy apparatus using the photosensitive element.

The invention provides a photosensitive element for electrophotography comprising a cylindrical supporting body made of a synthetic resin, the cylindrical supporting body having an outer diameter uniform in the axial direction thereof and an inner diameter gradually tapering in the axial direction, a driven member fixed to an end having a smaller inner diameter of the cylindrical supporting body, the driven member being rotated around the axis to be driven, and a photosensitive layer formed on the outer circumferential surface of the cylindrical supporting body.

According to the invention, the inner circumferential surface of the cylindrical supporting member, whose outer circumferential surface bears a photosensitive layer, has a gradual tapering in the axial direction and utilizes a draft for injection molding may be used. Besides, since the end having a smaller inner diameter, that is, the end with a larger thickness, which is the difference between the size of the outer diameter and the inner diameter of the supporting body is used as the driven side, the mechanical strength can be improved with a minimum amount of the synthetic resin material. The driven member may be formed by injection molding integrally with the supporting body. Such configuration is also included in the spirit of the invention.

The outer diameter of the supporting body is axially parallel, in other words, the outer circumferential surface is right-cylindrical, where a photosensitive layer is formed. And an electrostatic latent image is formed on the photosensitive layer in a photosensitive device and an electrophotography apparatus comprising the device. Since the photosensitive layer is arranged on an image formation area, which is the area of the supporting body excluding the end for fixing the driven member, the risk of deteriorating the quality of electrostatic latent images by adverse effects on the supporting body at the time of ejection process in the injection molding such as drooling can be avoided.

According to the photosensitive element for electrophotography of the invention, since the inner circumferential surface of a supporting body made of a synthetic resin is tapered by a draft for injection molding and a driven member is fixed at the thicker end, that is, the end having a larger difference of the size of the outer diameter and the inner diameter of the supporting body to be rotated around its axis, a supporting body having an improved mechanical strength capable of preventing the generation of crack or crazing caused by a driving force can be provided with a minimum amount of the synthetic resin material at a low cost.

Moreover, the invention is characterized in that the end of the supporting body has projections protruding inwardly in the radial direction with respect to the inner circumferential surface tapered with respect to its axis, and the driven member is fitted into the end, and comprises a fitting portion where stopping grooves to be engaged with the projections are formed.

According to the invention, as shown in FIGS. 4 to 8, the projections are formed so as to further protrude inwardly from the inner circumferential surface in the radial direction of the supporting body, having an incline with respect to its axis such as a draft at the end having a larger difference between the outer diameter and the inner diameter of the supporting body as illustrated in an embodiment of FIGS. 4 to 8 later described. The stopping grooves formed at the portion to which a driven member is fitted are engaged with the projections. Accordingly, in addition to the improvement of the strength with a minimum amount of the synthetic resin, the improvement of adherence strength in bonding the end of the supporting body and the fitting portion with an adhesive can be achieved.

According to the invention, since projections protruding inwardly in the radial direction from the inner circumferential surface tapering in the axial direction of the supporting body are engaged with stopping grooves formed at the fitting portion of the driven member, in addition to the improvement of the strength with a minimum amount of the synthetic resin material, the improvement of adherence strength in bonding with an adhesive to drive a photosensitive element with a larger driving force can be achieved.

Furthermore, the invention is characterized in that at the end of the supporting body are formed a plurality of notches axially elongating in the circumferential direction at intervals, and the driven member includes stopping projections axially elongating to be engaged with the notches, and a fitting portion to be fitted into the end.

According to the invention, since a plurality of axially elongating notches are provided at the end of the supporting body so as to allow stopping projections of the driven member are engaged with the notches, and further a fitting portion to be inserted and fitted to the end is provided in the driven member, the supporting body and the driven member can be fixed firmly.

According to the invention, since the projections and the notches formed at the end of the supporting body and the stopping grooves and the stopping projections of the driven member are formed at regular intervals in the circumferential direction, or are formed symmetrically with respect to the plane including the axis of the supporting body, the load in the operation on the supporting body and the driven member can be distributed evenly in the circumferential direction so that the strength of the supporting body can be improved without the risk of the breakage by the driving force.

According to the invention, since a plurality of axially extending notches, with which stopping projections are engaged, are formed at the end of the supporting body at intervals, for example, at regular intervals in the circumferential direction, or are formed symmetrically with respect to the plane including the axis of the supporting body, and the fitting portion of the driven member is fitted into the end of the supporting body, the load on the supporting body can be distributed nearly evenly on the circumferential surface so that the strength of the supporting body can be improved, and further, one kind of driven members can be applied commonly to a plurality of kinds of supporting members having different configurations, besides, firm fitting and fixing of the end of the supporting body and the driven member can be secured without generating dislocation.

Furthermore, the invention is characterized in that the fitting portion includes a supporting hole having a common axis, through which a supporting shaft is inserted, and a first edge position located in the inward of the supporting body in the axial dirction, at which the inner circumferential surface of the end of the supporting body and the fitting portion contact each other, and a second position at which the inner circumferential surface of the supporting hole and the supporting shaft contact each other have substantially the same coordinate with respect to the axial direction.

According to the invention, as shown in FIGS. 16 and 17 described later, even when a load perpendicular to the axis of the supporting body is applied, the breakage of the supporting member can be prevented and thus the strength of the photosensitive element in a state where the supporting body and the driven member are fixed can be improved. According to the invention, even when a load is applied from the perpendicular direction with respect to the axis of the supporting body, to which a photosensitive element is most vulnerable, the strength can be improved as mentioned above. According to the invention, since the first edge position and the second edge position of the supporting shaft have substantially the same coordinate with respect to the axis, the strength can be improved with respect to the load applied perpendicular to the axis of the supporting body.

According to the invention, the strength with respect to the load perpendicular to the axis, to which a photosensitive element is most vulnerable, can be improved. Accordingly, a photosensitive element for electrophotography having a superior strength and a long life without the risk of breakage such as crack or crazing of the supporting body can be realized at a low cost.

The invention is characterized in that only the inner circumferential surface of the end of the supporting body is formed nearly parallel to the axis, and a fitting portion is interlocked to the end.

According to the invention, since only the end of the cylindrical supporting member has the inner circumferential surface nearly parallel to the axis, in other words, the vicinity of the end is formed right-cylindrically, and a fitting portion of the driven member is inserted and fitted to the end, the inner circumferential surface of the end of the supporting body and the outer circumferential surface of the fitting portion of the driven member can be fixed firmly, and further, there is no risk that a large force is applied toward the outward in the radial direction at the end of the supporting body in the fitted state so that breakage of the supporting member can be prevented.

According to the invention, since only the vicinity of the end of the supporting body has the inner circumferential surface formed nearly parallel to the axis, that is, the inner circumferential surface is formed right-cylindrically, the fitting portion of the driven member can be inserted, fitted and fixed with an adhesive easily and securely.

The invention is characterized in that the outer circumferential surface of the fitting portion is formed tapering inwardly in the axial direction of the supporting body to have a smaller diameter.

According to the invention, as illustrated in FIG. 18, the outer circumferential surface of the fitting portion to be inserted to the inner circumferential surface of the supporting member of the driven member is formed tapering to have a smaller diameter toward the axially outer direction of the fitting portion, in other words, toward the axially inner direction of the supporting body. Accordingly, the outer circumferential surface of the fitting portion is formed to have a truncated cone shape. With this configuration, the fitting portion can be fitted to the end of the supporting body without the risk of generating crack or crazing, and further, the inner circumferential surface of the end of the supporting body and the outer circumferential surface of the fitting portion can be securely adhered with an adhesive.

According to the invention, since the outer circumferential surface of the fitting portion of the driven member is formed to have a truncated cone shape, that is, formed to have a smaller diameter toward the axially inner direction of the supporting body, the end of the supporting body and the fitting portion of the driven member can be fitted and fixed securely with an adhesive without having an intolerable force applied toward the outward in the radial direction on the end of the supporting member.

The invention provides a photosensitive element for electrophotography comprising a cylindrical supporting body made of a synthetic resin, the cylindrical supporting body having an outer diameter uniform in the axial direction thereof and an inner diameter gradually tapering in the axial direction, and a coaxial supporting hole formed in an insertion part inserted into an end having a larger inner diameter of the supporting body, wherein a supporting shaft is inserted into the supporting hole, and wherein a first edge position located in the inward of the supporting body in the axial direction thereof, where the inner circumferential surface of the end of the supporting body and the fitting portion contact each other, and a second edge position where an inner circumferential surface of the supporting hole and the supporting shaft contact each other have substantially the same coordinate with respect to the axis of the supporting body.

According to the invention, since the strength of the supporting body with respect to a load perpendicular to the axis can be improved by arranging the first edge position and the second edge position with substantially the same coordinate with respect to the axis of the supporting body, as illustrated in FIGS. 19 and 20, the fitting portion of the driven member can also be inserted and fitted to the end of the supporting body having a larger inner diameter, that is, the end having a smaller difference between the outer diameter and the inner diameter of the supporting body. Accordingly, the supporting body can be designed freer, and the photosensitive element can be produced freer as well.

According to the invention, since the strength toward a force applied perpendicular to the axis can be improved by arranging the first edge position and the second edge position with substantially the same coordinate with respect to the axis of the supporting body, the driven member can be mounted either to the radially thicker end or the radially thinner end of the supporting body. Accordingly, the strength of the supporting body can be improved at a low cost, and further, the supporting body can be designed freer and the photosensitive element can be produced freer as well.

The invention is characterized in that a reinforcing layer having an outer diameter nearly equal to the outer diameter of the photosensitive layer is formed in the outer circumferential surface of the end.

According to the invention, as illustrated in FIGS. 1, 12, 20 and 21, the outer circumferential surface of the end of the supporting body, to which the fitting portion of the driven member is fitted, can be provided with a reinforcing layer for the improvement of the strength. The reinforcing layer can be made of a synthetic resin tape such as a polyethylene terephthalate tape called "Mylar tape" by winding and fixing, or with a conductive coating layer. In an embodiment with a conductive coating layer, an electrical connection between a conductive supporting body and a conductive driven member can be further improved.

The reinforcing member is formed in a position axially offset with respect to the image formation area of the photosensitive element and thus the reinforcing layer does not cause an adverse effect to the electrostatic latent image formation.

A photosensitive layer and a reinforcing layer can contact with a sheet made of a flexible synthetic resin film having an elasticity for preventing scattering of a developer arranged upstream side of the rotation of the photosensitive element with respect to the developing roller of the developing device so that scattering of the developer in the electrophotography apparatus can be prevented. The reinforcing layer and the photosensitive layer are formed adjacent to each other in the axial direction of the supporting body without a gap so that scattering of the developer caused by the contact of the sheet can be prevented securely.

According to the invention, since the reinforcing layer is formed with the outer diameter substantially the same size of the outer diameter of the photosensitive layer formed on the outer circumferential surface of the supporting body, the strength of the end of the supporting body to which the driven member is fixed can be improved. Although generally speaking, a conductive synthetic resin forming the supporting body is vulnerable and weak, owing to the reinforcing layer, the strength of the end of the supporting body to which the driven member is fixed can be improved so that the generation of crack or crazing can be prevented.

According to the invention, since outer diameters of the photosensitive layer and the reinforcing layer are substantially the same, and thus a sheet for prevention of scattering the developer in the developing device can contact with both the photosensitive layer and the reinforcing layer in the photosensitive device and the electrophotography apparatus, scattering of the developer in the electrophotography apparatus to ruin the vicinity can be prevented.

The reinforcing layer can be formed not only by winding a "Mylar tape" made of a synthetic resin material, but also as a conductive coating layer. By the use of a conductive coating layer, a supporting body made of a conductive synthetic resin material and a conductive driven member can be securely connected electrically. Therefore grounding can be achieved easily without the need of providing an electrical member for grounding such as an earth plate, and thus the configuration can be simplified.

The invention is characterized in that at the end of the supporting body are formed a plurality of stopping grooves at intervals in the circumferential direction, the plurality of stopping grooves being dent from the outer circumferential surface having a round cross-section in the plane perpendicular to the axis thereof, and the driven member includes projections protruding toward the axis direction to be engaged with the respective stopping grooves.

According to the invention, as illustrated in FIGS. 22 to 24, stopping grooves being dent from the outer circumferential surface of the end of the supporting body are formed for fitting and engaging with the projections of the driven member at a radially outward position. According to this configuration, the adherence strength between the supporting body and the driven member can be improved with a minimum amount of a synthetic resin material by increasing the area to be bonded with an adhesive, and also the rotating driving force of the torque transmitted from the driven member to the supporting body can be increased.

According to the invention, since a plurality of dent stopping grooves are formed in the outer circumferential surface of the end of the supporting body at regular intervals in the circumferential direction and the projections of the driven member are engaged with the stopping grooves at a radially outward position, the adherence strength between the end of the supporting body and the driven member can be improved with a minimum amount of a synthetic resin material comprising the supporting body by increasing the area to be bonded, and thus the strength of the photosensitive element for electrophotography of the invention can be improved.

Furthermore, the invention provides a photosensitive element for electrophotography comprising a cylindrical supporting body made of a synthetic resin, the cylindrical supporting body having an outer diameter uniform in the axial direction thereof and an inner diameter gradually tapering in the axial direction, wherein the end having a smaller inner diameter of the cylindrical supporting body is fitted into a groove dent in the axial direction, the groove being formed in an end face of a driven member rotated around the axis to be driven.

According to the invention, as illustrated in FIGS. 25 to 27, since the supporting body is fixed by being fitted in a groove being dent toward the axis direction formed at the end face of the driven member, the outer circumferential surface and the inner circumferential surface of the end of the supporting body are supported by respective facing inner peripheries of the driven member, and thus the supporting body and the driven member can be fixed without deteriorating the strength of the supporting body, and further, owing to the increase of the area of the end of the supporting body and the driven member to be bonded, the adherence strength of an adhesive can be improved.

Moreover, according to the invention, since the end of the supporting body is fitted to a groove of the driven member, the length of the photosensitive element can be minimized in the axial direction to achieve the downsizing.

According to the invention, since the thicker end of the supporting body is fitted and fixed to a groove formed at the end face of the driven member, the outer circumferential surface and the inner circumferential surface of the end of the supporting body can contact with the respective facing inner peripheries of the groove of the driven member to increase the contacting area so as to improve the adherence strength by increasing the area to be bonded with an adhesive, and thus the strength of the photosensitive element of the invention can be improved. By providing projections and depressions at the end of the supporting body to be engaged respectively with driving depressions and driving projections formed at the bottom of the groove of the driven member, a further improvement of the strength can be achieved. Besides, since the end of the supporting body is fitted to the groove of the driven member, the length of the photosensitive element of the invention can be shortened in the axial direction to allow downsizing.

Furthermore, the invention provides a photosensitive device for eletrophotography comprising:

(a) a photosensitive element having a cylindrical supporting body made of a synthetic resin, the cylindrical supporting body having an outer diameter uniform in the axial direction thereof and an inner diameter gradually tapering in the axial direction, a driven member fixed to the end having a smaller inner diameter of the cylindrical supporting body, the driven member being rotated around the axis to be driven and having a gear protruding outwardly in the axial direction of the cylindrical supporting body from the cylindrical supporting body, and a photosensitive layer formed on the outer circumferential surface of the cylindrical supporting member, and (b) driving means having a driving gear to be engaged with the gear to provide rotation driving force.

According to the photosensitive device for electrophotography of the invention, since the driven member comprises an external gear or an internal gear protruding outwardly from the end of the supporting body in the axial direction to be engaged with the driving gear of the driving means, the photosensitive element can be driven rotating around the axis.

According to the photosensitive device for electrophotography of the invention, an effect of easily implementing the invention in a conventional electrophotography apparatus can be achieved by driving with the gear of the external gear or the internal gear of the driven member engaged with the driving gear of the driving means.

According to the photosensitive device for electrophotography of the invention, an effect of easily implementing the invention in a conventional electrophotography apparatus can be achieved by driving with the gear of the external gear or the internal gear of the driven member engaged with the driving gear of the driving means.

The invention provides an electrophotography apparatus for forming electrostatic latent images in a photosensitive element provided in a photosensitive device, developing the electrostatic latent images with a developer of a developing device, and transferring and fixing the developed images on a recording sheet, wherein the photosensitive device includes:

a photosensitive element and driving means, the photosensitive element including a cylindrical supporting body made of a synthetic resin, the cylindrical supporting body having an outer diameter uniform in the axial direction thereof and an inner diameter gradually tapering in the axial direction, a driven member fixed to the end having a smaller inner diameter of the cylindrical supporting body, the driven member being rotated around the axis to be driven, a photosensitive layer formed on an outer circumferential surface of the cylindrical supporting member, and a reinforcing layer formed on an outer circumferential surface of the end, the photosensitive layer and the reinforcing layer having a nearly equal outer diameter, the driving means rotating the driven member around the axis of the supporting body; and the developing device includes a casing to accommodate a developer so as to surround a developing roller arranged to face the photosensitive element, the casing being provided with a developer-scattering prevention sheet contacting the photosensitive layer and the reinforcing layer on an upstream side in a rotation direction of the photosensitive element with respect to the developing roller.

According to the electrophotography apparatus of the invention, since the photosensitive layer and the reinforcing layer are roughly equal in outer diameter and the developer-scattering prevention sheet contacts the photosensitive layer and the reinforcing layer as mentioned above, the developer of the developing device will not scatter in the electrophotography apparatus to ruin the vicinity thereof.

According to the electrophotography apparatus of the invention, since the photosensitive layer and the reinforcing layer adjacent thereto in the axial direction have substantially the same outer diameter size, scattering of the developer in the electrophotography apparatus can be prevented securely with a developer scattering prevention sheet of the developing device.

The invention provides a photosensitive element for electrophotography comprising:

a cylindrical supporting body made of a synthetic resin and having an outer circumferential surface on which a photosensitive layer is formed;

a driven portion provided at an end of the cylindrical supporting body so as to face outwardly in the axial direction of the supporting body, the driven portion having a plurality of projections and depressions formed alternately so as to be adjacent to each other in the circumferential direction of the supporting body; and driving means for rotating and driving the supporting body around the axis of the supporting body, the driving means being provided a joint member to be removably engaged with the projections and depressions, and having the same axis as that of the supporting body.

According to the invention, since a driven portion including projections and depressions alternately formed to be adjacent to each other in the circumferential direction is arranged at an axially end of the cylindrical supporting body made of a synthetic resin, including a photosensitive layer formed on the outer circumferential surface, and the joint member of the driving means is engaged with the driving member so that the supporting body is driven rotating around the axis, a photosensitive element can be realized with a simple configuration with a minimum amount of a synthetic resin material without deteriorating the mechanical strength. The driving portion may be a part of the supporting body formed by integral molding, or the supporting body and the driven portion may be produced separately and fixed afterwards.

According to the invention, since the driven portion is arranged at an axially end of the synthetic resin supporting body, and the joint member of the driving means is engaged with the driven portion to drive the supporting body around the axis, a photosensitive element can be realized with a simple configuration with a minimum amount of a synthetic resin material without decreasing the mechanical strength.

Furthermore, the invention is characterized in that each projection is formed to protrude outwardly in the axial direction and taper gradually toward the outward in the axial direction.

According to the invention, since each projection is formed to taper gradually toward the outward in the axial direction and can be nearly triangle when developed along the circumferential direction, the projections and depressions of the driven portion can be engaged with the driving depressions and the driving projections formed in the joint member of the driving means without generating backlash, and thus a torque can be transmitted securely from the joint member to the driven portion.

Further, the invention is characterized in that the edge portions of the projections and the bottoms of the depressions are formed to be curved.

According to the invention, as illustrated in FIG. 4, since the edge portions of the projections and the bottoms of the depressions are formed to be curved, the driven portion and the joint member can be smoothly engaged. Besides, since the edge portion of a projection is not sharp but has an R-like shape, that is, formed to be curved as mentioned above, neither abrasion nor crack would not be caused by deterioration. And thus malfunction of the electrophotography apparatus caused by falling off the abraded or cracked portion can be prevented. Furthermore, generation of crack in the driven portion of the supporting body can be prevented by eliminating concentration of stress. Deterioration of image quality can be prevented as well. Sharp edge of a projection may cause a problem of crack of a driven portion or a supporting body with a small impact. However, the invention can avoid the problem.

Since the bottoms of depressions are curved, that is, are not formed to have an acute angle, generation of crack caused by concentration of stress can be prevented. Besides, by forming depressions and projections curved, generation of crack in the driven portion and the supporting body caused by the stress generated by a rotation power transmitted from the joint member to the driven portion can be prevented to secure a long life.

The invention is characterized in that the driven portion of the supporting body is thicker than the rest thereof.

According to the invention, as illustrated in FIGS. 7 and 8, since the driven portion of the supporting body is made thicker than the rest, the supporting body which became weak and vulnerable due to containing a carbon material such as carbon for providing conductivity can be improved in strength.

The invention is characterized in that the driven portion and the rest of the supporting body are connected to each other to form an obtuse angle in the inner circumferential surface of the supporting body.

According to the invention, since the driven portion of the supporting body is formed thicker to have a gap of an obtuse angle K as illustrated in FIG. 9 and a gap of an acute angle can be prevented, the strength of a comparatively vulnerable and weak supporting body can be further reinforced.

The invention is characterized in that the upstream side surfaces of the projections are nearly parallel to the rotation axis or inclined to the upstream side of the rotation direction toward the axially outer direction.

According to the invention, as illustrated in FIGS. 5 and 6, since the upstream side surfaces of the projections are nearly parallel to the rotation axis or inclined to the upstream side of the rotation direction toward the outward in the axial direction, a power can be transmitted from the joint member to the driven portion without having a force functioning to repel each other, and thus the rotation power can be transmitted from the joint member to the driven portion in a state securely jointed. Besides, according to this configuration, the projections and depressions of the driven portion can be engaged with the driving depressions and the driving projections of the joint portion smoothly.

Moreover, the invention is characterized in that the driven portion of the supporting body includes a conical guiding surface arranged more inwardly than the projections and depressions in the radial direction, the conical guiding surface having an outer diameter gradually tapering toward the outward in the axial direction.

According to the invention, since the driven portion of the supporting body comprises a conical or truncated-conical guiding surface arranged more inwardly than the projections and depressions in the radial direction, the strength of the driven portion can be improved so as to ensure the power transmission in a state where the driven portion and the joint member are engaged. Furthermore, owing to the existence of the guiding surface, the driven portion and the joint member can be guided and engaged to each other smoothly. Besides, in molding of the supporting body a further effect of facilitating molding can be achieved by providing a smooth guiding surface since the smooth guiding surface allows smooth flow of a synthetic resin in injection molding.

The invention is characterized in that in the inner circumferential surface of the supporting body in the vicinity of the driven portion is formed a conical guiding surface having an inner diameter gradually enlarging toward the axially outer direction.

According to the invention, as illustrated in FIGS. 10 to 13, since a conical guiding surface is formed in the inner circumferential surface of the driven portion, the driven portion and the joint member can be smoothly engaged with each other.

The invention is characterized in that the projections of the driven portion of the supporting body are formed to protrude inwardly from the inner circumferential surface of the supporting body excluding the driven portion in the radial direction.

According to the invention, since projections of the driven portion are formed so as to protrude inwardly in the radial direction, the strength can be improved with a minimum amount of a synthetic resin material.

The invention is characterized in that a reinforcing layer having a diameter nearly equal to that of the photosensitive layer is formed on the outer circumferential surface in the vicinity of the driven portion.

According to the invention, the strength can be improved by providing a reinforcing layer on the outer circumferential surface in the vicinity of the driven portion. The reinforcing layer can be formed by winding and fixing a synthetic resin tape of polyethylene terephthalate, called "Mylar tape", or with a conductive coating layer. With the conductive coating layer, electric connection between a conductive supporting member and a conductive driven member can be further improved.

Since a reinforcing layer is formed at a position axially offset from the image formation area of the photosensitive element, the electrostatic latent image formation will not be adversely affected.

The outer diameter of the reinforcing layer is nearly equal to that of the photosensitive layer, whereby the photosensitive layer and the reinforcing layer can contact with a sheet made of a flexible synthetic resin film having an elasticity for preventing scattering of a developer at an upstream side of the rotation of the photosensitive element with respect to the developing roller of the developing device, so that scattering of the developer in the electrophotography apparatus can be prevented. The reinforcing layer and the photosensitive layer are alternately formed to be adjacent to each other in the axial direction of the supporting body without a gap so that scattering of the developer caused by the contact of the sheet can be prevented securely.

Since the outer diameter of the reinforcing layer has a size nearly the same as that of the photosensitive layer, scattering of a developer in the developing device caused by the contact of the sheet can be securely prevented.

The invention is characterized in that the inner diameter of the supporting body is axially tapered toward the driven portion.

According to the invention, since the inner diameter of the supporting body is an inclined surface as a draft for injection molding or an angle larger the draft that with respect to the axis, and a driven portion is formed at the axial end of the supporting body having a smaller inner diameter, the strength can be improved with a minimum amount of a synthetic resin material.

The outer diameter of the supporting body is axially parallel, in other words, the outer circumferential surface is right-cylindrical, where a photosensitive layer is formed, and an electrostatic latent image is formed on the photosensitive layer in a photosensitive device and an electrophotography apparatus. Since the photosensitive layer is arranged on an image formation area, which is the area of the supporting body excluding the end for fixing the driven member, the risk of deteriorating the quality of electrostatic latent images by adverse effects on the supporting body at the time of ejection process in the injection molding such as drooling can be avoided.

The invention is characterized in that the driven portions are arranged at both ends of the supporting body.

According to the invention, since the driven portions are arranged at both axial ends of the supporting body, the driven portions can be easily mounted to the joint members, and thus designing and production can be conducted freer. Furthermore, the production cost can be reduced by providing joint members for supporting both axial ends of the supporting body with the same configuration, and thus the productivity can be improved as well. Besides, in a configuration where the axial end of the supporting body and the joint members are conductive, electric conductivity therebetween can be achieved securely, and thus the rate of the poor grounding of the photosensitive layer formed on the outer circumferential surface of the supporting body can be realized. Moreover, owing to the configuration with both the axial ends of the supporting body of the same configuration, the supporting body can be mounted in either direction, and thus maintenance operability can be facilitated.

The invention provides a photosensitive device for electrophotography comprising:

(a) a photosensitive element having a cylindrical supporting body made of a synthetic resin, having a photosensitive layer formed on the outer circumferential surface and a driven portion with a plurality of projections and depressions formed alternately to be adjacent to each other in the circumferential direction, the driven portion being arranged at an axially end of the supporting body so as to face the outward in the axial direction; and (b) driving means including a joint member sharing an axis with the supporting body to be engaged removably with projections and depressions of the driven portions, a spring for providing a spring force applied to the direction the driven portion and the joint member of the supporting body come closer, and a driving power source to rotate the joint member around the rotation axis to be driven.

According to the invention, since the driven portion of the supporting body in the driving means is provided with a spring force from the spring, in replacing the photosensitive element, the joint member can be displaced to the direction parting from the photosensitive element and thus the maintenance can be easily conducted.

The invention is characterized in that the projections are formed so as to protrude outwardly in the axial direction and taper outwardly in the axial direction.

According to the invention, since the projections are tapered, the joint member applied with a spring force can be engaged with the driven portion of the supporting body securely and smoothly.

The invention is characterized in that a conical guiding surface arranged more inwardly than the projections and depressions in the radial direction, having an outer diameter tapering toward the outward in the axial direction, is formed in the driven portion of the supporting body, and a joint member comprises a conical receiving surface to be fitted with the guiding surface in a state the axis of the supporting body and the rotation axis of the joint member are on a straight line.

According to the invention, since the conical guiding surface of the driven portion of the supporting body and the conical receiving surface of the joint member fit to each other, the driven portion and the joint member can be engaged by guiding the supporting body and the joint member smoothly.

The invention is characterized in that a conical guiding surface having the inner diameter enlarging to the outward in the axial direction is formed in the inner circumferential surface of the supporting body in the vicinity of the driven portion, and the joint member comprises a guiding projection to be fitted to the guiding surface having an outer diameter smaller than that of the guiding surface so as to have a gap formed with the inner surface of the guiding surface in a fitted state.

According to the invention, the guiding projection of the joint member prevents a compressing force functioning to widen the driven portion of the supporting body outwardly in the radial direction so as to prevent generation of a crack in the driven portion. The gap can be, for example, 0.2 to 0.5 mm. Accordingly, the photosensitive element can be driven rotating with a large torque.

The invention is characterized in that the joint member comprises a dent portion being axially dent to fit with the driven portion of the supporting body, and driving depressions and driving projections to be engaged respectively with the projections and depressions of the driven portion are formed at the bottom of the dent portion.

According to the invention, since driving depressions and driving projections are formed to be engaged respectively with projections and depressions of the driven portion at the bottom of a dent portion formed in the joint member, the joint member can support the outer and the inner circumferential surface of the driven portion of the cylindrical supporting body to rotate the supporting body, and thus the strength can be improved, as well as the supporting body can be stably rotated. Furthermore, the axis of the supporting body and the joint member can be easily maintained on a straight line. Accordingly, the quality of the electrostatic photography can be improved.

The invention is characterized in that the supporting body having the driven portion is made of a conductive synthetic resin, and the joint member is made of a conductive material.

According to the invention, since the supporting body and the joint member are made of a conductive material, that is, the supporting body is made of a conductive synthetic resin and the joint member can be made of a conductive synthetic resin or aluminum or another metal, the supporting body can be grounded easily. Besides, the joint member can be connected electrically via a spring. Moreover, since an earth plate, which has been regarded as necessary for grounding of the supporting body, is not required, the production cost can be reduced.

The invention is characterized in that the supporting body having the driven portion is made of a material softer than that of the joint member.

According to the invention, since the supporting body is made of a synthetic resin material, which is softer than that of the joint member, in other words, the joint member is made of a material harder than that of the supporting body, such as aluminum or iron, the joint member can be used over a long period unlike the supporting body, which is an expendable part and requires replacement. Accordingly, the supporting body, which is an expendable part can be made of a material softer than that of the joint member, and the joint member can be made of a material not liable to deteriorate the driven portion of the supporting body in a short time, such as iron and stainless steel. Therefore, the life of the joint member can be extended and the driven portion of the supporting body can ensure the strength in consideration of the life as the photosensitive element.

The invention is characterized in that driving depression and driving projections formed in the joint member to be engaged with projections and depressions of the driven portion are formed in a number obtained by multiplying the number of the projections and the depressions of the driven portion by two or more, and thus the joint member can be applied commonly to a plurality of kinds of driven portions.

According to the invention, since the number of dents and projections formed in the joint member is a number obtained by multiplying the number of the dents and projections formed in the driven portion of the supporting body by an integer, the joint member can be applied commonly to a plurality of kinds of photosensitive elements. Accordingly, since different kinds of joint members need not be prepared for each kind of a photosensitive element, the maintenance can be conducted easily.

The invention provides an electrophotography apparatus for forming electrostatic latent images in a photosensitive element in a photosensitive device, developing the electrostatic latent images with a developer of a developing device, transferring and fixing the developed images on a recording sheet, wherein the photosensitive device includes:

a photosensitive element; and driving means, the photosensitive element including:

a cylindrical supporting body made of a synthetic resin, having a photosensitive layer formed on the outer circumferential surface thereof, and a driven portion with a plurality of projections and depressions formed alternately to be adjacent to each other in the circumferential direction, the driven portion being arranged at an axially end of the supporting body so as to face the outward in the axial direction, a reinforcing layer having an outer diameter nearly equal to the outer diameter of the photosensitive layer being formed on the outer circumferential surface of a vicinity of the driven portion the end, the driving means including:

a joint member sharing an axis with the supporting body to be engaged removably with projections and depressions of the driven portions, a spring for providing a spring force applied to the direction the driven portion and the joint member of the supporting body come closer, and a driving power source for rotating and driving the joint member around the rotation axis; and wherein the developing device includes a casing to accommodate a developer so as to surround a developing roller arranged to face the photosensitive element, the casing being provided with a developer-scattering prevention sheet contacting the photosensitive layer and the reinforcing layer on an upstream side in a rotation direction of the photosensitive element with respect to the developing roller.

According to the electrophotography apparatus of the invention, since the photosensitive layer and the reinforcing layer adjacent thereto in the axial direction have substantially the same diameter size, scattering of the developer in the electrophotography apparatus can be prevented securely with a developer scattering prevention sheet of the developing device.

The invention provides a photosensitive element for electrophotography comprising:

a nearly cylindrical supporting body made of a synthetic resin and having an outer circumferential surface on which a photosensitive layer is formed; and a driven portion provided at an end of the nearly cylindrical supporting body so as to face outwardly in the axial direction of the supporting body, the driven portion having a plurality of projections and depressions formed alternately so as to be adjacent to each other in the circumferential direction of the supporting body, wherein the supporting body is solid only in the vicinity of the end, and rotated to be driven around the axis of the supporting body by driving means which is provided with a joint member to be removably engaged with the projections and depressions, and has the same axis as that of the supporting body.

According to the invention, since a driven portion having projections and depressions alternately arranged to be adjacent to each other in the circumferential direction is provided at an axially end of the nearly cylindrical supporting body made of a synthetic resin, comprising a photosensitive layer on the outer circumferential surface, and the supporting body rotates around the axis by engaging a joint member of driving means with the driven portion, a photosensitive element can be realized with a minimum amount of a synthetic resin material in a simple configuration without deteriorating the mechanical strength. The driven member can be a part of the supporting body formed by an integral molding, but can be produced separately and fixed to the supporting body afterwards.

According to the invention, since only the vicinity of the end of the supporting body is solid, generation of crack or crazing caused by the stress of rotation of the driven portion transmitted from the joint member can be prevented, and the strength can be improved. In addition to the end, the other end can be solid as well. Such configuration can be achieved producing a nearly cylindrical supporting body having solid portions at both ends in a blow molding by a molding utilizing the centrifugal force or a molding utilizing a pressure of a gas such as air.

According to the invention, since a driven portion is arranged at an axially end of the synthetic resin supporting body and the driven portion is rotated around the axis by the joint member of the driving means engaged therewith, a photosensitive element can be realized with a minimum amount of a synthetic resin material in a simple configuration without deteriorating the mechanical strength.

The invention provides a photosensitive element for electrophotography comprising:

a nearly cylindrical supporting body made of a synthetic resin and having an outer circumferential surface on which a photosensitive layer is formed; and a driven portion provided at an end of the nearly cylindrical supporting body so as to face outwardly in the axial direction of the supporting body, the driven portion having a plurality of projections and depressions formed alternately so as to be adjacent to each other in the circumferential direction of the supporting body, wherein the supporting body is rotated to be driven around the axis of the supporting body by driving means which is provided with a joint member to be removably engaged with the projections and depressions, and has the same axis as that of the supporting body.

According to the invention, since the substantially columnar solid supporting body made of a synthetic resin, having a photosensitive layer on the outer circumferential surface is substantially solid in the axially entire length, generation of crack or crazing caused by the stress of the rotation of the driven member transmitted from the joint member can be prevented and thus the strength can be improved.

Furthermore, the invention is characterized in that each projection is formed so as to protrude outwardly in the axial direction and taper gradually to the outward in the axial direction.

According to the invention, since each projection is formed so as to taper gradually to the outward in the axial direction and can be substantially triangle when developed along the circumferential direction, the projections and the depressions of the driven portion can be engaged with the driving depressions and the driving projections formed in the joint member of the driving means without generating backlash, and thus a torque can be transmitted securely from the joint member to the driven portion.

According to the invention, since each projection is formed so as to taper gradually to the outward in the axial direction, the projections and the depressions of the driven portion can be engaged with the driving depressions and the driving projections formed in the joint member of the driving means without generating backlash, and thus a torque can be transmitted securely from the joint member to the driven portion.

According to the invention, since only the vicinity of the end of the supporting body is solid, generation of crack or crazing caused by the stress of rotation of the driven portion transmitted from the joint member can be prevented, and the strength can be improved. In addition to the end, the other end can be solid as well. Such configuration can be achieved producing a nearly cylindrical supporting body having solid portions at both the ends in a blow molding by a molding utilizing the centrifugal force or a molding utilizing a pressure of a gas such as air.

According to the invention, since the supporting body is substantially solid in the axially entire length, generation of crack or crazing caused by the stress of the rotation of the driven member transmitted from the joint member can be prevented and thus the strength can be improved.

Further, the invention is characterized in that the edge portions of the projections and the bottoms of the depressions are formed to have a curve shape.

According to the invention, as illustrated in FIG. 4, since the edge portions of the projections and the bottoms of the depressions are formed to have a curve shape, the driven portion and the joint member can be smoothly engaged. Besides, since the edge portion of a projection is not sharp but has an R-like shape, that is, formed to have a curve shape as mentioned above, abrasion or crack caused by deterioration would not generate. And thus malfunction of the electrophotography apparatus caused by falling off the abraded or cracked portion can be prevented. Furthermore, generation of crack in the driven portion of the supporting body can be prevented by eliminating concentration of stress. Deterioration of image quality can be prevented as well. Sharp edge of a projection may cause a problem of crack of a driven portion or a supporting body with a small impact. However, the invention can avoid the problem.

Since the bottoms of depressions are curved, that is, are not formed to have an acute angle, generation of crack caused by concentration of stress can be prevented. Besides, by forming depressions and projections curved, generation of crack in the driven portion and the supporting body caused by the stress generated by a rotation power transmitted from the joint member to the driven portion can be prevented to secure a long life.

The invention is characterized in that the upstream side surfaces of the projections are nearly parallel to the rotation axis, or the more outwardly in the axial direction, the more inclined to the upstream side of the rotation direction.

According to the invention, as illustrated in FIGS. 5 and 6, since the upstream side surface of the projections are nearly parallel to the rotation axis or inclined to the upstream side of the rotation direction toward the axially outer direction, a power can be transmitted from the joint member to the driven portion without having a force functioning to repel each other, and thus the rotation power can be transmitted from the joint member to the driven portion in a state securely jointed. Besides, according to this configuration, projections and the depressions of the driven portion can be engaged with the driving depressions and the driving projections of the joint portion can be engaged smoothly.

Moreover the invention is characterized in that in the driven portion of the supporting body is formed a conical guiding surface arranged more inwardly than the projections and depressions in the radial direction, having an outer diameter gradually tapering toward the axially outer direction.

According to the invention, since the driven portion of the supporting body comprises a conical or truncated-conical guiding surface arranged more inwardly than the projections and depressions in the radial direction, with the outer diameter gradually tapering toward the axially outer direction, the strength of the driven portion can be improved so as to ensure the power transmission in a state where the driven portion and the joint member are engaged. Furthermore, owing to the existence of the guiding surface the driven portion and the joint member can be guided and engaged to each other smoothly. Besides, in molding of the supporting body a further effect of facilitating molding can be achieved by providing a smooth guiding surface since the smooth guiding surface allows smooth flow of a synthetic resin in injection molding.

The invention is characterized in that in the vicinity of the driven portion of the supporting body is formed a conical guiding surface having an inner diameter gradually enlarging toward the axially outer direction.

According to the invention, as illustrated in FIGS. 7 to 14, since a conical guiding surface is formed in the inner circumferential surface of the driven portion, the driven portion and the joint member can be engaged smoothly.

According to the invention, since a conical guiding surface is formed in the inner circumferential surface of the driven portion, the driven portion and the joint member can be engaged smoothly.

The invention is characterized in that a guiding surface having an inner diameter gradually enlarging toward the axially outward direction is formed in the driven portion of the supporting body, and a plurality of projections and depressions are alternately formed in the circumferential direction at a position located midway in the guiding surface in the axial direction or at a position located inwardly in the guiding surface in the axial direction, so as to face outwardly in the axial direction and be adjacent to each other in the circumferential direction.

According to the invention, since projections and depressions are formed at positions located midway in the guiding surface in the axial direction or at positions located inwardly in the guiding surface in the axial direction, rotation power can be transmitted from the joint member to the driven portion at a radially inner position, and thus irregular rotation can be alleviated. According to the configuration, since the guiding surface is arranged more outwardly than the projections and the depressions in the radial direction, the driven portion and the joint member share the same axis, and thus a stable drive can be achieved.

The invention is characterized in that the projections of the driven portion of the supporting body are formed so as to protrude inwardly in the radial direction.

According to the invention, since projections of the driven portion are formed so as to protrude inwardly in the radial direction, the strength can be improved with a minimum amount of a synthetic resin material.

The invention is characterized in that a reinforcing layer having a diameter of a size substantially the same as that of the photosensitive layer is formed on the outer circumferential surface in the vicinity of the driven portion.

According to the invention, the strength can be improved by providing a reinforcing layer on the outer circumferential surface in the vicinity of the driven portion. The reinforcing layer can be formed by winding and fixing a synthetic resin tape of polyethylene terephthalate, called "Mylar tape", or with a conductive coating layer. With the conductive coating layer, electric connection between a conductive supporting member and a conductive driven member can be further improved.

Since a reinforcing layer is formed at a position axially offset from the image formation area of the photosensitive element, the electrostatic latent image formation will not be adversely affected.

A photosensitive layer and a reinforcing layer can contact with a sheet of a flexible synthetic resin film having an elasticity for preventing scattering of a developer at an upstream side of the rotation of the photosensitive element with respect to the developing roller of the developing device so that scattering of the developer in the electrophotography apparatus can be prevented. The reinforcing layer and the photosensitive layer are formed adjacent to each other in the axial direction of the supporting body without a gap so that scattering of the developer caused by the contact of the sheet can be prevented securely.

The outer diameter of the supporting body is axially parallel, in other words, the outer circumferential surface is right-cylindrical or right-columarar, where a photosensitive layer is formed, and an electrostatic latent image is formed on the photosensitive layer in a photosensitive device and an electrophotography apparatus. Since the photosensitive layer is arranged on an image formation area, which is the area of the supporting body excluding the end for fixing the driven member, the risk of deteriorating the quality of electrostatic latent images by adverse effects on the supporting body at the time of ejection process in the injection molding such as drooling can be avoided.

According to the invention, since a reinforcing layer is formed on the outer circumferential surface in the vicinity of the driven portion, the strength can be improved. By forming the reinforcing layer with a conductive coating layer, a conductive supporting body and a conductive driven member can be electrically connected well.

Since the reinforcing layer is formed axially offset from the image formation area of the photosensitive element, the electrostatic latent image formation will not be adversely affected.

Since the outer diameter of the reinforcing layer has a size substantially the same as that of the photosensitive layer, scattering of a developer in the developing device caused by the contact of the sheet can be securely prevented.

The invention is characterized in that driven portions are arranged at both ends of the supporting member.

According to the invention, since the driven portions are arranged at both axial ends of the supporting member, the driven portions can be easily mounted to the joint members, and thus designing and production can be conducted freer. Furthermore, the production cost can be reduced by providing joint members for supporting both axial ends of the supporting member with the same configuration, and thus the productivity can be improved as well. Besides, in a configuration where the axial ends of the supporting body and the joint members are conductive, electric conductivity therebetween can be achieved securely, and thus the rate of the poor grounding of the photosensitive layer formed on the outer circumferential surface of the supporting body can be realized. Moreover, owing to the configuration with both the axial ends of the supporting body of the same configuration, the supporting body can be mounted in either direction, and thus maintenance operability can be facilitated.

The invention is characterized in that a supporting depression of which an inner circumferential surface is concentric with the outer circumferential surface of the supporting body is formed in the middle of the driven portion so as to face outwardly in the axial direction.

According to the invention, since the supporting depression is provided at the center of the driven portion for supporting the outer circumferential surface of the driven portion of the supporting body, and in addition to the outer circumferential surface of the driven member, the inner circumferential surface thereof can be supported as well. Therefore the driven portion can be supported while being engaged with the joint member securely, and thus backlash or irregular rotation can be prevented.

The invention provides a photosensitive device for electrophotography comprising:

(a) a photosensitive element including:

a cylindrical supporting body made of a synthetic resin, having a a photosensitive layer on the outer circumferential surface thereof, and a driven portion having a plurality of projections and depressions formed alternately so as to be adjacent to each other in the circumferential direction, the driven portion being provided at one end of the supporting body in the axial direction so as to face outwardly in the axial direction, the cylindrical supporting body being solid only in a portion in the vicinity of the one end; and (b) driving means including:

a joint member removably to be engaged with projections and depressions of the driven portion, having the same axis as that of the supporting body, a spring for providing a spring force in a direction where the driven portion and the joint member of the supporting body come close to each other, and a driving power source for rotating and driving the joint member around a rotation axis.

The invention provides a photosensitive device for electrophotography comprising:

(a) a photosensitive element including:

a nearly cylindrical supporting body made of a synthetic resin, having a a photosensitive layer on the outer circumferential surface thereof, and a driven portion having a plurality of projections and depressions formed alternately so as to be adjacent to each other in the circumferential direction, the driven portion being provided at one end of the supporting body in the axial direction so as to face outwardly in the axial direction; and (b) driving means including:

a joint member removably to be engaged with projections and depressions of the driven portion, having the same axis as that of the supporting body, a spring for providing a spring force in a direction where the driven portion and the joint member of the supporting body come close to each other, and a driving power source for rotating and driving the joint member around a rotation axis.

According to the invention, since the driven portion of the supporting body in the driving means is provided with a spring force from the spring, in replacing the photosensitive element, the joint member can be displaced to the direction parting from the photosensitive element and thus the maintenance can be easily conducted.

The invention is characterized in that projections are formed so as to protrude outwardly in the axial direction and taper to the outward in the axial direction.

According to the invention, since the projections are tapered, the joint member applied with a spring force can be engaged with the driven portion of the supporting body securely and smoothly.

The invention is characterized in that a conical guiding surface arranged more inwardly in the radial direction than the projections and depressions and having an outer diameter tapering to the outward in the axial direction is formed in the driven portion of the supporting body, and a joint member comprises a conical receiving surface to be fitted with the guiding surface in a state the axis of the supporting body and the rotation axis of the joint member are on a straight line.

According to the invention, since the conical guiding surface of the driven portion of the supporting body and the conical receiving surface of the joint member fit to each other, the driven portion and the joint member can be engaged by guiding the supporting body and the joint member smoothly.

The invention is characterized in that a conical guiding surface having an inner diameter enlarging to the outward in the axial direction is formed in the inner circumferential surface of the supporting body in the vicinity of the driven portion, and the joint member comprises a guiding projection to be fitted to the guiding surface having an outer diameter smaller than that of the guiding surface so as to have a gap formed with the inner surface of the guiding surface in a fitted state.

According to the invention, the guiding projection of the joint member prevents a compressing force functioning to widen the driven portion of the supporting body outwardly in the radial direction so as to prevent generation of a crack in the driven portion. The gap can be, for example, 0.2 to 0.5 mm. Accordingly, the photosensitive element can be driven rotating with a large torque.

The invention is characterized in that the joint member includes a dent portion axially dent to fit with the driven portion of the supporting body, and driving depressions and driving projections to be engaged respectively with the projections and depressions of the driven portion are formed at the bottom of the dent portion.

According to the invention, since driving depressions and driving projections are formed to be engaged respectively with projections and depressions of the driven portion at the bottom of a dent portion formed in the joint member, the joint member can support the outer and inner circumferential surface of the driven portion of the cylindrical supporting body to rotate the supporting body, and thus the strength can be improved, as well as the supporting body can be rotated stably. Furthermore, the axis of the supporting body and the joint member can be easily maintained on a straight line. Accordingly, the quality of the electrostatic photography can be improved.

The invention is characterized in that a supporting depression having an inner circumferential surface concentric with the outer circumferential surface of the supporting body is formed in the middle of the driven portion so as to face the outward in the axial direction, and that the joint member has a supporting projection for supporting the supporting body by being engaged with the supporting depression.

According to the invention, since the supporting depression is provided at the center of the driven portion for supporting the outer circumferential surface of the driven portion of the supporting body, and the inner circumferential surface thereof can be supported as well. Therefore the driven portion can be supported while being engaged with the joint member securely, and thus backlash or irregular rotation can be prevented.

The invention is characterized in that the supporting body having the driven portion is made of a conductive synthetic resin, and a joint member is made of a conductive material.

According to the invention, since the supporting body and the joint member are made of a conductive material, that is, the supporting body is made of a conductive synthetic resin and the joint member can be made of a conductive synthetic resin or aluminum or another metal, the supporting body can be grounded easily. Besides, the joint member can be connected electrically via a spring. Moreover, since an earth plate, which has been regarded as necessary for grounding of the supporting body, is not required, the production cost can be reduced.

The invention is characterized in that the supporting body having the driven portion is made of a material softer than that of the joint member.

According to the invention, since the supporting body is made of a synthetic resin material, which is softer than that of the joint member, in other words, the joint member is made of a material harder than that of the supporting body, such as aluminum or iron, the joint member can be used over a long period unlike the supporting body, which is an expendable part and requires replacement. Accordingly, the supporting body, which is an expendable part can be made of a material softer than that of the joint member, and the joint member can be made of a material not liable to deteriorate the driven portion of the supporting body in a short time, such as iron and stainless steel. Therefore, the life of the joint member can be extended and the driven portion of the supporting body can ensure the strength in consideration of the life as the photosensitive element.

The invention is characterized in that driving depressions and driving projections formed in the joint member to be engaged with projections and depressions of the driven portion are formed in a number obtained by multiplying the number of the projections and the depressions of the driven portion by two or more, and thereby the joint member can be applied commonly to a plurality of kinds of driven portions.

According to the invention, since the number of dents and projections formed in the joint member is a number obtained by multiplying the number of the dents and projections formed in the driven portion of the supporting body by an integer, the joint member can be applied commonly to a plurality of kinds of photosensitive elements. Accordingly, since different kinds of joint members need not be prepared for each kind of a photosensitive element, the maintenance can be conducted easily.

The invention provides an electrophotography apparatus for forming electrostatic latent images in a photosensitive element provided in a photosensitive device, developing the electrostatic latent images with a developer of a developing device, and transferring and fixing the developed images on a recording sheet, wherein the photosensitive device includes a photosensitive element and driving means, the photosensitive element including:

a nearly cylindrical supporting body made of a synthetic resin, having a photosensitive layer on the outer circumferential surface thereof, and a driven portion having a plurality of projections and depressions formed alternately so as to be adjacent to each other in the circumferential direction, the driven portion being provided at one end of the supporting body in the axial direction so as to face the outward in the axial direction, the nearly cylindrical supporting body being solid only in a portion in the vicinity of the one end;

a reinforcing layer having an outer diameter nearly equal to the outer diameter of the photosensitive layer, being formed on the outer circumferential surface in the vicinity of the driven portion, the driving means including:

a joint member sharing an axis with the supporting body to be engaged removably with projections and depressions of the driven portion, a spring for providing a spring force applied to the direction where the driven portion and the joint member of the supporting body come close to each other, and a driving power source for rotating and driving the joint member around a rotation axis; and wherein the developing device includes a casing to accommodate a developer surrounding a developing roller arranged so as to face the photosensitive element, in which casing a developer scattering prevention sheet contacting with the photosensitive layer and the reinforcing layer on the upstream side with respect to the developing roller in the rotation direction of the photosensitive element.

The invention provides an electrophotography apparatus for forming electrostatic latent images in a photosensitive element provided in a photosensitive device, developing the electrostatic latent images with a developer of a developing device, and transferring and fixing the developed images on a recording sheet, wherein the photosensitive device includes a photosensitive element and driving means, the photosensitive element including:

a nearly cylindrical supporting body made of a synthetic resin, having a photosensitive layer on the outer circumferential surface thereof, and a driven portion having a plurality of projections and depressions formed alternately so as to be adjacent to each other in the circumferential direction, the driven portion being provided at one end of the supporting body in the axial direction so as to face outwardly in the axial direction;

a reinforcing layer having an outer diameter nearly equal to the outer diameter of the photosensitive layer, is formed on the outer circumferential surface in the vicinity of the driven portion, the driving means including:

a joint member sharing an axis with the supporting body to be engaged removably with projections and depressions of the driven portion, a spring for providing a spring force applied to the direction where the driven portion and the joint member of the supporting body come close to each other, and a driving power source for rotating and driving the joint member around a rotation axis; and wherein the developing device includes a casing to accommodate a developer surrounding a developing roller arranged so as to face the photosensitive element, in which casing a developer scattering prevention sheet contacting with the photosensitive layer and the reinforcing layer on the upstream side with respect to the developing roller in the rotation direction of the photosensitive element.

According to the electrophotography apparatus of the invention, since the photosensitive layer and the reinforcing layer adjacent thereto in the axial direction have substantially the same diameter size, scattering of the developer in the electrophotography apparatus can be prevented securely with a developer scattering prevention sheet of the developing device.

BRIEF DESCRIPTION OF THE DRAWINGS

Other and further objects, features, and advantages of the invention will be more explicit from the following detailed description taken with reference to the drawings wherein:

FIGS. 36A, 36A-1, 36B and 36B-1, are side views illustrating a vicinity of a driven portion 109 of a supporting body 102 of the invention;

FIGS. 69A, 69A-1, 69B and 69B-1 are side views illustrating the vicinity of the driven portion 309 of the supporting body 302 of the invention;

DETAILED DESCRIPTION OF THE PREFERRED EMBODIMENTS

Figure 1:
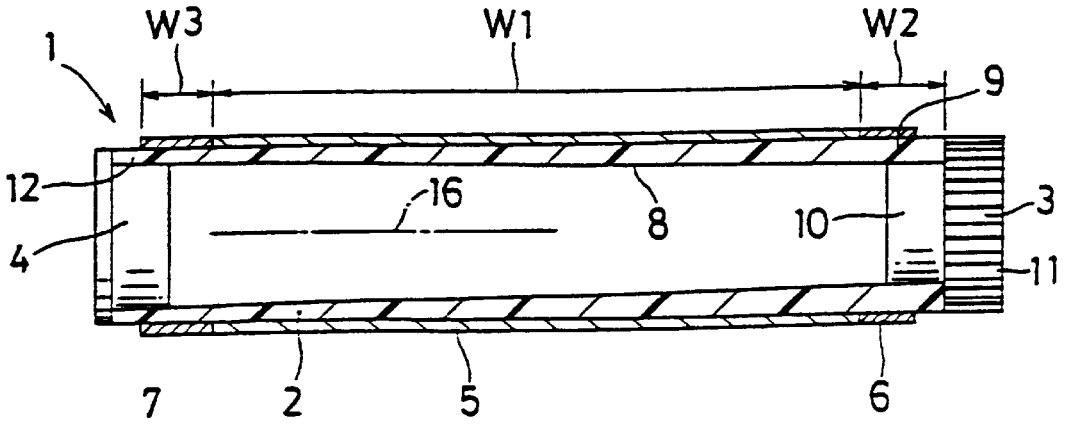
FIG. 1 is a sectional view of one embodiment of a photosensitive element for electrophotography 1 of the invention.

Now referring to the drawings, preferred embodiments of the invention are described below.

FIG. 1 is a sectional view of a photosensitive element for electrophotography 1 of one embodiment of the invention. The photosensitive element for electrophotography 1 is used for forming electrostatic latent images in electrophotography apparatus such as a copying machine or a laser printer later described. The photosensitive element 1 basically comprises a conductive synthetic resin supporting body 2, a driven member 3 to be fixed to one end in the axis 16 direction of the supporting body 2, and a supporting member 4 to be fixed to the other end. The supporting body 2 is cylindrical and the outer diameter is axially parallel, and the inner diameter gradually tapers toward the right side of FIG. 1. A photosensitive layer 5 is formed on the outer circumferential surface of the supporting body 2, and reinforcing layers 6, 7 are formed axially next to the photosensitive layer 5. The supporting member 4 comprises a fitting portion 13 to be fitted to the end 12 of the supporting body 2, and an outward flange 14.

Figure 2:
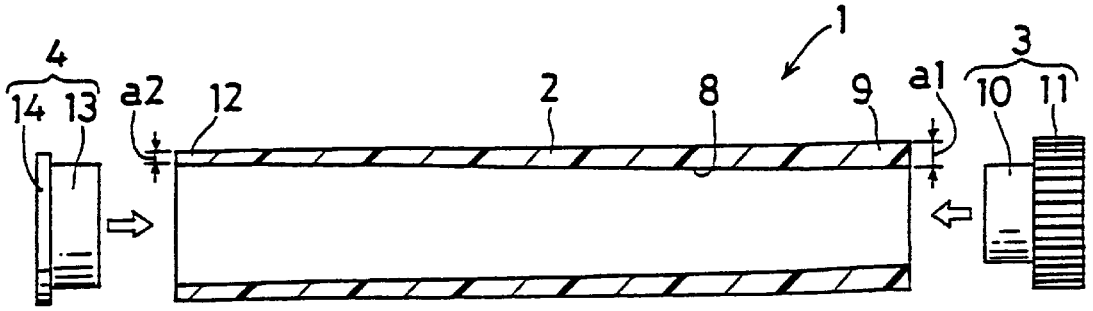
FIG. 2 is an exploded partial-view illustrating elements 2, 3 and 4 of the photosensitive element 1 separately.

FIG. 2 is a diagram illustrating the elements 2, 3 and 4 of the photosensitive element 1 separately. The inner circumferential surface 8 of the supporting body 2 has a draft for injection molding, or an incline larger than the draft with respect to the axis of the supporting body 2. A fitting portion 10 of the driven member 3 is fitted in and fixed to the end having a smaller inner diameter 9 (the right side end of FIGS. 1 and 2) of the supporting body 2. A gear 11 is formed at a position connecting to the fitting portion 10 of the driven member 3. Although an external gear is used as the gear 11 in this embodiment, an internal gear can be used as well. The thickness al of the end 9 of the supporting body 2 to which the driven member 3 is fixed is larger than the thickness a2 of the other end 12 (a1>a2).

Figure 3:
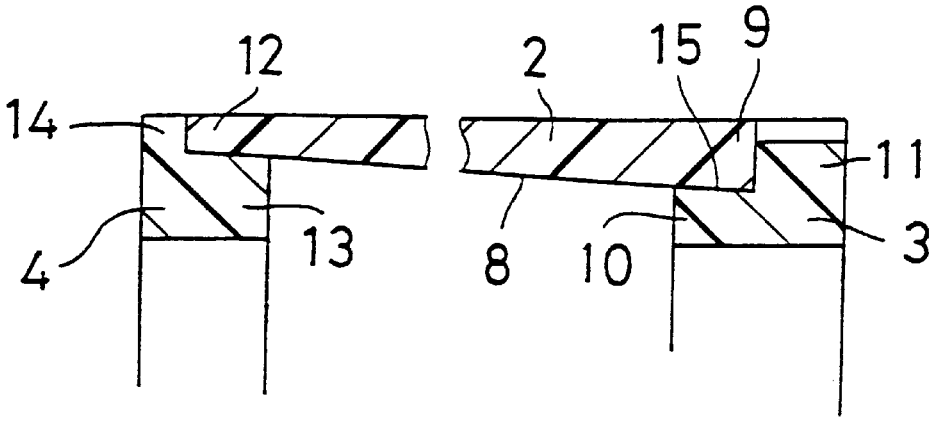
FIG. 3 is an enlarged sectional-view of a vicinity of the driven member 3 and the supporting member 4 of the embodiment of the invention shown in FIGS. 1 and 2.

As illustrated in FIG. 3, the inner circumferential surface 15 of the end 9 connected to the inclined inner circumferential surface 8 of the supporting body 2 is formed nearly parallel to the axis of the supporting body 2, and thus the supporting body 2 is right-cylindrical at the end 9. The fitting portion 10 is formed right-cylindrically as well. Accordingly the supporting body 2 and the driven member 3 are fixed with an adhesive applied between the outer circumferential surface of the fitting portion 10 and the inner circumferential surface 15 of the end 9.

A fitting portion 13 of the supporting member 4 is fitted to the other end 12 of the supporting body 2 and fixed with an adhesive. The outer circumferential surface of the fitting portion 13 can have a slight incline corresponding to the inclined inner circumferential surface 8 of the supporting body 2 and fixed with an adhesive. However, the inner circumferential surface of the end 12 can be formed parallel to the axis of the supporting body 2 so that a right-cylindrical fitting portion 13 is inserted thereto as another embodiment of the invention.

Since the inner circumferential surface 8 of the supporting body 2 has a draft as mentioned above, the supporting body 2, which as a molded product, can easily be taken out from the mold at the time of the injection molding. Since the driven member 3 is fixed to the thicker end 9 having a larger difference between the outer circumferential surface and the inner circumferential surface 8 of the supporting body 2, the mechanical strength can be improved without increasing the amount of the synthetic resin for the supporting body 2, and thus crack, crazing or breakage at the end 9 of the supporting body can be prevented.

The size of the supporting body 2 can be, for example, 270 to 280 mm in the entire length, 30 mm ϕ in the outer diameter, 27 mm ϕ in the inner diameter in the vicinity of the end 9, 28 mm ϕ in the inner diameter of the other end 12. A draft can be 0.15 to 0.25 degree on one side.

The supporting body 2 is made of a mixture of a synthetic resin, a conductive material, a light absorbing material and a light scattering material. Examples of applicable synthetic resins include a polyacetal resin, polypropylene, polyethylene, polyvinyl chloride, polystyrene, an ABS resin, noryl, nylon, polycarbonate, polybutylene terephthalate and polyethylene fluoride, and a mixture thereof. However, they are not limited to these examples and any moldable material can be used as well.

Examples of conductive materials include carbon blacks such as thermal black, acetylene black, furnace black, lamp black and graphite, metals such as tin oxide, antimony oxide, gold, silver, copper, aluminum, and a compound thereof, and inorganic compounds such as zinc oxide, titanium dioxide, aluminum oxide, calcium carbonate, barium sulfate, mica, potassium titanate, aluminum borate and silicon carbide doped with a conductive material. In addition to a conductive material, a material such as a light absorbing material and a light scattering material can be included in the resin in order for preventing interference fringes of a laser beam.

Examples of light absorbing materials include the various carbons mentioned above, and coloring matters such as phthalocyanine, but are not limited thereto. Examples of light scattering materials include various kinds of metal powders. Conductive materials, light absorbing materials and light scattering materials can be identical or different. For example, carbons are good conductive materials as well as good light absorbing material, and further, can be dispersed well in a resin and are inexpensive.

Although a constitution in which a conductive material and other materials are included in a synthetic resin in the invention, these materials may not be included. For example, after forming the supporting body 2 only with a synthetic resin, a conductive layer may be formed by depositing aluminum to the surface thereof. In this case, a process of mixing (dispersing) the resin and the conductive material can be omitted. Further, in addition to the deposition method, a method of forming a conductive layer by coating after forming the supporting body 2 of only a synthetic resin can be used as well.

In addition to these materials, inorganic pigments such as glass beads, titan oxide, barium sulfate, calcium carbonate, silica, talc, zinc sulfate and clay, or organic pigments can be added as a filler. It is preferable the amount of the above-mentioned materials are 5 to 300 weight parts with respect to 100 weight parts of a synthetic resin. By heating the synthetic resin, conductive material, light absorbing material and light scattering material to a temperature to or higher than the melting temperature of the synthetic resin and kneading, fine particles can be dispersed homogeneously in the synthetic resin. Then by placing the material into a mold, the supporting body 2 can be injection-molded preferably. In addition to an integral molding using a mold, molding can be conducted in various methods such as protrusion molding in order for forming a drum-like supporting body. However, since the protrusion molding requires driven member 3 to be assembled by compressing or bonding after the formation of the photosensitive layer 5, the integral molding of the supporting body 2 as mentioned above, which does not require the additional process, is preferable.

Furthermore, it is preferable that the surface of the portion of the mold where the photosensitive layer 5 is to be formed is roughened by sand blasting beforehand so as to improve the adherence between the photosensitive layer 5 and the outer circumferential surface of the supporting body 2 and the light-scattering property. It is preferable to have a roughness on the surface of the mold so that the roughness on the surface of the molded supporting body becomes 1 μm or less. Since a roughness more than 1 μm causes unevenness in the formation of a charge generation layer, it is not preferable. As heretofore mentioned, the photosensitive layer 5 is formed on the portion for forming a photosensitive layer of the supporting body.

A supporting body 2 is prepared with a synthetic resin mainly containing a crosslinking-type polyphenylene sulfide resin, to which a highly-conductive carbon black with a volume resistivity of $10^{-1}$ Ω·cm or less is added so as to have the volume resistivity of $10^{4}$ Ω·cm or less, with an average particle size of the carbon black of 20 nm to 50 nm, preferably with the ratio of the crosslinking-type polyphenylene sulfide resin of at least 40 weight %, with the surface of the supporting body treated by irradiating an ultraviolet ray of a wavelength of 180 nm to 255 nm. Accordingly, the supporting body 2 provides stable quality with a good conductivity, a light weight, excellent chemical resistance and heat resistance, good size accuracy even in a thin, long-length configuration, without degradation such as oxidization even in an atmosphere.

The driven member 3 and the supporting member 4 may be made of a material similar to the supporting body 2. Or the driven member 3 can be made of a conductive material, such as a metallic material like aluminum.

As an adhesive to bond the supporting body 2, driven member 3 and supporting member 4, a one-liquid type or two-liquid type adhesive, such as an epoxy type synthetic resin or a polyurethane resin can be used. For example, "Polysic Polybond (an adhesive produced by 3M Co. of the United States)" is commercially available. A conductive adhesive may be used as well.

A photosensitive layer 5 may be made of an organic material. A thickness of the photosensitive layer 5 is, for example, 10 to 30 μm, preferably about 20 μm. The photosensitive layer 5 is formed in the image formation area W1 of an electrophotography apparatus. In the areas W2, W3 axially adjacent to the photosensitive layer 5 of the supporting body 2, reinforcing layers 6, 7 are formed at the ends 9, 12. A thickness of the reinforcing layers 6, 7 is substantially the same as that of the photosensitive layer 5, and thus the outer diameter of the photosensitive layer 5 and the outer diameter of the reinforcing layers 6, 7 are almost equivalent. Accordingly, as later described, a developer scattering prevention sheet securely contacts with the photosensitive layer 5 and the reinforcing layers 6, 7 so as to prevent scattering and leakage of the developer from the developing device to the outside, and improve the image quality.

Reinforcing layers 6, 7 are synthetic resin films made of polyethylene terephthalate or the like, which is commercially available as "Mylar tape". The reinforcing layers 6, 7 are prepared by winding such a tape around the outer circumferential surface of the ends 9, 12 of the supporting body 2 as one layer or a plurality of layers. Therefore, since the reinforcing layers 6, 7 are formed in non-image formation areas, which have nothing to do with image formation of the supporting body 2, generation of crack, crazing or breakage of the supporting body 2 by the stress on the end 9 of the supporting body 2 at the time of fitting the fitting portion 10 of the driven member 3 can be prevented, and thus the strength can be improved.

Although a synthetic resin forming a supporting body 2 is, in general, vulnerable and thus has a problem of weakness with respect to the load perpendicular to the axis of the photosensitive element 1, by forming the reinforcing layer 6 as mentioned above, the strength can be improved and thus the problem can be solved. The same is applied to the reinforcing layer 7.

In another embodiment of the invention, the reinforcing layer 6 is composed of a conductive coating layer. The conductive coating layer is prepared by dissolving a synthetic resin material capable of bonding with the synthetic resin material which the supporting body 102 is made of, such as polycarbonate, nylon, acrylic resin in a solvent, dispersing particles of a conductive material, such as carbon black, thermal black and acetylene black, and coating. By this process, the strength can be improved as well as the end 9 of the supporting body 2 and the driven member 3 can be securely connected electrically.

Figure 4:
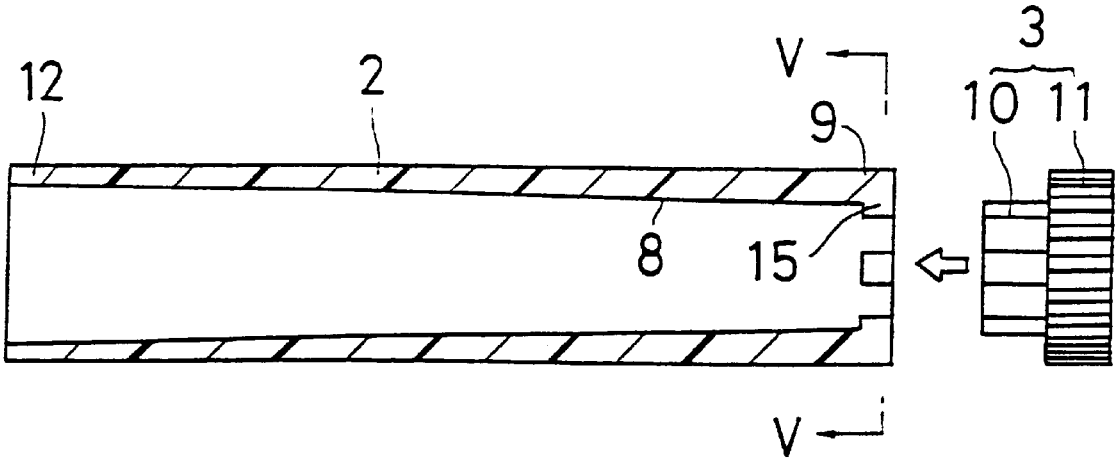
FIG. 4 is a sectional view illustrating elements of another embodiment of the invention separately.

FIG. 4 is a sectional view of another embodiment of the invention illustrating elements separately. Since the configuration is similar to the above-mentioned configuration, the corresponding parts bear the same numerals. The feature of this embodiment is that projections 15 protruding further inwardly in the radial direction from the inner circumferential surface 8 tapering with respect to the axis are provided at the end 9 of the supporting body 2.

Figure 5:
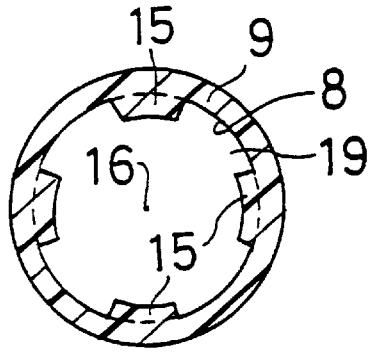
FIG. 5 is a sectional view taken on the cutting-plane line V—V of FIG. 4.

FIG. 5 is a sectional view taken on the cutting-plane line V—V of FIG. 4. The projections 15 are provided plane-symmetrical with respect to the plane including the axis 16 of the supporting body 2 with a regular interval on the circumferential surface.

Figure 6:
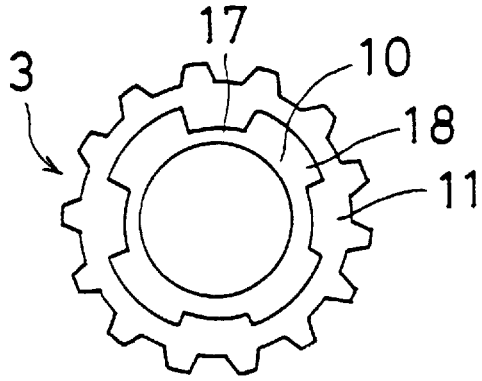
FIG. 6 is a plan view of the driven member 3 of the embodiment of the invention shown in FIG. 4 viewed from the left side.

As illustrated in FIG. 6, stopping grooves 17, axially elongating (toward the horizontal direction in FIG. 4, and toward the direction perpendicular to the paper surface in FIG. 6) to be engaged with the projections 15 are provided at the fitting portion 10 of the driven member 3. The fitting portion 10 further comprises projections 18. The projections 18 are engaged with the inner circumferential surface 8 of the end 9 of the supporting body 2 by being inserted to stopping grooves 19 formed alternately with the projections 15.

Figure 7:
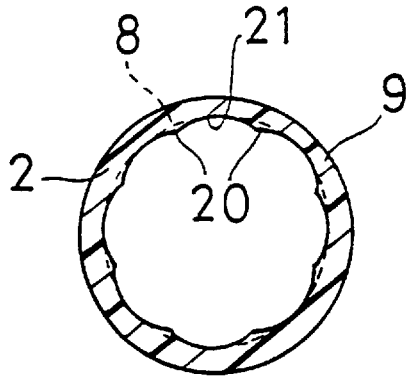
FIG. 7 is a sectional view of a supporting body 2 of another embodiment of the invention.

FIG. 7 is a sectional view of a supporting body 2 of another embodiment of the invention. FIG. 7 corresponds with FIG. 5. Projecting portions 20 protruding inwardly in the radial direction from the inner circumferential surface 8 are provided in the supporting body 2. Arc-like stopping grooves 21 are provided between the projections 20.

Figure 8:
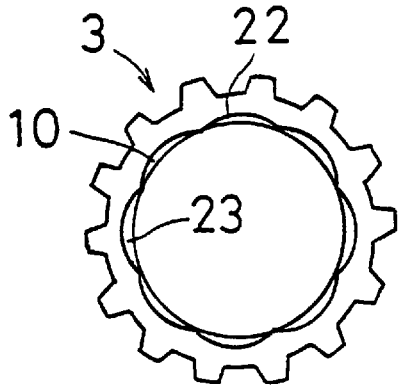
FIG. 8 is a plan view of a driven member 3 to be fitted into the end 9 of the supporting body 2 shown in FIG. 7.

FIG. 8 is a plan view of the driven member 3 to be fitted into the end 9 of the supporting body 2 shown in FIG. 7. A fitting portion 10 is provided with stopping grooves 22 to engage with the projections 20 by being inserted and projections 23 to engage with grooves 21 are provided to the fitting portion 10. The other features of the configuration are the same as those of the embodiment shown in FIGS. 4 to 6.

According to the embodiment shown in FIGS. 4 to 8, a photosensitive element 1 can be produced with an improved mechanical strength with a minimum amount of a synthetic resin at a low cost. Furthermore, since the bonding area can be enlarged, bonding strength of an adhesive can be improved.

Figure 9:
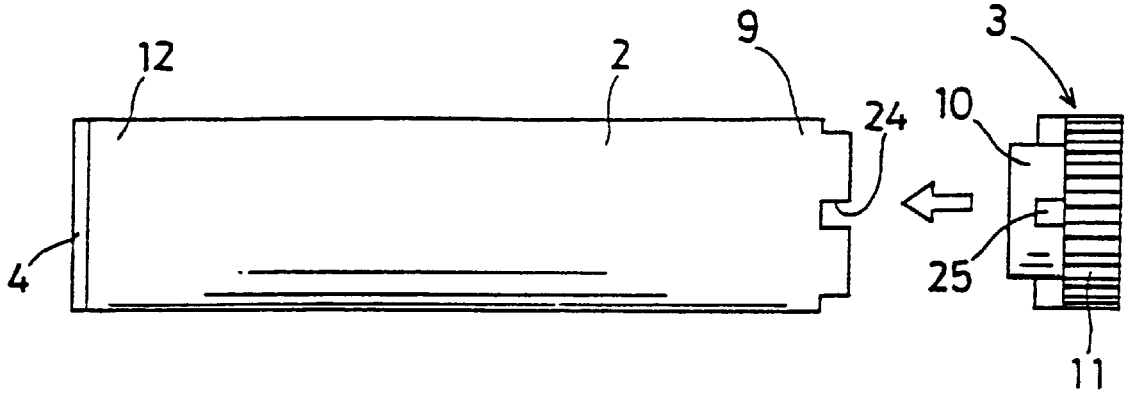
FIG. 9 is a side view illustrating some of the members of another embodiment of the invention separately.

FIG. 9 is a side view of another embodiment of the invention. This configuration is similar to the embodiments mentioned above and thus corresponding parts bear the same numerals. A plurality of axially extending notches 24 are provided at the end 9 of the supporting body 2.

Figure 10:
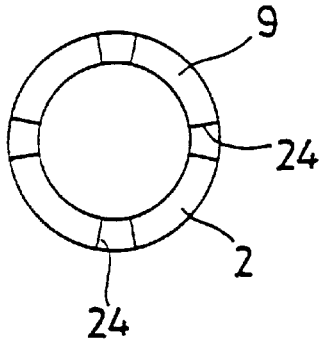
FIG. 10 is a plan view of the end 9 of the supporting body 2.

FIG. 10 is a plan view of the end 9 of the supporting body 2. A plurality of (in this embodiment, 4) notches 24 are provided at regular intervals in the circumferential direction. The fitting portion 10 of the driven member 3 is inserted and fitted into the end 9. Stopping projections 25 are formed on the outer circumferential surface of the fitting portion 10.

Figure 11:
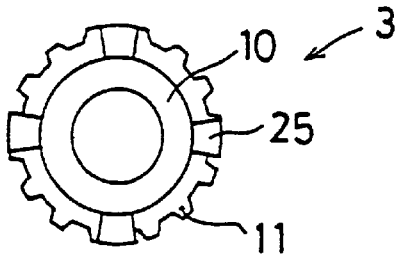
FIG. 11 is a plan view of the driven member 3.
Figure 12:
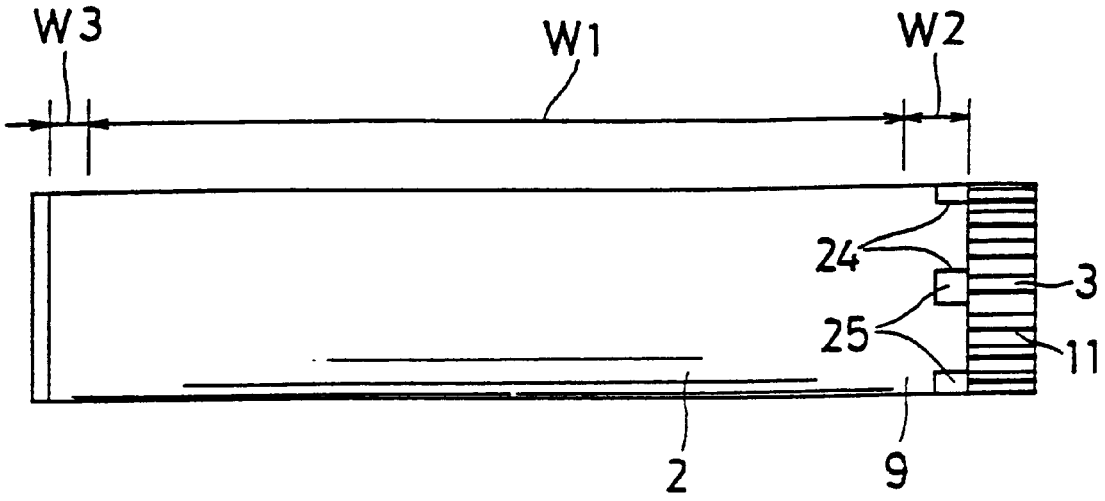
FIG. 12 is a side view of the embodiment of the invention shown in FIGS. 9 to 11.

FIG. 11 is a plan view of the driven member 3. The stopping projections 25 correspond respectively with notches 24, and as shown in FIG. 12, the fitting portion 10 of the driven member 3 is fitted into the supporting body 2, and the stopping projections 25 are fitted to the notches 24 to be engaged.

Figure 13:
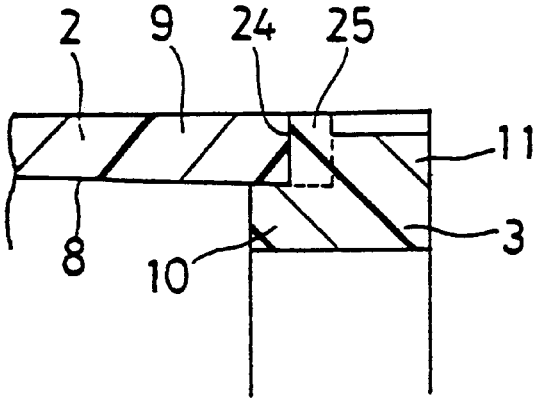
FIG. 13 is a sectional view of the fitting portion 10 of the driven member 3 fitted in and fixed to the end 9 of the supporting body 2.

FIG. 13 is a sectional view illustrating the state where the fitting portion 10 of the driven member 3 is fitted in and fixed to the end 9 of the supporting body 2 of the embodiment shown in FIGS. 9 to 12. According to the configuration, the bonding area of an adhesive can be increased to improve the strength. Besides, since a plurality of the notches 24 and the stopping projections 25 are provided in the circumferential direction, a force on the supporting body 2 can be distributed to the circumferential direction, and thus the strength can be improved. Furthermore, since the dislocation with respect to the driven member 3 at the end 9 can be prevented, the supporting body 2 and the driven member 3 can be fitted and fixed firmly.

Figure 14:
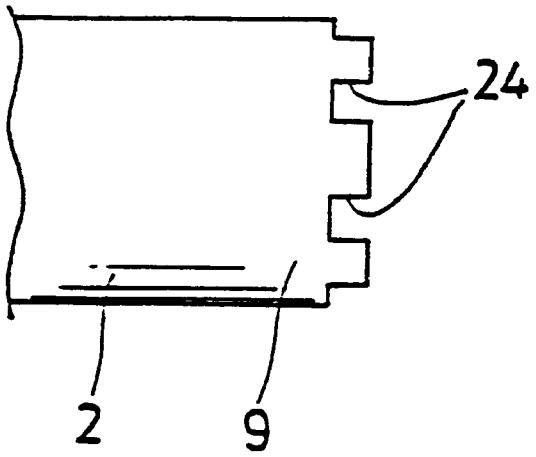
FIG. 14 is a side view of the end 9 of the supporting body 2 of another embodiment of the invention.
Figure 15:
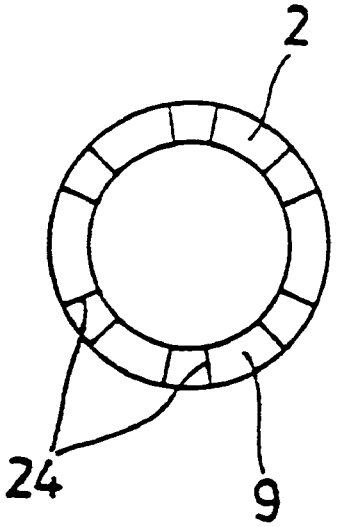
FIG. 15 is a plan view of the end 9 of the supporting body 2.

FIG. 14 is a side view illustrating the end 9 of the supporting body 2 of another embodiment of the invention. FIG. 15 is a plan view of the end 9 of the supporting body 2. This embodiment is similar to the embodiment shown in FIGS. 9 to 13. However, the feature of this embodiment is a larger number of (in this embodiment, 6) notches 24 are provided compared with the embodiment of FIGS. 9 to 13. Accordingly, the strength can be improved in the state where the supporting body 2 and the driven member 3 are fixed as well as the stable rotation can be ensured without the risk of peel-off of an adhesive. Since a torque from the driven member 3 to the supporting body 2 can be transmitted via not only an adhesive but also notches 24 and stopping projections 25, the supporting body 2 can be rotated stably without the risk of the peel-off of an adhesive as mentioned above.

Figure 16A:
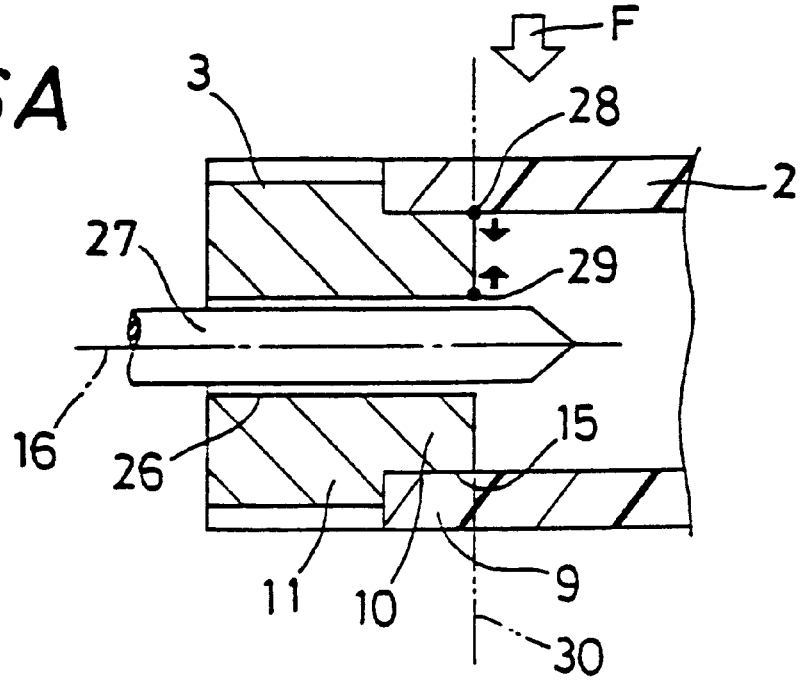
FIGS. 16A and 16B are sectional views illustrating a vicinity of the driven member 3 of one embodiment of the invention and the configuration for reference.

FIG. 16 is a schematic diagram of a driven member 3 of one embodiment of the invention. A supporting hole 26 is provided in the driven member 3 with the same axis in both the fitting portion 10 and the driven portion 11. A right-columnar supporting shaft 27 is inserted through the supporting hole 26. A first edge position 28 where the inner circumferential surface of the end 9 of the supporting body 2 and the outer circumferential surface of the fitting portion 10 contact with each other inwardly in the axial direction of the supporting member 2, and a second edge position 29 where the inner circumferential surface of the supporting hole 26 and the outer circumferential surface of the supporting shaft 27 contact with each other share a same coordinate with respect to the axis 16, in other words, are both on a straight line 30 perpendicular to the axis 16, and are positioned at points having horizontally the same coordinate but vertically different coordinates in FIG. 16A. A state where the driven member 3 is fixed to the supporting body 2, as in FIG. 16A, is also shown in FIG. 17A. Even when a load F is on the vicinity of the end 9 of the supporting body 2, since the first and second edge positions 28, 29 share a same coordinate with respect to the axis 16, the risk of breakage of the end 9 of the supporting body 2 can be avoided and thus the strength can be improved.

Figure 16B:
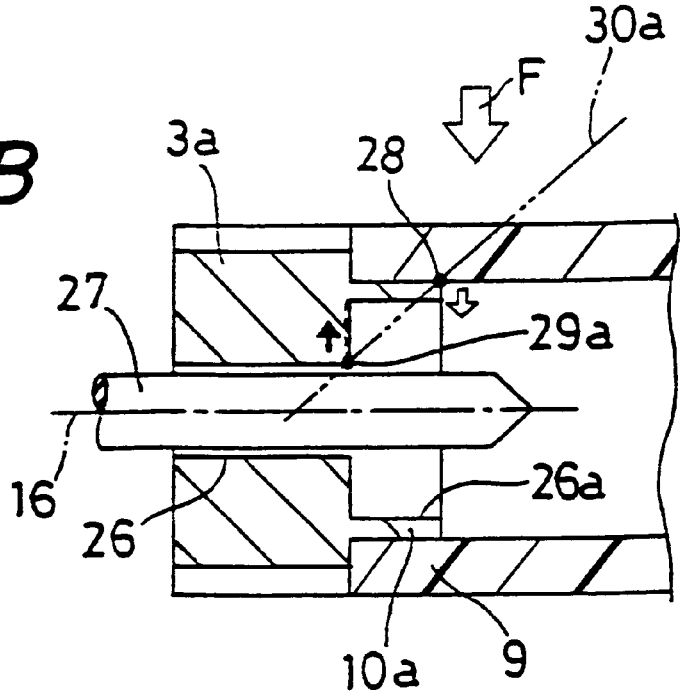
Figure 17A:
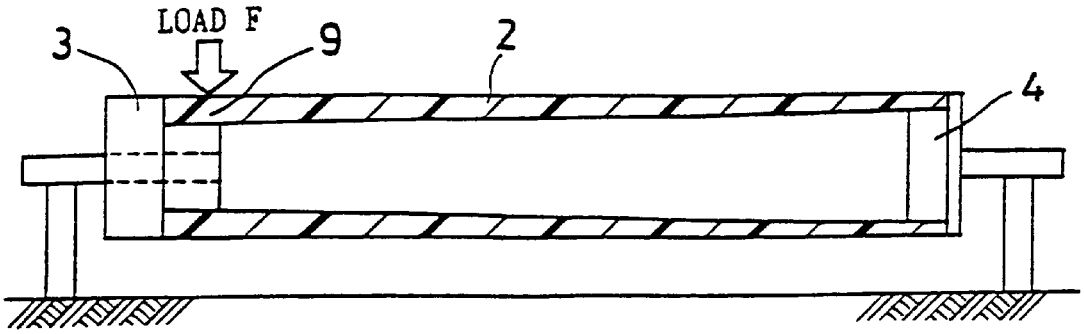
FIGS. 17A and 17B are sectional views illustrating the state of measuring the strength of the load F in one embodiment of the invention.
Figure 17B:
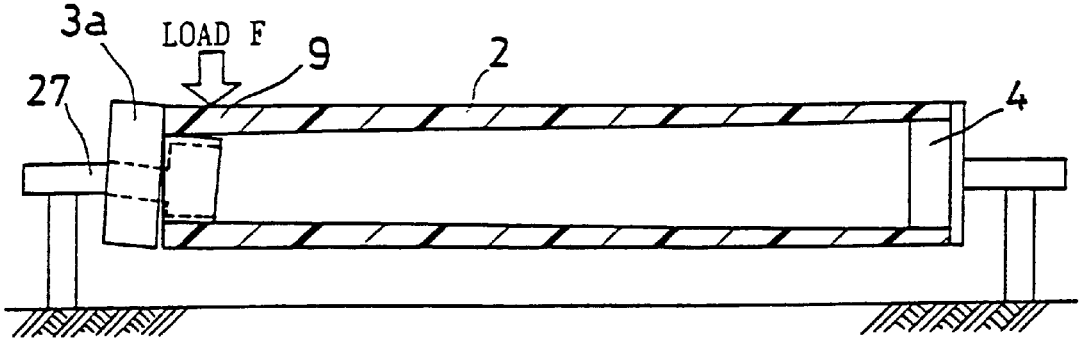

FIG. 16B is provided for comparison, illustrating an embodiment where the supporting hole 26 of the fitting portion 10*a* of the driven member 3 has a larger diameter at a position close to the supporting body 2 (toward the right direction of FIG. 16B). In this embodiment, a second edge position 29*a* where the inner circumferential surface of the supporting hole 26 and the outer circumferential surface of the supporting shaft 27 contact with each other with a coordinate different from that of the first edge position 28 with respect to the axis 16 of the supporting body 2. Therefore, in case when a load F perpendicular to the axis 16 functions in the vicinity of the end 9, as illustrated in FIG. 17B, the vicinity of the end 9 of the supporting body is liable to break, and thus the strength is deteriorated. Since the line connecting the first and second edge positions 28, 29*a* is not perpendicular to the axis 16 as shown with a broken line 30*a* in FIG. 16B, the fitting portion 10*a* is liable to apply a twisting force on the end 9 of the supporting body 2 due to the force F, the risk of breakage of the end 9 is high. According to the invention, as illustrated in FIGS. 16A and 17A, since a line connecting the first and second edge positions 28, 29 is perpendicular to the axis 16, the strength can be improved with respect to the force F functioning perpendicular to the axis 16, and the breakage of the end 9 of the supporting body 2 can be prevented.

Figure 18:
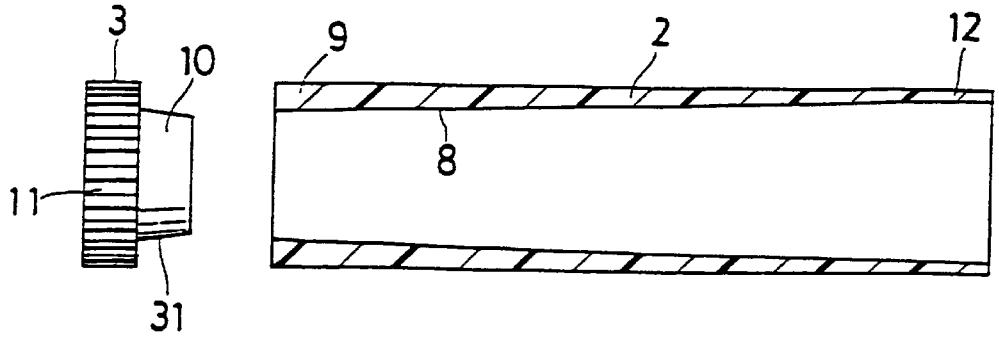
FIG. 18 is a partial sectional view of another embodiment of the invention.

FIG. 18 is a partial sectional view of another embodiment of the invention. In this embodiment, the outer circumferential surface 31 of the fitting portion 10 of the driven member 3 has a diameter gradually tapering to the inward in the axial direction of the supporting body 2 (to the right direction from the end 9 in FIG. 18) to have a truncated cone-like shape. Accordingly, the fitting portion 10 can be smoothly inserted and fitted into the inner circumferential surface 8 of the thicker end 9 of the supporting body 2, and thus the generation of breakage such as crack or crazing of the end 9 can be prevented. A right-columnar fitting portion 10 of a driven member 3 tends to generate breakage such as crack or crazing in fitting process by an intolerable force on the end 9, whereas the invention is to solve this problem.

Figure 19:
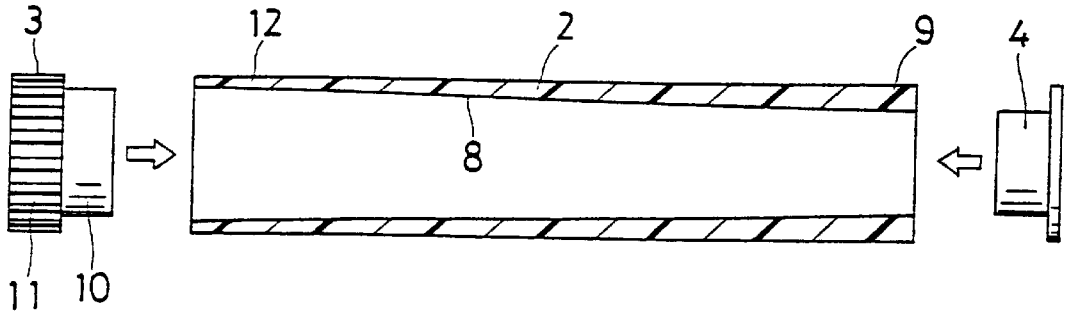
FIG. 19 is a sectional view illustrating the elements of another embodiment of the invention separately.
Figure 20:
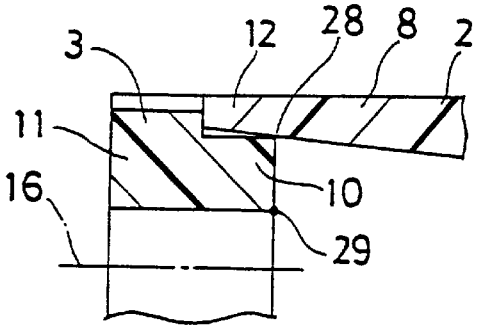
FIG. 20 is a sectional view illustrating a vicinity of the driven member 3 of the embodiment of the invention shown in FIG. 19.

FIG. 19 is a sectional view illustrating another embodiment of the invention with elements separately. In this embodiment, the supporting body 2 is thinner, and thus the fitting portion 10 of the driven member 3 is fitted to the end 12 having a larger inner diameter as illustrated in FIG. 20, and fixed with an adhesive. As explained with reference to FIGS. 16 and 17, since the first and second edge positions 28, 29 share the same coordinate with respect to the axis 16, the strength can be improved in the state where a force F perpendicular to the axis 16 is applied, and thus the breakage of the end 12 of the supporting body 2 can be prevented. Such configuration is also included in the spirit of the invention. The other features of the embodiment of FIGS. 19 and 20 are the same as those of the embodiments shown in FIGS. 16A and 17A.

Figure 21:
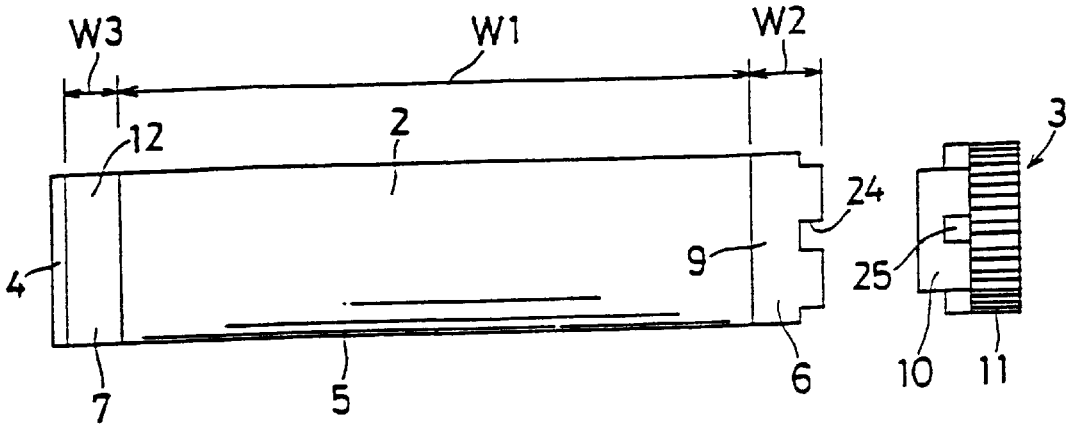
FIG. 21 is a side view illustrating the elements of still another embodiment of the invention separately.

FIG. 21 is a side view of still another embodiment of the invention showing the elements separately. This configuration is similar to the embodiment shown in FIGS. 9 to 13, and corresponding parts bear the same numerals. The feature of this embodiment is that a coating layer 6 is formed in the non-image formation area W2 adjacent to the photosensitive layer 5 at the end 9 of the supporting body 2. Owing to the reinforcing layer 6, crack or crazing of the end 9 of the supporting body 2 can be prevented and the strength can be improved.

Figure 22:
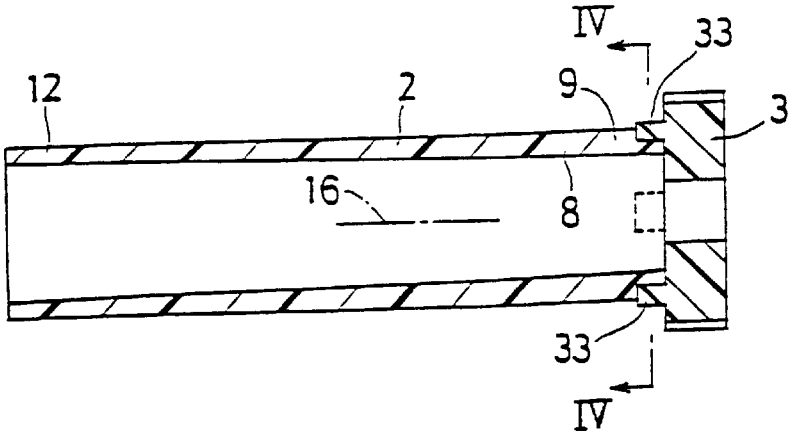
FIG. 22 is a partial sectional view of another embodiment of the invention.

FIG. 22 is a partial sectional view of another embodiment of the invention. Stopping grooves 33 being dent from the outer circumferential surface 32 which has a round shape in the section plane perpendicular to the axis 16 of the supporting body 2 are formed at the end 9 of the supporting body 2.

Figure 23:
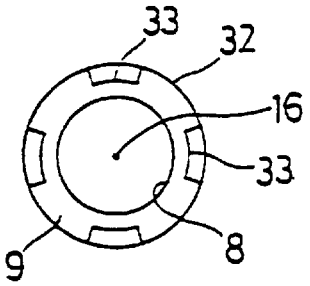
FIG. 23 is a plan view of the end 9 of the supporting body 2 shown in FIG. 22 viewed from the right side.

FIG. 23 is a plan view of the end 9 of the supporting body 2 of FIG. 22 viewed from the right side. A plurality of (in this embodiment 4) stopping grooves 33 are formed on the circumferential surface with a regular interval, but in another embodiment, are formed symmetrically with respect to a symmetrical plane including the axis 16. The stopping grooves 33 are formed on the end 9 elongating along the axis 16.

Figure 24:
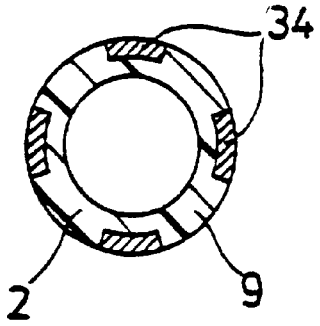
FIG. 24 is a sectional view taken on the cutting-plane line IV—IV of FIG. 22.

FIG. 24 is a sectional view taken on the cutting-plane line IV—IV of FIG. 22. Projecting portions 34 protruding in the axis 16 direction for being engaged respectively with stopping grooves 33 are provided in the driven member 3. The projections 34 fit and engage with the stopping grooves 33 at the end 9 of the supporting body 2 from a radially outer direction. According to this configuration, the supporting body 2 can be provided with a minimum amount of a synthetic resin as well as the adhesion strength with an adhesive with respect to the driven member can be improved. Besides, the strength can be improved since a intolerable force would not be applied on the end 9.

Figure 25:
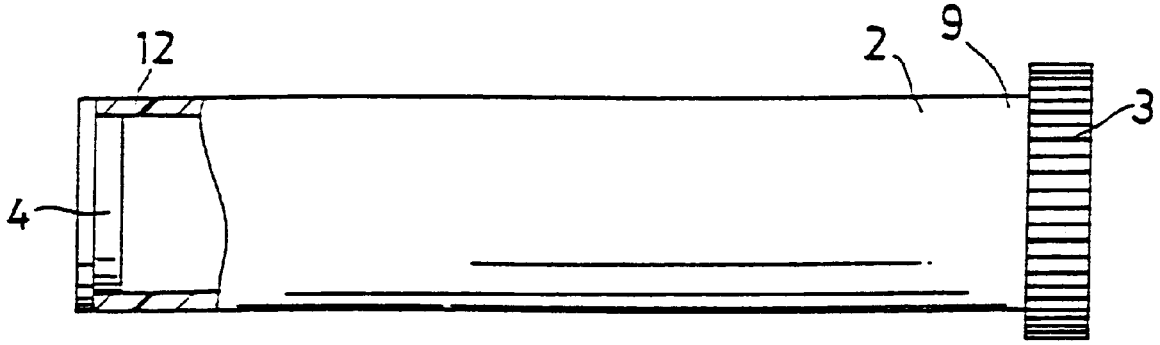
FIG. 25 is a partial sectional view of still another embodiment of the invention.
Figure 26:
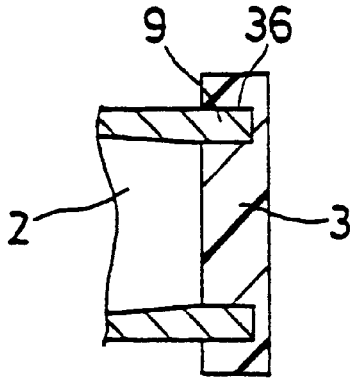
FIG. 26 is an enlarged sectional view of the vicinity of the driven member 3 of the embodiment of FIG. 25.

FIG. 25 is a partial sectional view of still another embodiment of the invention. FIG. 26 is an enlarged sectional view in the vicinity of the driven member 3. This configuration corresponds with the above embodiment, and corresponding parts bear the same numerals. The feature of this embodiment is that the end 9 of the supporting body 2 is fitted and fixed to a round-groove 36 formed in the driven member 3.

Figure 27:
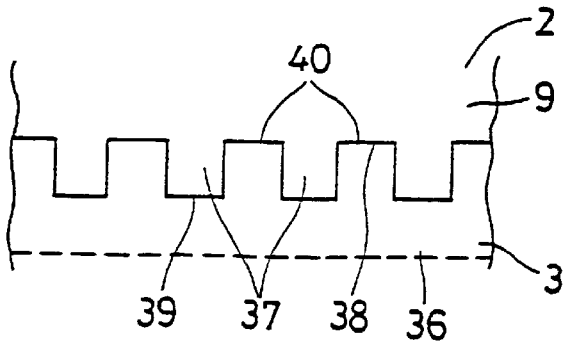
FIG. 27 is a development along the circumferential direction of the end 9 shown in FIGS. 25 and 26.

FIG. 27 is a development along the circumferential direction of the end 9 of the embodiment shown in FIGS. 25 and 26. Axially protruding projections 37 and notches 38 are alternately formed so as to be adjacent to each other in the circumferetial direction on the end 9 of the supporting body 2. The projections 37 are fitted to driving depressions 39 and driving projections 40 formed at the bottom of the groove 36 respectively. Accordingly, the outer and the inner circumferential surface of the supporting body 2 can be supported by the contact with the inner circumferential surface of the driven member 3 facing the groove 36 in the radial direction and firmly fixed with an adhesive.

Furthermore, in the embodiment of FIGS. 25 to 27, since the projections 39 and the notches 38 formed at the end 9 of the supporting body 2 are fitted and engaged with the driving depressions 39 and the driving projections 40 at the bottom of the groove 36, a torque form the driven member 3 can be securely transmitted to the end 9 of the supporting body 2. However, a configuration not having projections 39 or notches 38 in the end 9, accordingly not having driving depressions 39 or driving projections 40 on the groove 36 can be applied as another embodiment of the invention.

Figure 28:
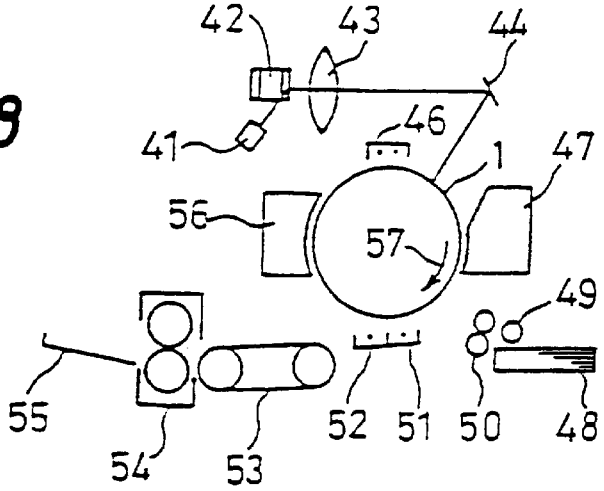
FIG. 28 is a schematic diagram illustrating the entire configuration of a laser printer of one embodiment of the invention.

FIG. 28 is a schematic diagram of the entire constitution of a laser printer of one embodiment of the invention. A laser beam outputted from a semiconductor laser source 41 is modulated based on the information signal to be recorded from a reading device or a computer. The laser beam is manipulated with a rotating polyhedron42 and a reflecting mirror 44, and focused on a photosensitive layer 5 on a photosensitive element 1 by an image-formation lens 43, accordingly an electrostatic latent image is formed on the photosensitive layer 5. The image-formation lens 43 has an $f \cdot \theta$ characteristic, namely, depends on an amount of light f and a refractive angle of light $\theta$.

The photosensitive element 1 is driven to rotate in the direction shown by the arrow 57. The surface of the photosensitive layer 5 is homogeneously charged by a main charging device 46, and exposed to a laser beam scanning parallel to the rotation axis 16 of the photosensitive element 1. Accordingly an electrostatic latent image is formed on the surface of the photosensitive element 1, and the electrostatic latent image is developed by a developer in a developing device 47. The developed toner image is transferred by a transfer charging device 51 on a recording sheet supplied timely from a sheet supply cassette 48 via a feeding roller 49 and a resist roller 50. The recording sheet is removed from the surface of the photosensitive element 1 by a removing charging device 52 and conveyed to a fixing device 54 by a conveyor belt 53. The fixing device 54 is to fix a toner image on a recording sheet by heat, and the fixed recording sheet is discharged onto a discharge tray 55. A developer remained on the surface of the photosensitive element 1 after transfer is collected from the surface of the photosensitive layer 5 of the photosensitive element 1 by a cleaner 56 for purifying.

Figure 29:
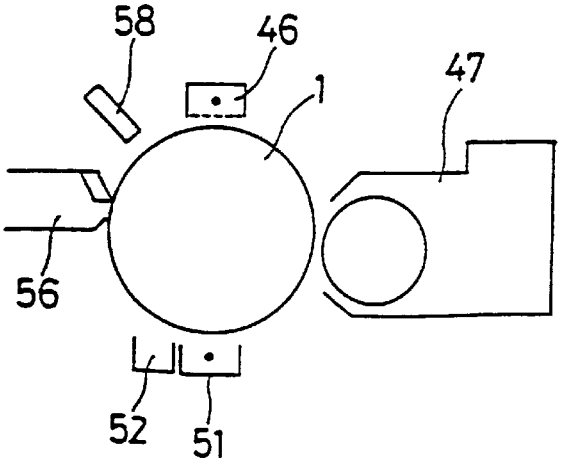
FIG. 29 is a schematic diagram illustrating the vicinity of the photosensitive element 1 shown in FIG. 28.

FIG. 29 is a schematic diagram of the vicinity of the photosensitive element 1 shown in FIG. 28. Residual charge on the surface of the photosensitive element 1 after cleaning with the cleaner 56 is eliminated by a charge eliminating lamp 58.

Figure 30:
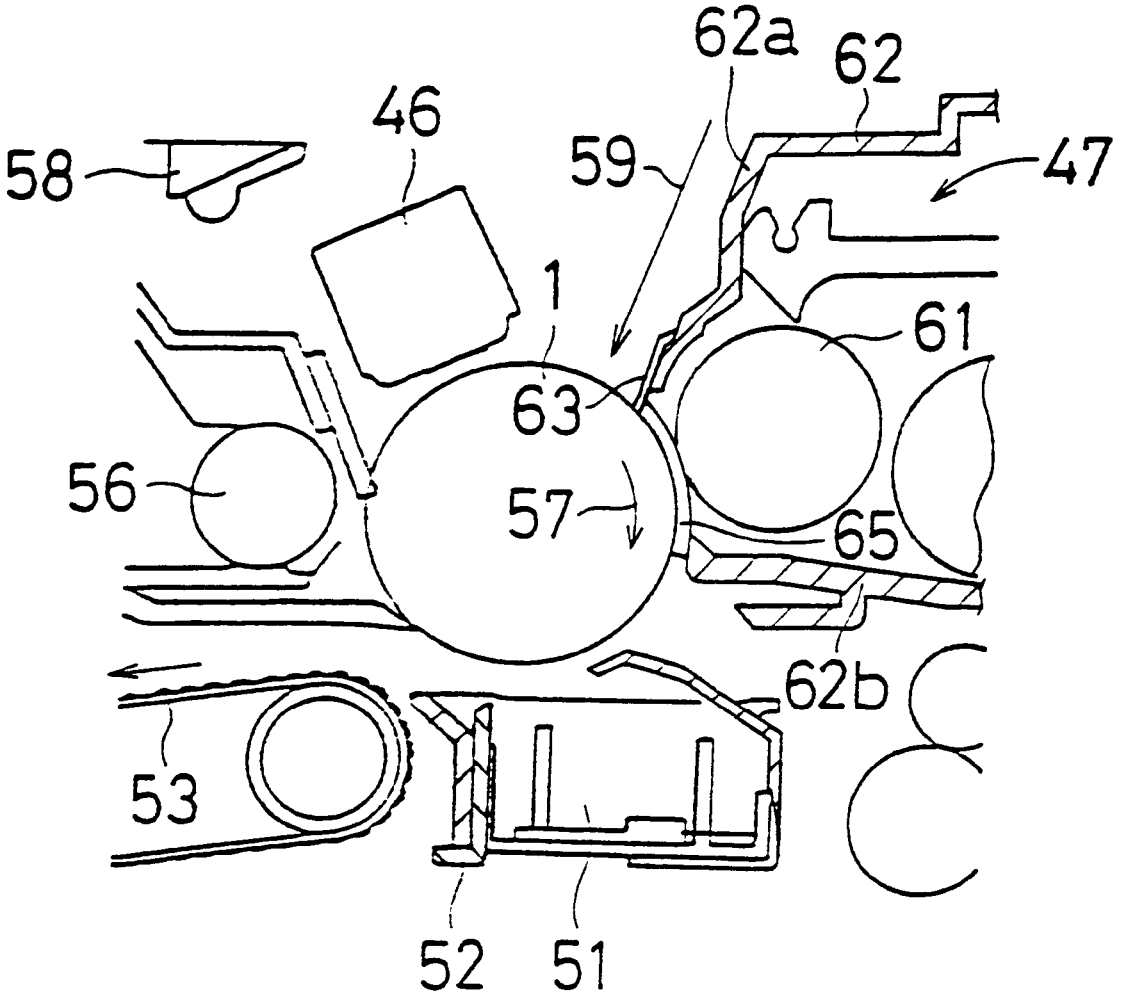
FIG. 30 is a sectional view illustrating a part of the laser printer shown in FIGS. 28 and 29 in further detail.

FIG. 30 is a partial sectional view further illustrating the details of the laser printer shown in FIGS. 28 and 29. The surface of the photosensitive layer 5 is charged by the main charging device 46. In the developing device 47, casing 62 for storing a developer surrounding a developing roller 61 arranged facing to a photosensitive element 45 is provided with a developer scattering prevention sheet 63 contacting with a photosensitive layer 5 and reinforcing layers 6, 7 at a position upstream of the rotation direction 57 of the photosensitive element 45 with respect to the developing roller 61.

Figure 31:
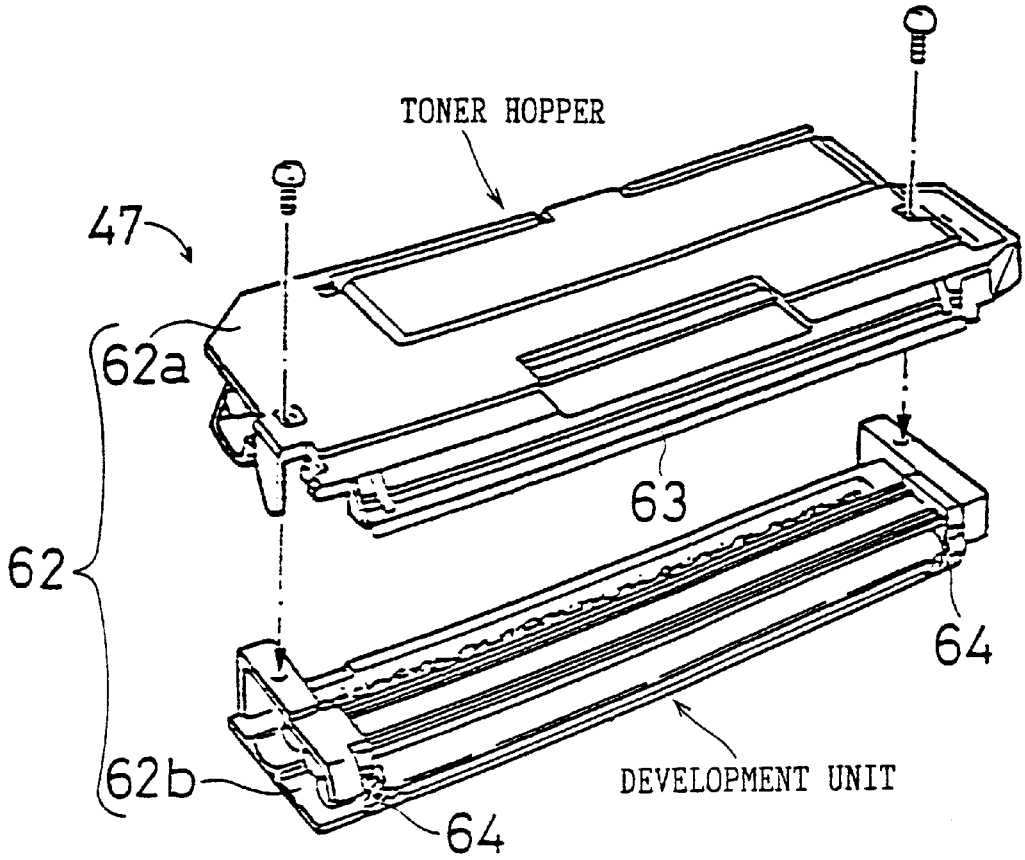
FIG. 31 is a perspective view of a developing device 47 illustrating elements separately.

FIG. 31 is a perspective view of the developing device 47 illustrating elements separately. The casing 62 comprises an upper casing portion 62*a*, to which a sheet 63 is mounted, and a lower casing portion 62*b*. The sheet 63 is made of a material having elasticity and flexibility, such as rubber or a synthetic resin. Suede members 64 made of a flexible material such as a synthetic resin or rubber are provided so as to close the aperture 65 of the casing 62 at the axial ends of the supporting body 2 with respect to the photosensitive element 45 at the endss 9, 12 where reinforcing layers 6, 7 are arranged.

Figure 32:
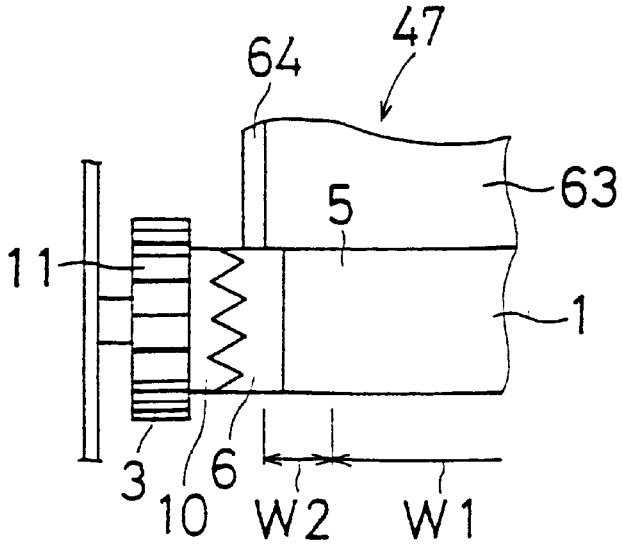
FIG. 32 is a plan view of the vicinity of the photosensitive element 1 of the embodiment shown in FIGS. 28 to 31.

FIG. 32 is a plan view of the vicinity of the photosensitive element 45 of the embodiment shown in FIGS. 28 to 31. The aperture 65 formed in the casing 62 of the developing device 47 is closed by the sheet 63 and the suede members 64 provided at both the sides. Accordingly, scattering of the developer in the casing 62 to the inside of the laser printer of the invention can be prevented and thus the vicinity will not be ruined.

Figure 33:
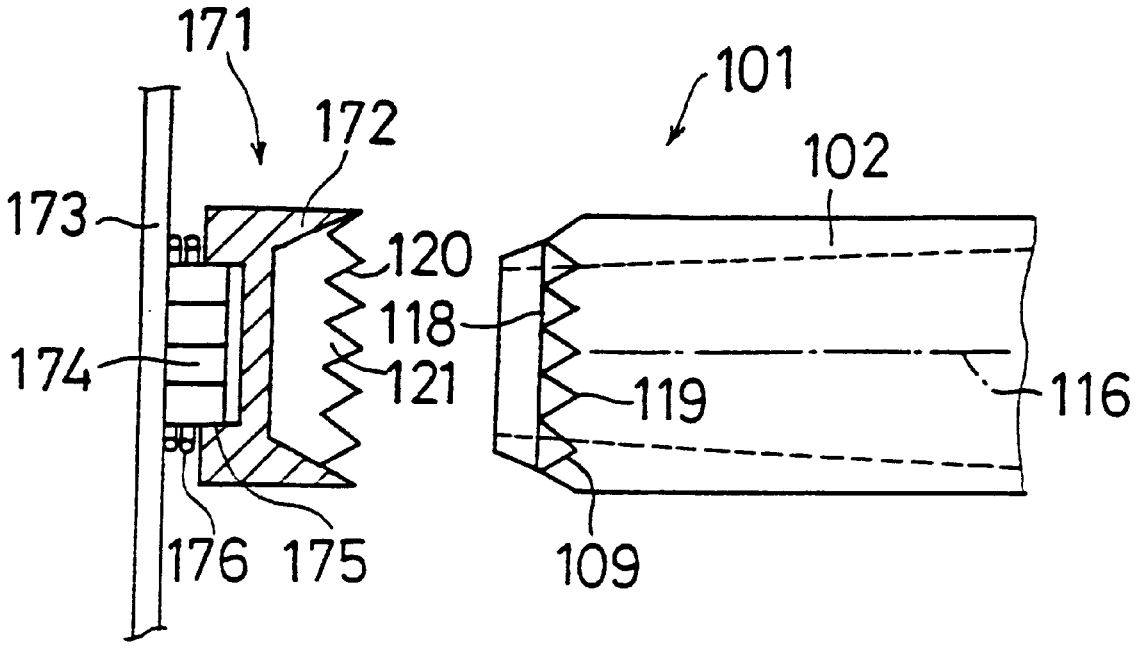
FIG. 33 is a sectional view of a photosensitive element for electrophotography 101 of one embodiment of the invention.

FIG. 33 is a sectional view of a photosensitive element for electrophotography 1 of one embodiment of the invention. The photosensitive element for electrophotography 1 is used for forming electrostatic latent images in electrophotography apparatus such as a copying machine or a laser printer later described. The photosensitive element 171 basically comprises a conductive synthetic resin supporting body 102 and driving means 171 to drive at one axially end of the axis 116 of the supporting body 102. The driving means 171 comprises a joint member 172. The supporting body 102 is cylindrical and the outer diameter is axially parallel, and the inner diameter gradually tapers toward the left side of FIG. 33 so as to form a draft for injection molding, and thus the left side of the driven member 109 in FIG. 33 is thicker.

Figure 34:
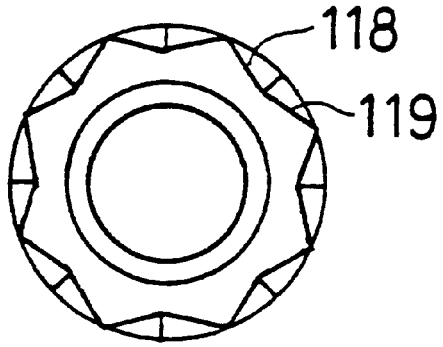
FIG. 34 is a plan view of the supporting body 102 of FIG. 33 viewed from the left side.

FIG. 34 is a plan view of the supporting body 2 of FIG. 33 viewed from the left side. In the driven portion 109 a plurality of projections 118 and depressions 119 are alternately formed so as to be adjacent to each other in the circumferential direction. The projections 118 and the depressions 119 are arranged toward outer direction with respect to the axis 116 (the left side of FIG. 33, or the upper direction from the paper surface of FIG. 34). The joint member 172 comprises driving depressions 120 and driving projections 121 to be engaged with the projections 118 and the depressions 119, and the joint member 172 shares the axis 116 with the supporting body 102 in a fitted state.

Figure 35:
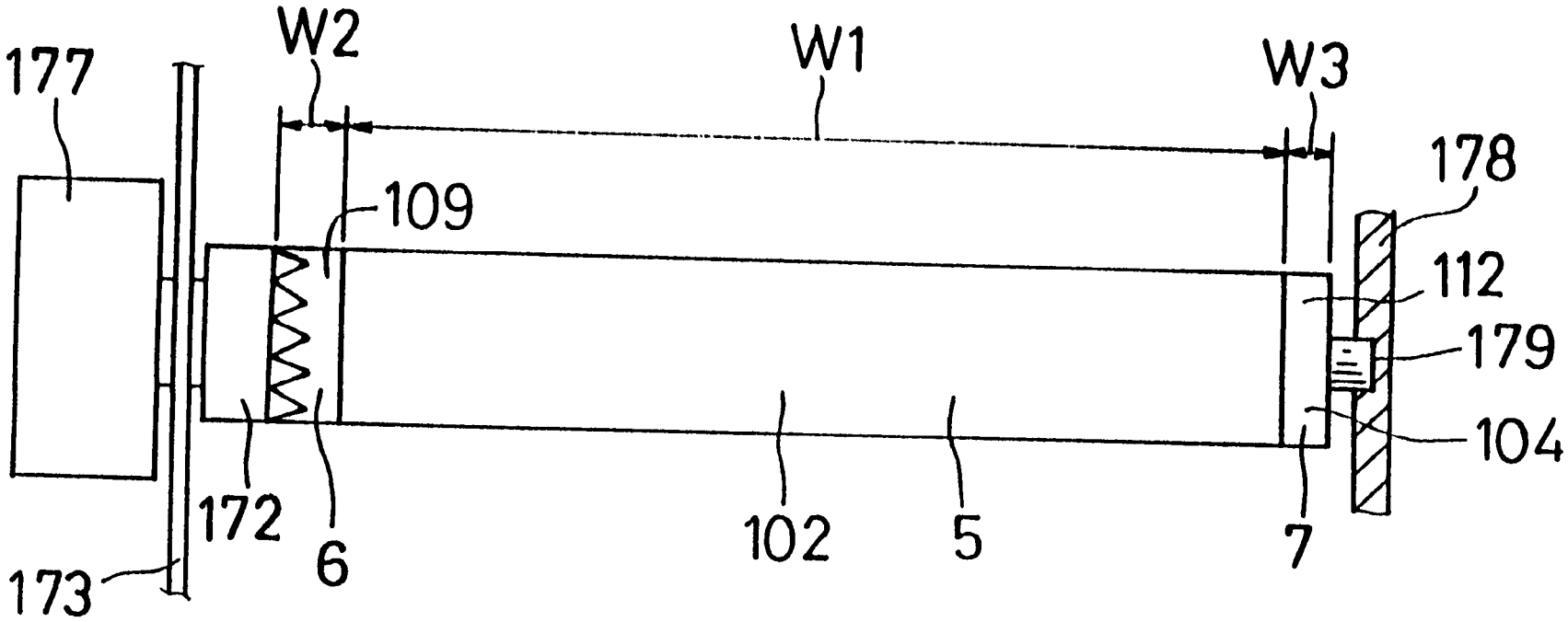
FIG. 35 is a side view of the embodiment of the invention shown in FIGS. 1 and 2.

FIG. 35 is a side view of the embodiment shown in FIGS. 33 and 34. A photosensitive layer 5 comprising an organic photosensitive material is formed in the image formation area W1 on the outer circumferential surface of the supporting body 2. Reinforcing layers 6, 7 are provided in the non-image formation areas W2, W3 adjacent to both the axially ends of the photosensitive layer 5.

The joint member 172 comprises a fitting portion 175 having a constitution of a spline for fitting to the driving shaft 174 to be driven rotating at the side wall 173 of an electrophotography apparatus, and the joint member 172 is provided with a spring force toward the supporting body 302 by the function of a spring 176. The driving shaft 174 is rotated around the axis 116 by a driving power source 177 such as a gear. A supporting member 104 is provided removably or fixed at the end 112 opposite to the end having a driven portion 309 of the supporting body 302, and the supporting member 104 is supported rotatably by a bearing 179 at the side wall 178 of the electrophotography apparatus.

The size of the supporting body 2 can be, for example, 270 to 280 mm in the entire length, 30 mm ϕ in the outer diameter, 27 mm ϕ in the inner diameter in the vicinity of the end 9, 28 mm ϕ in the inner diameter of the other end 12. A draft can be 0.15 to 0.25 degree on one side.

FIG. 36 is a side view illustrating the vicinity of the driven portion 109 of the supporting body 102 of the invention. As shown in FIG. 36A, the edge portion 118*a* of the projection 118 and the bottom 119*a* of the depression 119 of the driven portion 109 are curved. Similarly, the bottom 120*a* and the edge portion 121*a* of the driving depression 120 and the driving projection 121 are curved as well. Accordingly, the projection 118 is smoothly fitted to the driving depression 120, and the depression 119 is smoothly fitted to the driving projection 121 so that the attachment is secured and the risk of damaging the supporting body 102 can be prevented.

As shown in FIG. 36B, in the case the edge portion 118a of the projection 118 and the bottom 119*a* of the depression 119 are sharp, and similarly the bottom 120*a* of the driving depression 120 and the edge portion 121*a* of the driving projection 121 are sharp, crack 180 or chipping 181 is liable to generate. However, such configuration shown in FIG. 36B is also included in the spirit of the invention.

The edge portion 118*a* of the projection 118 and the bottom 120*a* of the driving depression 120 do not contact to each other. Similarly, the bottom 119*a* of the depression 119 and the edge portion 121*a* of the driving projection 121 do not contact to each other. Therefore, the damage can be prevented further securely.

Figure 37:
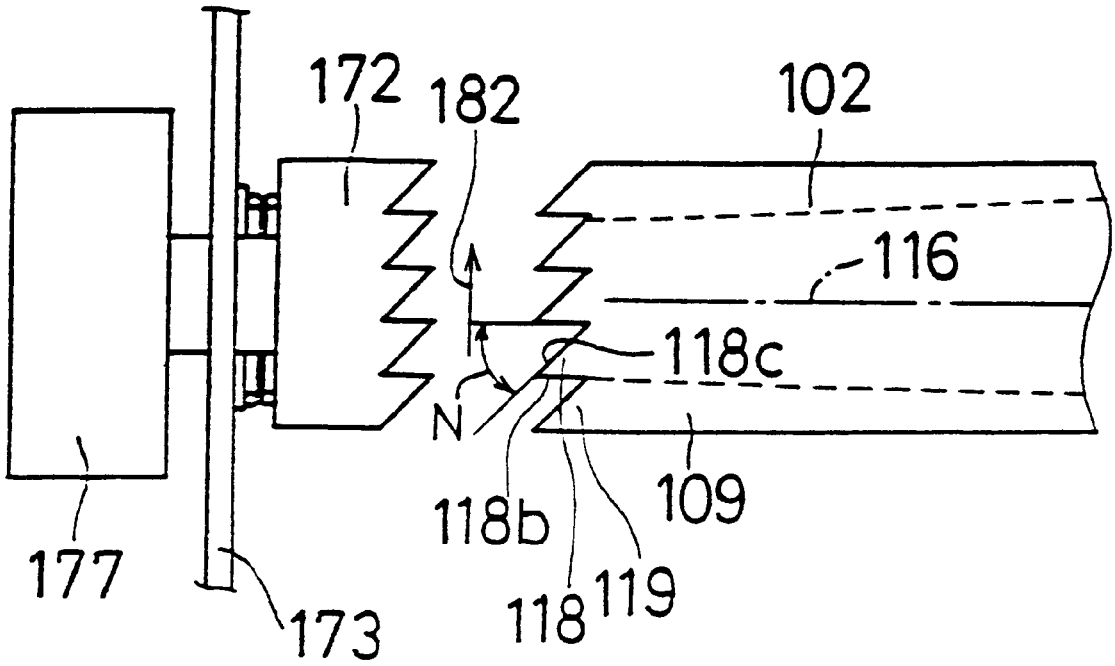
FIGS. 37 is a side view of another embodiment of the invention.
Figure 38:
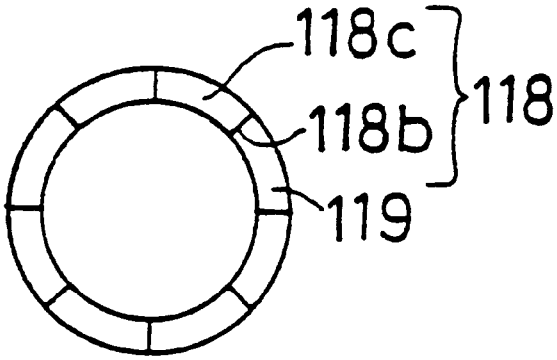
FIG. 38 is a plan view illustrating projections 118 and depressions 119 of the driven portion 9 of FIG. 5.

FIG. 37 is a side view of another embodiment of the invention. This embodiment is similar to the above configuration, and the same parts bear the same numerals. The feature of this embodiment is that the upstream surface 118b with respect to the rotation direction 182 of the projection 118 is nearly parallel to the rotation axis 116 or inclined to the upstream side of the rotation direction toward the axially outward direction (toward the left direction in FIG. 37). In this configuration, the joint member 172 is fitted to the driven portion 109. According to an experiment of the inventor, an angle N made by the upstream surface 118*b* with respect to the rotation direction of the projection 118 and the downstream surface 118*c* is preferably 45 to 90 degrees. According to the configuration, even when a torque of 40 kgf·cm or larger functions on the supporting body 102 for rotation driving, the rotation power can be securely transmitted from the joint member 172 to the driven member 109. FIG. 38 illustrates the constitution of the projections 118 and the depressions 119 of the driven portion 109 apparently.

Figure 39:
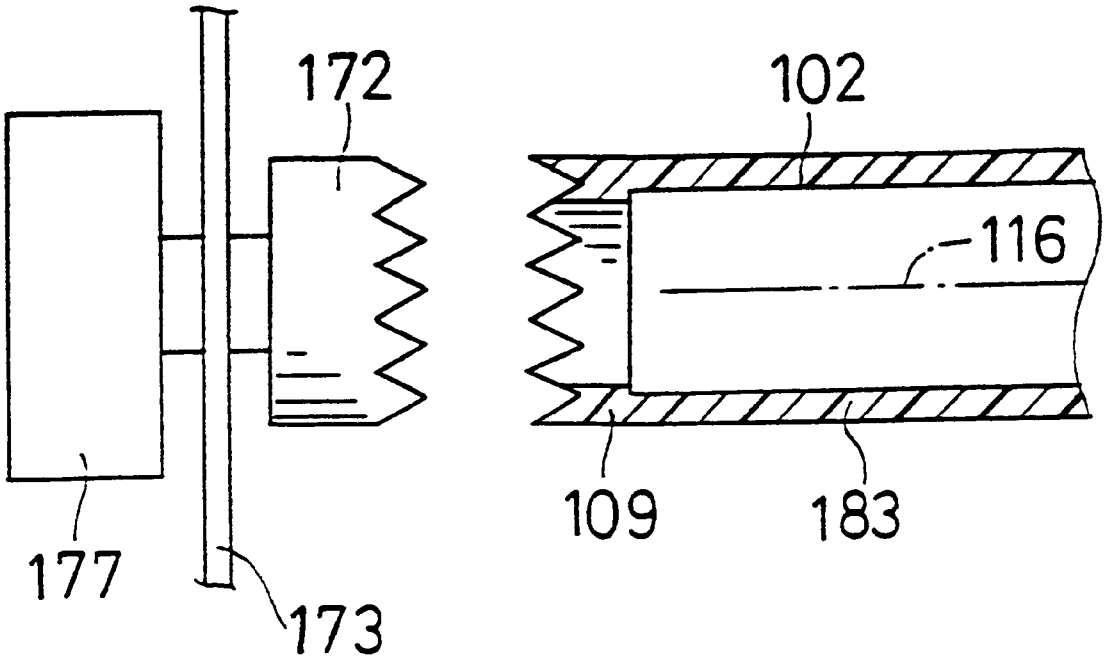
FIG. 39 is a sectional view of still another embodiment of the invention.

FIG. 39 is a sectional view of still another embodiment of the invention. A driven portion 109 at the axially end of the supporting body 102 is formed thicker than the rest 183 of the supporting body 102. Accordingly the strength can be improved.

Figure 40:
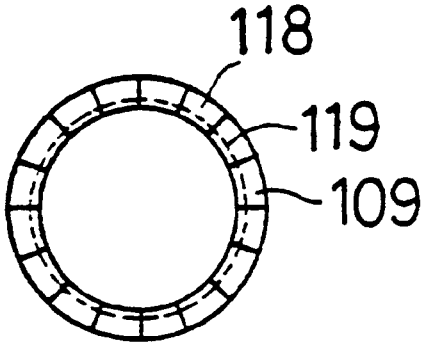
FIG. 40 is a plan view of the driven member 109 of the supporting body 102 of the embodiment shown in FIG. 39 viewed from the left side.

FIG. 40 is a plan view of the driven portion 109 of the supporting body 102 of the embodiment shown in FIG. 39 viewed from the left side. Projecting portions 118 and depressions 119 are formed similarly as in the above embodiment.

Figure 41:
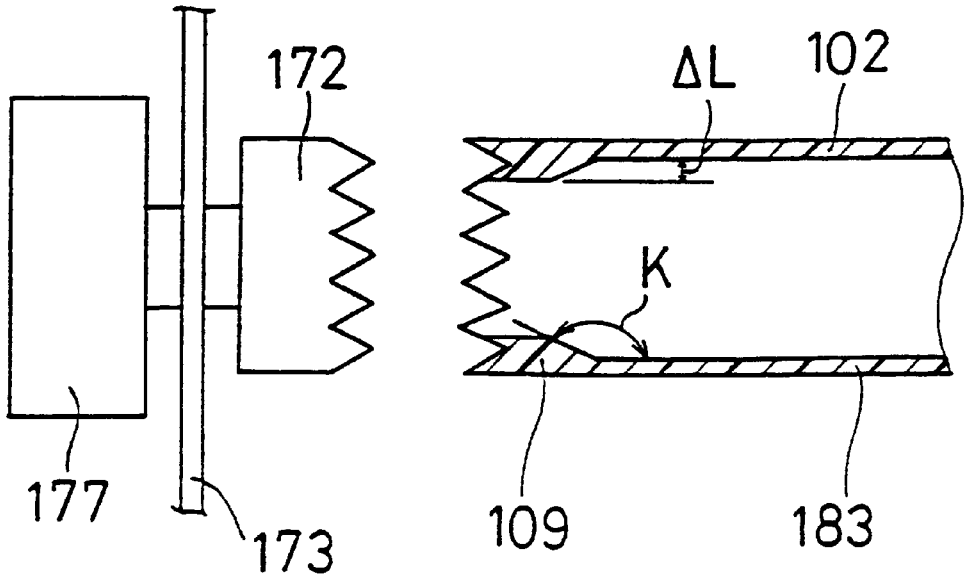
FIG. 41 is a sectional view of still another embodiment of the invention.

FIG. 41 is a partial sectional view of still another embodiment of the invention. This embodiment is similar to the embodiment shown in FIGS. 39 and 40. The feature of this embodiment is that the driven portion 109 is thicker than the rest 183 of the supporting body 102, and further an obtuse angle K is formed therebetween. Accordingly, the strength can be improved by preventing stress concentration. The strength is improved by forming the driven portion 109 thicker than the rest 183 by a thickness ΔL.

Figure 42:
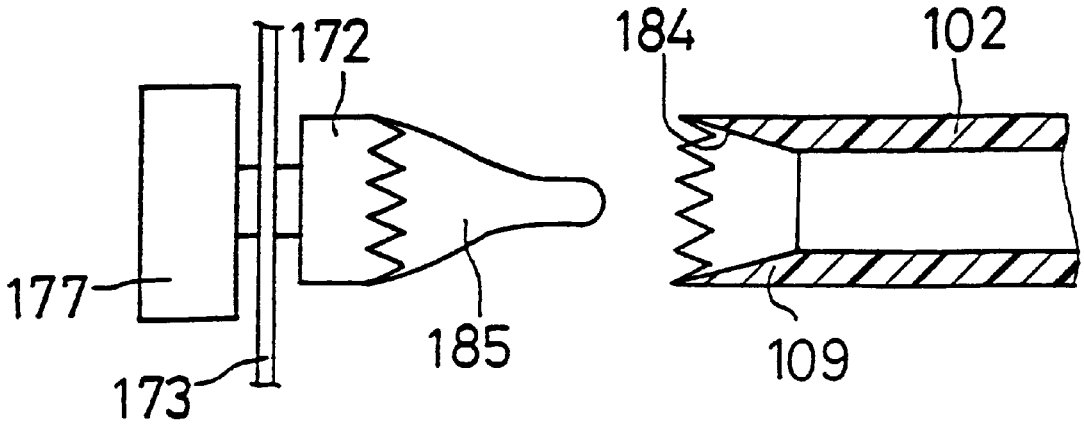
FIG. 42 is a sectional view of still another embodiment of the invention.

FIG. 42 is a sectional view of still another embodiment of the invention. The inner circumferential surface 184 of the driven portion 109 of the supporting body 102 comprises a conical guiding surface 184 where the inner diameter enlarges toward the axially outward direction (the left side of FIG. 42). A joint member 172 comprises a conical guiding projection 185 to be fitted to the guiding surface 184.

Figure 43:
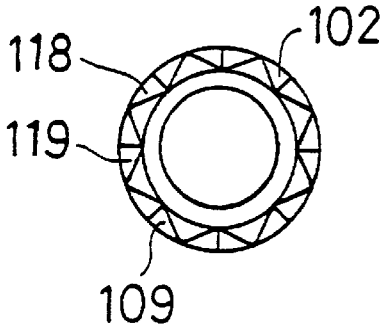
FIG. 43 is a plan view of the driven portion 109 of the supporting body 102 of FIG. 42 viewed from the left side.

FIG. 43 is a plan view of the driven portion 109 of the supporting body 102 of FIG. 42 viewed from the left side. The driven portion 109 comprises projections 118 and depressions 119, and this configuration is similar to the embodiments mentioned above.

Figure 44:
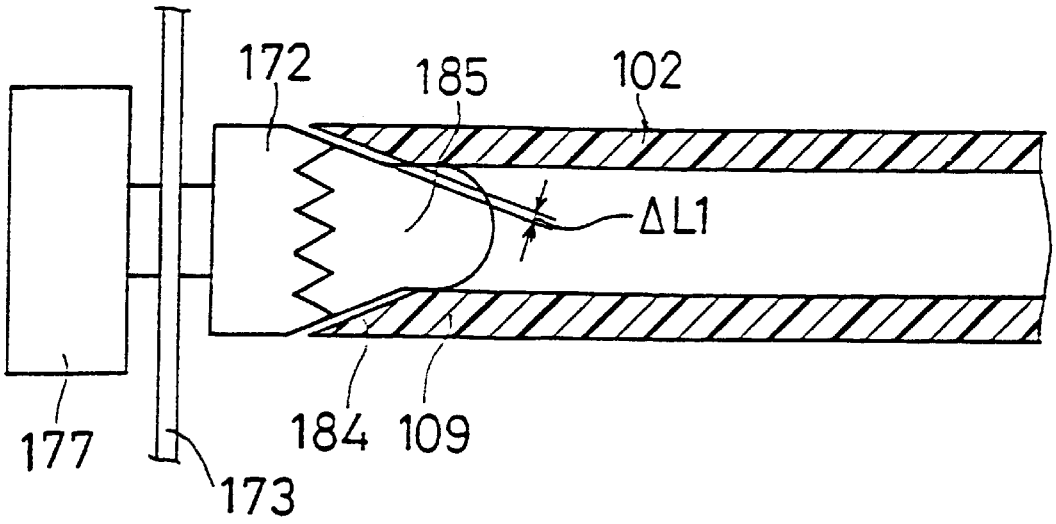
FIG. 44 is a partial sectional view of still another embodiment of the invention.

FIG. 44 is a partial sectional view of still another embodiment of the invention. The feature of this embodiment is that a gap ΔL is provided between a guiding surface 184 formed in a driven portion 109 of a supporting body 102 and the inner circumferential surface of a guiding projection 185 of a joint member 172. ΔL is, for example, 0.2 to 0.5 mm. The gap prevents a radially outward force applied on the driven portion 109, and thus breakage thereof can be prevented.

Figure 45:
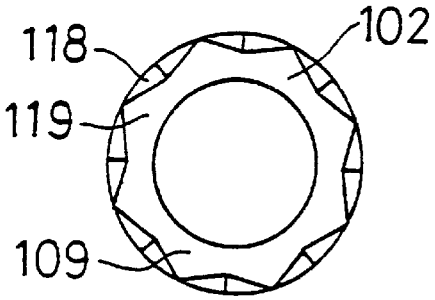
FIG. 45 is a plan view of the end of the supporting body 102 of the embodiment shown in FIG. 44.

FIG. 45 is a plan view of the end of the supporting body 2 of the embodiment shown in FIG. 44. As in the above configuration, the driven portion 109 comprises projections 118 and depressions 119.

Figure 46:
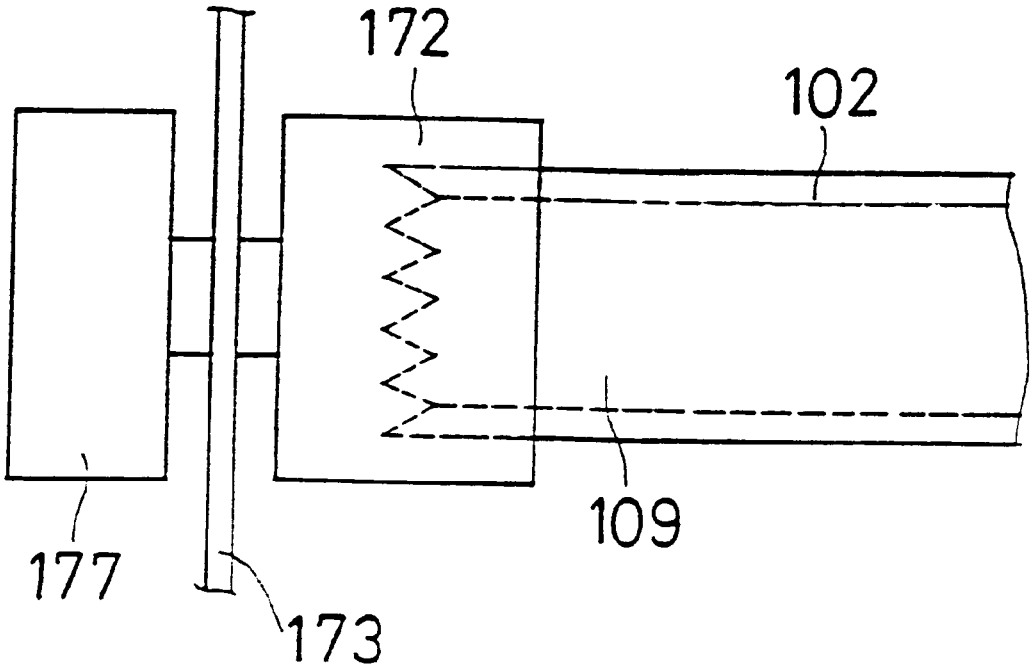
FIG. 46 is a side view of still another embodiment of the invention.
Figure 47:
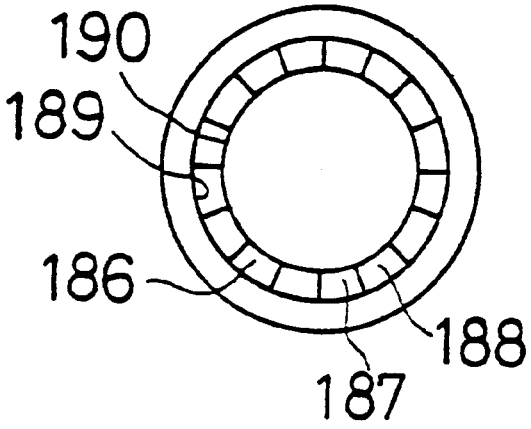
FIG. 47 is a plan view of the joint member 172 of the embodiment of FIG. 46 viewed from the right side.

FIG. 46 is a side view of still another embodiment of the invention, and FIG. 47 is a plan view of the joint member 172 of the embodiment shown in FIG. 46 viewed from the right side. The joint member 172 comprises a dent portion 186 being axially dent for being fitted with the driven portion 109 of the supporting body 102. Driving depressions 187 and driving projections 188 are formed at the bottom of the dent portion 186 to engage with projections 118 and depressions 119 of the driven portion 109. According to this configuration, the outer circumferential surface and the inner circumferential surface of the driven portion 109 are supported by radially facing surfaces 189, 190 of the dent portion 186, and thus the strength can be improved.

Figure 48:
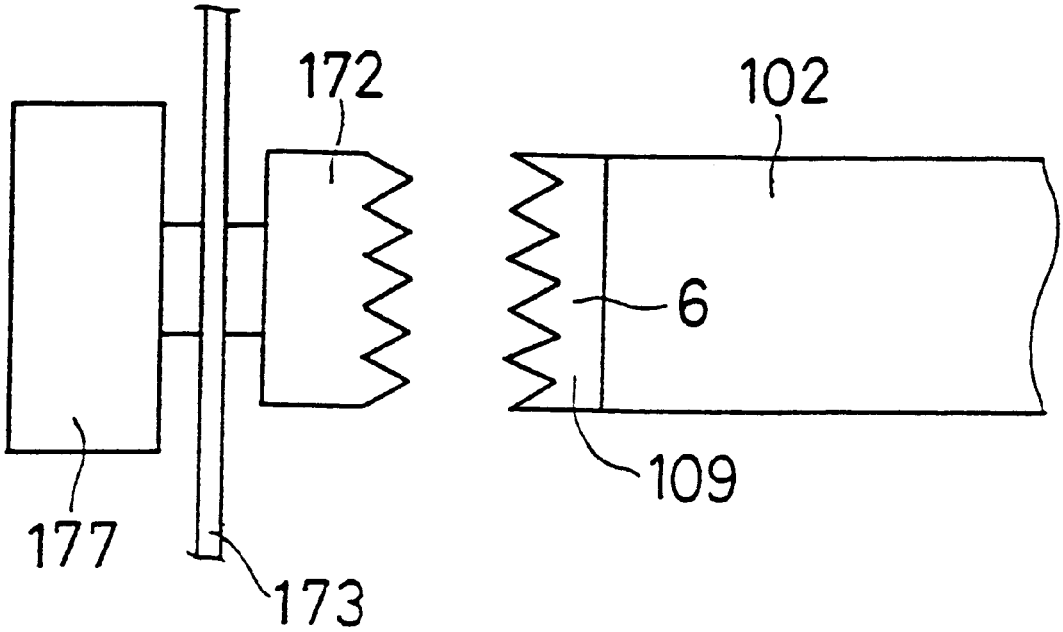
FIG. 48 is a partial side view of another embodiment of the invention.

FIG. 48 is a side view of another embodiment of the invention. A driven portion 109 of a supporting body 102 comprises a reinforcing layer 6. Reinforcing layers 6, 7 are synthetic resin films made of a material such as polyethylene terephthalate, which is commercially available as "Mylar tape". The reinforcing layers 6, 7 are prepared by winding such a tape around the outer circumferential surface of the ends 109, 112 of the supporting body 102 as one layer or a plurality of layers. Therefore, since the reinforcing layers 6, 7 are formed in non-image formation areas, which have nothing to do with image formation of the supporting body 102, generation of crack, crazing or breakage of the supporting body 102 by the stress on the end 109 of the supporting body 102 at the time of fitting the joint member 172 and the driven portion 102 can be prevented, and thus the strength can be improved.

Although a synthetic resin forming a supporting body 102 is, in general, vulnerable and thus has a problem of weakness with respect to the load perpendicular to the axis of the photosensitive element 1, by forming the reinforcing layer 6 as mentioned above, the strength can be improved and thus the problem can be solved. The same is applied to the reinforcing layer 7.

Figure 49:
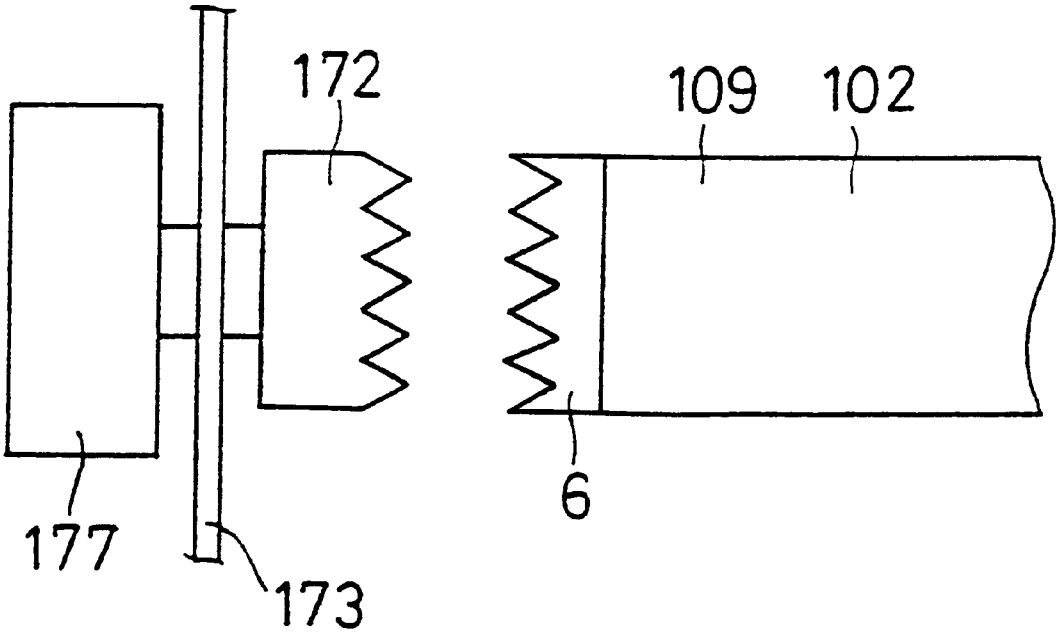
FIG. 49 is a side view of still another embodiment of the invention.

In still another embodiment of the invention shown in FIG. 49, the driven portion 109 includes a reinforcing layer 6 composed of a conductive coating layer. The conductive coating layer is prepared by dissolving a synthetic resin material capable of bonding with the synthetic resin material which the supporting body 102 is made of, such as polycarbonate, nylon, acrylic resin in a solvent, dispersing particles of a conductive material, such as carbon black, thermal black and acetylene black, and coating. By this process, the strength can be improved as well as the end 109 of the supporting body 102 and the driven member 3 can be securely connected electrically.

Figure 50:
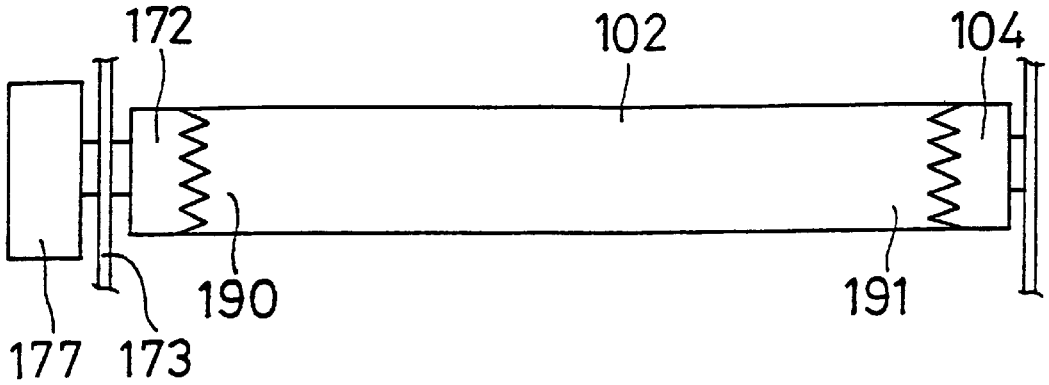
FIG. 50 is a side view of still another embodiment of the invention.

FIG. 50 is a side view of still another embodiment of the invention. In this embodiment, both the axial ends 190, 191 of a supporting body 102 have the same configuration. One end 190 is engaged with a joint member 172, and the other end 191 is engaged with a supporting member 104.

Figure 51:
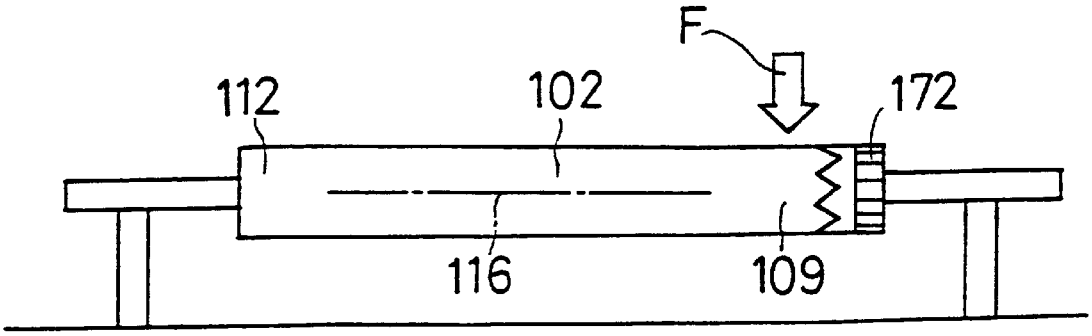
FIG. 51 is a schematic diagram illustrating the experiment conducted by the inventor.

FIG. 51 is a diagram illustrating an experiment conducted by the inventor. The size of the load at which a driven portion 109 and a joint member 172 break was measured by applying a load F perpendicular to the axis 16 of the supporting body 102. The experiment results are shown in Table 1.

TABLE 1

Figure 54:
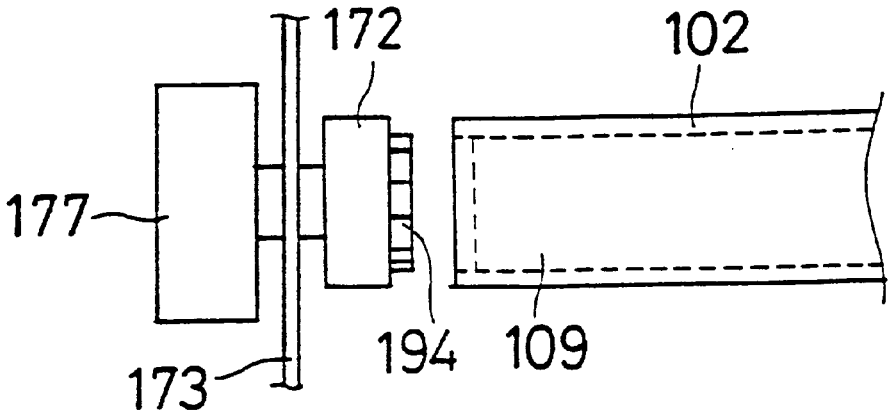
FIG. 54 is a side view of still another embodiment of the invention.

| Embodiment | Breaking load F(kgf) |
|---|---|
| FIG. 33 | 18 |
| FIG. 54 | 18 |
| FIG. 39 | 19 |
| FIG. 41 | 20 |
| FIG. 44 | 21 |
| FIG. 46 | 20 |
| FIG. 48 | 19 |
| FIG. 49 | 19 |

It was learned that the embodiment shown in FIG. 44 is strongest among the embodiments in Table 1.

Figure 52:
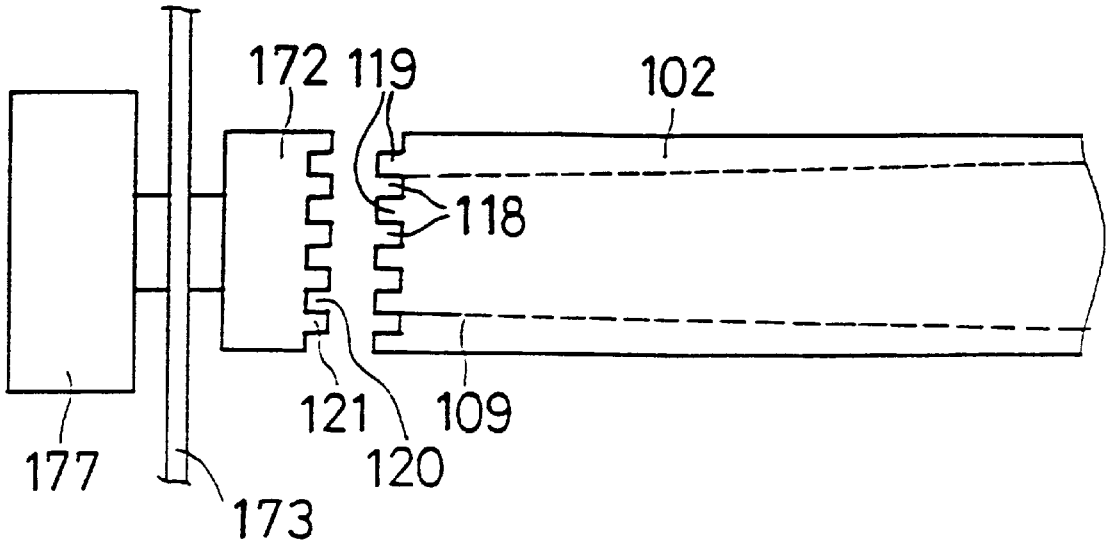
FIG. 52 is a partial sectional view of still another embodiment of the invention.
Figure 53:
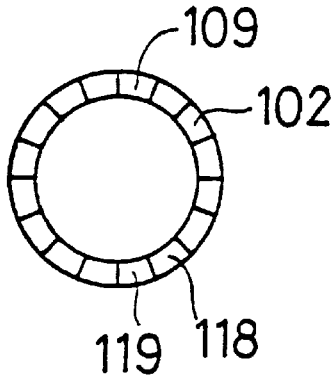
FIG. 53 is a plan view illustrating projections 118 and depressions 119 of the driven portion 109 of FIG. 52.

FIG. 52 is a sectional view of still another embodiment of the invention. As illustrated in FIG. 53, in the driven portion 109 of the supporting body 502 are formed a plurality of projections 118 and depressions 119 at regular intervals in the circumferential direction. The joint member 172 comprises driving depressions 120 and driving projections 121 to be engaged with the projections 118 and the depressions 119 respectively.

Figure 55:
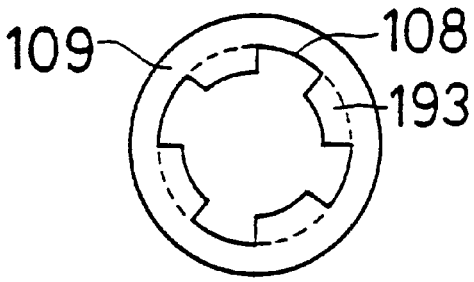
FIG. 55 is a plan view of the driven portion 109 of the supporting body 102 of FIG. 54.
Figure 56:
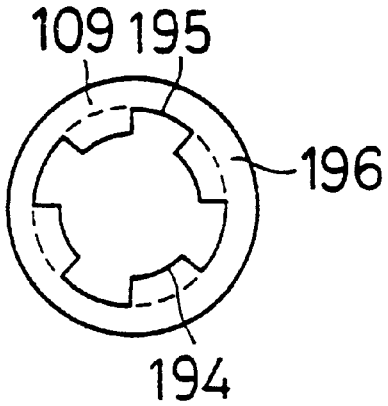
FIG. 56 is a plan view of the fitting portion 194 of the joint member 172 of FIG. 54.

FIG. 54 is a sectional view of still another embodiment of the invention. As shown in FIG. 55, in the the driven portion 109 of the supporting body 102 are formed projections 193 protruding from the inner circumferential surface 108 inwardly in the radial direction. Driving projections 195 for fitting to the inner circumferential surface 108 and driving depressions 196 for being fitted by the projections 193 are formed in the fitting portion 194 of the joint member 172 as shown in FIG. 56. According to this configuration, the strength can be improved with a minimum amount of a synthetic resin material of the supporting body 102.

Figure 57:
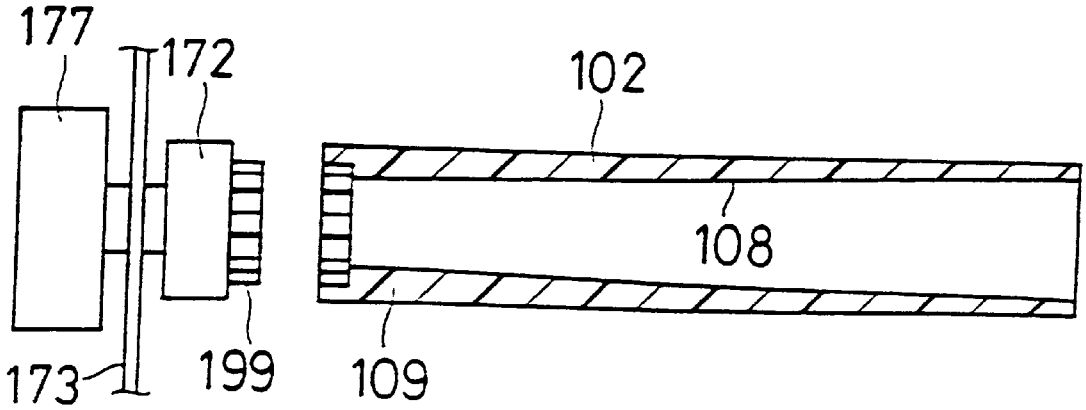
FIG. 57 is a sectional view of another embodiment of the invention.
Figure 58:
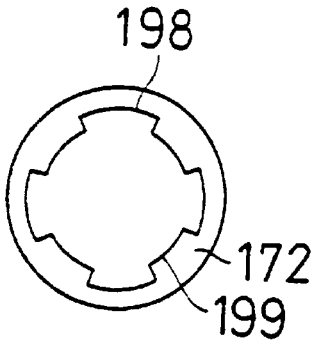
FIG. 58 is a plan view of the fitting portion 199 of the joint member 172 of FIG. 57.
Figure 59:
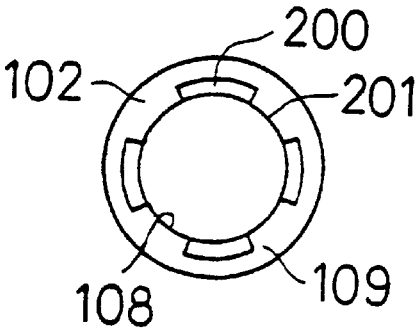
FIG. 59 is a plan view of the driven portion 109 of the supporting body 102 of FIG. 57 viewed from the left side.

FIG. 57 is a side view of still another embodiment of the invention. The supporting body 102 has a draft in the inner circumferential surface 108, and in the driven portion 109 are formed depressions 198 dented outwardly in the radial direction as illustrated in FIG. 58. The driven portion 109 is the thicker axial end of the supporting body 102. Driving projections 200 for fitting to the depressions 198 and driving depressions 201 for being fitted by the inner circumferential surface 108 are formed in the fitting portion 199 of the joint member 172 as shown in FIG. 59.

Figure 60:
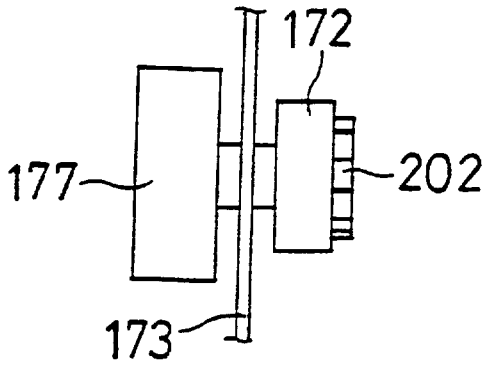
FIG. 60 is a side view of the joint member 172 of another embodiment of the invention.
Figure 61:
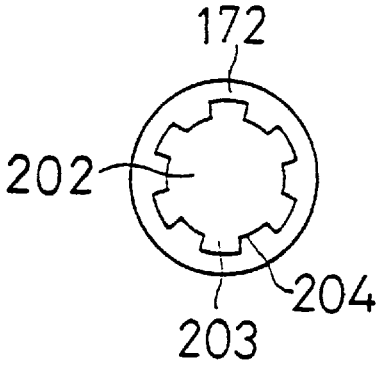
FIG. 61 is a plan view of the joint member 172 of FIG. 60 viewed from the right side.

FIG. 60 is a side view of a joint member 172 of another embodiment of the invention. FIG. 61 is a plan view of the joint member 172 viewed from the right side. In a fitting portion 202 for fitting to a driven portion 109 of a supporting member 102 are formed driving projections 203 and driving depressions 204 at regular intervals in the circumferential direction.

Figures 62A, 62B, 62C:
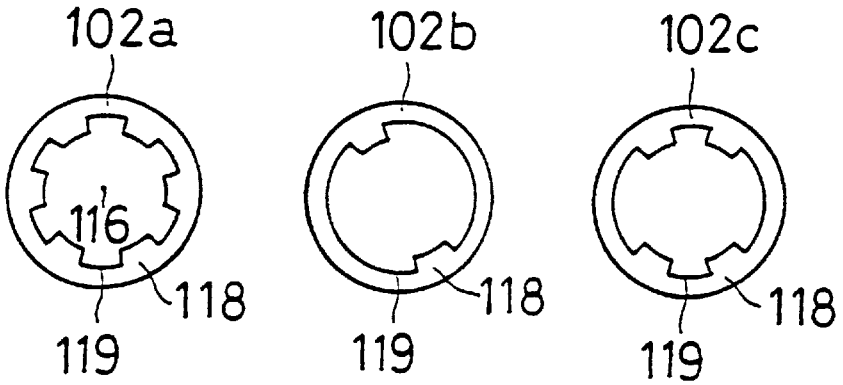
FIGS. 62A, 62B and 62C are plan views of the supporting bodies 102*a*, 102*b* and 102*c* in the driven portion of another embodiment of the invention.

The joint member 172 shown in FIGS. 60 and 61 can be mounted removably to supporting bodies 102*a*, 102*b*, 102*c* shown in FIGS. 62A to 62C, respectively. Projecting portions 118 and depressions 119 in a driven portion of these supporting members 102*a*, 102*b*, 102*c* are formed in a number obtained as a quotient provided by dividing the number of the projections 203 and the depressions 204 of the joint member 172 shown in FIGS. 60 and 61 with an integer, and arranged plane-symmetrical with respect to a symmetrical plane including the axis 16.

Figure 63:
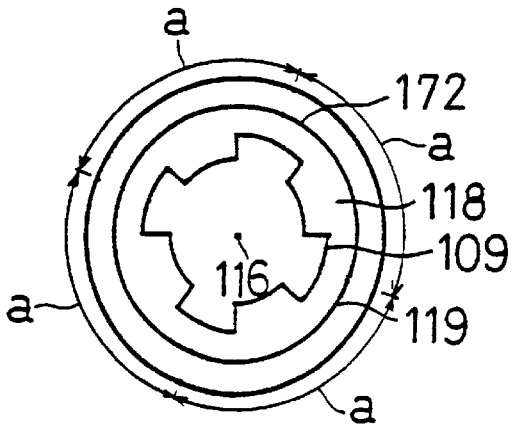
FIG. 63 is a plan view of the driven portion 109 of the supporting body 102 of still another embodiment of the invention.
Figure 64A:
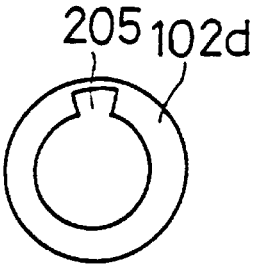
FIGS. 64A, 64B, 64C and 64D are plan views of the driven portion 109 of the supporting body 102 of another embodiment of the invention.
Figure 64B:
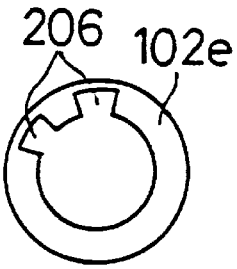
Figure 64C:
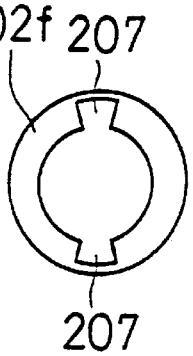

FIG. 63 is a plan view of a driven portion 109 of a supporting body 102 of still another embodiment of the invention. Projecting portions 118 and depressions 119 are formed plane-symmetrical at regular intervals a in the circumferential direction. The joint member 171 shown in FIG. 63 can be removably fitted to supporting bodies 102*d* to 102*g* shown in FIGS. 64A to 64D. The supporting bodies 102*d* to 102*g* include depressions 205 to 208. In FIG. 64A, only one depression 205 is formed, in FIG. 64B, two depressions 206 adjacent to each other are formed, in FIG. 64C, depressions 207 are formed along a diameter, and in FIG. 64D, four fitting depressions 208 are formed at regular intervals in the circumferential direction. The time of the usage of an electrostatic photography apparatus to generate a crack in the supporting bodies 102*d* to 102*g* shown in FIGS. 64A to 64D was found according to an experiment conducted by the inventor. Results are as shown in Table 2.

TABLE 2

| Fig. | 64A | 64B | 64C | 64D |
|---|---|---|---|---|
| Time(h) | 5 | 20 | 50 | 60 or more |

Figure 64D:
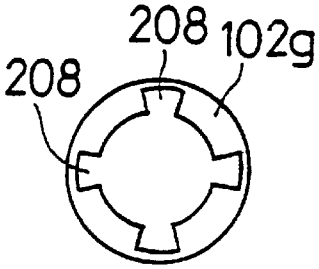

As apparent from the results of Table 2, it was learned when a joint member 172 shown in FIG. 63 was used, a configuration of a supporting body 102 including a large number of dents and projections formed at regular intervals in the circumferential direction to be fitted accurately as shown in FIG. 64D can be used continuously in a long duration.

Figure 65:
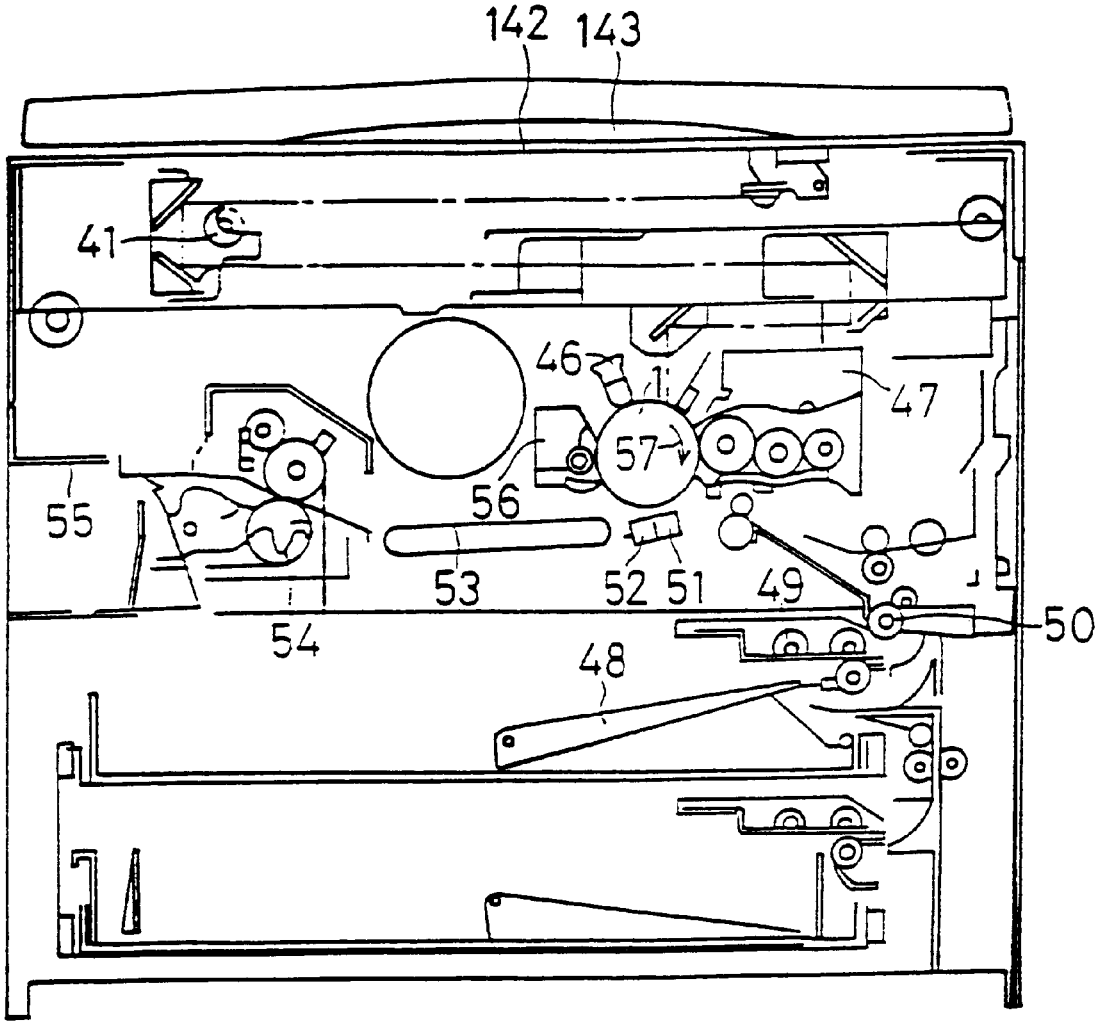
FIG. 65 is a schematic diagram illustrating the entire configuration of a copying machine including a photosensitive element 101 of the invention.

FIG. 65 is a schematic diagram of the entire configuration of a copying machine of one embodiment of the invention. A light beam outputted from a light source 41 is irradiated to a manuscript 143 on a transparent plate 142, and the manuscript image is slit-exposed at a photosensitive layer 5 on a photosensitive element 1 of the invention for image formation. Accordingly, an electrostatic latent image is formed on the photosensitive layer 5.

The photosensitive element 1 is rotated and driven toward the direction shown by the arrow 57. The photosensitive element 1 is homogeneously charged with a main charging device 46 on the surface, and exposed as mentioned above. Accordingly an electrostatic latent image is formed on the surface of the photosensitive element 1, and the electrostatic latent image is developed by a developer in a developing device 47. The developed toner image is transferred by a transfer charging device 51 on a recording sheet supplied timely from a sheet supply cassette 48 via a feeding roller 49 and a resist roller 50. The recording sheet is removed from the surface of the photosensitive element 1 by a removing charging device 52 and conveyed to a fixing device 54 by a conveyor belt 53. The fixing device 54 is to fix a toner image on a recording sheet by heat, and the fixed recording sheet is discharged onto a discharge tray 55. A developer remained on the surface of the photosensitive element 1 after transfer is collected from the surface of the photosensitive layer 5 of the photosensitive element 1 by a cleaner 56 for purifying. The residual charge on the surface of the photosensitive element 1 after being purified by a cleaner 56 is eliminated with a charge eliminating lamp 58.

Embodiments explained with reference to FIGS. 33 to 64 and other embodiments can be applied similarly to the embodiments shown in FIGS. 65 and 28 to 32. Accordingly, by the use of a developer scattering prevention sheet 63 and suede members 64, scattering of a developer in a laser printer or a copying machine can be prevented, and thus the damage of the vicinity can be prevented as well.

Figure 66:
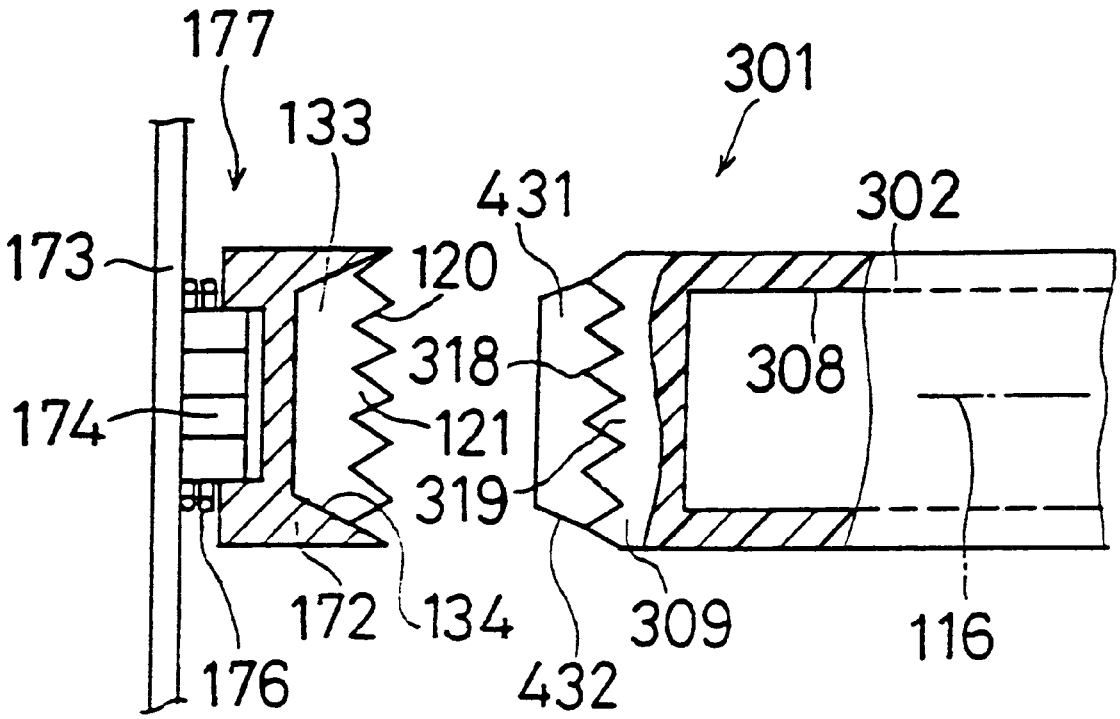
FIG. 66 is a sectional view of a photosensitive element for electrophotography 301 of one embodiment of the invention.

FIG. 66 is a sectional view of a photosensitive element for electrophotograpy 1 of one embodiment of the invention. The photosensitive element for electrophotography 1 is used for forming electrostatic latent images in electrophotography apparatus such as a copying machine or a laser printer later described. The photosensitive element 301 basically comprises a conductive synthetic resin supporting body 302 and driving means 171 to drive at one axially end of the axis 116 of the supporting body 302. The driving means 171 comprises a joint member 172. In the supporting body 302, one axial end 309 is solid and closed, and the other axial end 312 is open as later described. The inner diameter 308 of the supporting body 302 comprises a draft gradually tapering from the end 312 to the end 309, or may incline with an angle larger than the draft with respect to the axis 116 for improving the strength of the end 309. Accordingly, the outer diameter of the supporting body 302 is axially parallel and the inner circumferential surface gradually tapers toward the left side of FIG. 66 so as to form a draft for injection molding, and thus the left side of the driven member 309 in FIG. 66 is thicker. The other end 312 of the supporting body 302 may be solid and closed as well. A supporting body 302 having both ends 309 and 312 closed can be produced in a method of moving a plasticized synthetic resin material to the inner circumferential surface of a mold utilizing a centrifugal force or a blow molding utilizing a gas pressure such as air pressure. The numeral 309 would be referred to as a driven portion in the explanation below.

Figure 67:
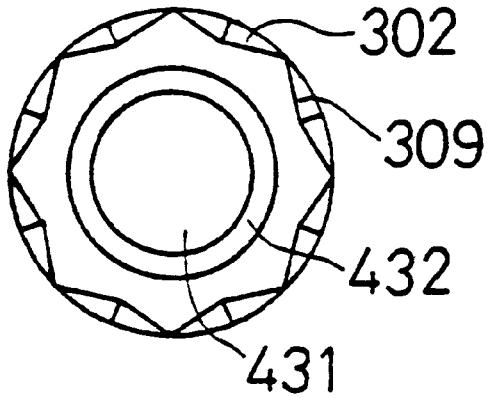
FIG. 67 is a plan view of the supporting member 302 of FIG. 66 viewed from the left side.

FIG. 67 is a plan view of the supporting body 302 of FIG. 66 viewed from the left side. In the driven portion 309 are alternately formed a plurality of projections 318 and depressions 319 to be adjacent to each other in the circumferential direction. The projections 318 and the depressions 319 are arranged toward outer direction with respect to the axis 116 (the left side of FIG. 66, or the upper direction from the paper surface of FIG. 67). The joint member 172 comprises driving depressions 120 and driving projections 121 to be engaged with the projections 318 and the depressions 319, and the joint member 172 shares the axis 116 with the supporting body 302 in a fitted state. The end 309 comprises a truncated-conical shaped guiding portion 431 formed more inwardly in the radial direction with respect to the projections 318 and the depressions 319. The outer diameter of the inclined guiding surface 432 of the guiding portion 431 tapers to the outward in the axial direction of the supporting body 302 (toward the left direction of FIG. 66).

Figure 68:
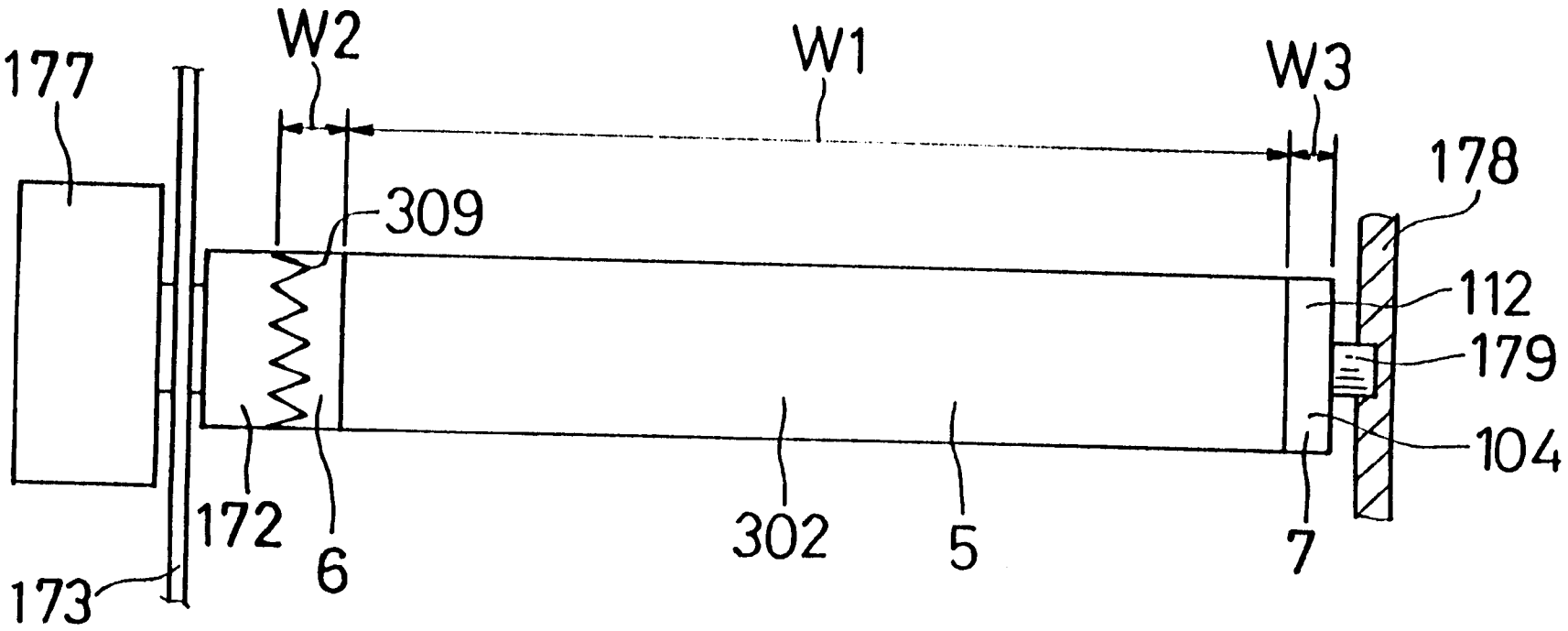
FIG. 68 is a side view of the embodiment of the invention shown in FIGS. 66 and 67.

FIG. 68 is a side view of the embodiment shown in FIGS. 66 and 67. A photosensitive layer 5 comprising an organic photosensitive material is formed in the image formation area W1 on the outer circumferential surface of the supporting body 2. Reinforcing layers 6, 7 are provided in the non-image formation areas W2, W3 adjacent to both the axial ends of the photosensitive layer 5.

The size of the supporting body 2 can be, for example, 270 to 280 mm in the entire length, 30 mm ϕ in the outer diameter, 27 mm ϕ in the inner diameter in the vicinity of the end 9, 28 mm ϕ in the inner diameter of the other end 12. A draft can be 0.15 to 0.25 degree on one side.

FIG. 69 is a side view illustrating the vicinity of the driven portion 309 of the supporting body 302 of the invention. As shown in FIG. 69A, the edge portion 118*a* of the projection 118 and the bottom 319*a* of the depression 319 of the driven portion 309 are curved. Similarly, the bottom 120*a* and the edge portion 121*a* of the driving depression 120 and the driving projection 121 are curved as well. Accordingly, the projection 318 is smoothly fitted to the driving depression 120, and the depression 319 is smoothly fitted to the driving projection 121, so that the attachment is secured and the risk of damaging the supporting body 302 can be prevented.

As shown in FIG. 69B, in the case the edge portion 318*a* of the projection 318 and the bottom 319*a* of the depression 319 are sharp, and similarly the bottom 120*a* of the driving depression 120 and the edge portion 121*a* of the driving projection 121 are sharp, crack 380 or chipping 381 is liable to generate. However, such configuration shown in FIG. 69B is also included in the spirit of the invention.

The edge portion 318*a* of the projection 318 and the bottom 120*a* of the driving depression 120 do not contact to each other. Similarly, the bottom 319*a* of the depression 319 and the edge portion 121*a* of the driving projection 121 do not contact to each other. Therefore, the damage can be prevented further securely.

The joint member 172 comprises a guiding dent portion 133 for fitting with the guiding portion 431. The guiding dent portion 133 comprises a truncated-conical shaped guiding surface 134 to contact with the guiding surface 432. The outer end in the axis 116 direction of the guiding portion 431 and the bottom of the guiding dent portion 133 do not contact with each other, and accordingly, the guiding surfaces 432 and 134 are fitted and supported accurately.

Figure 70:
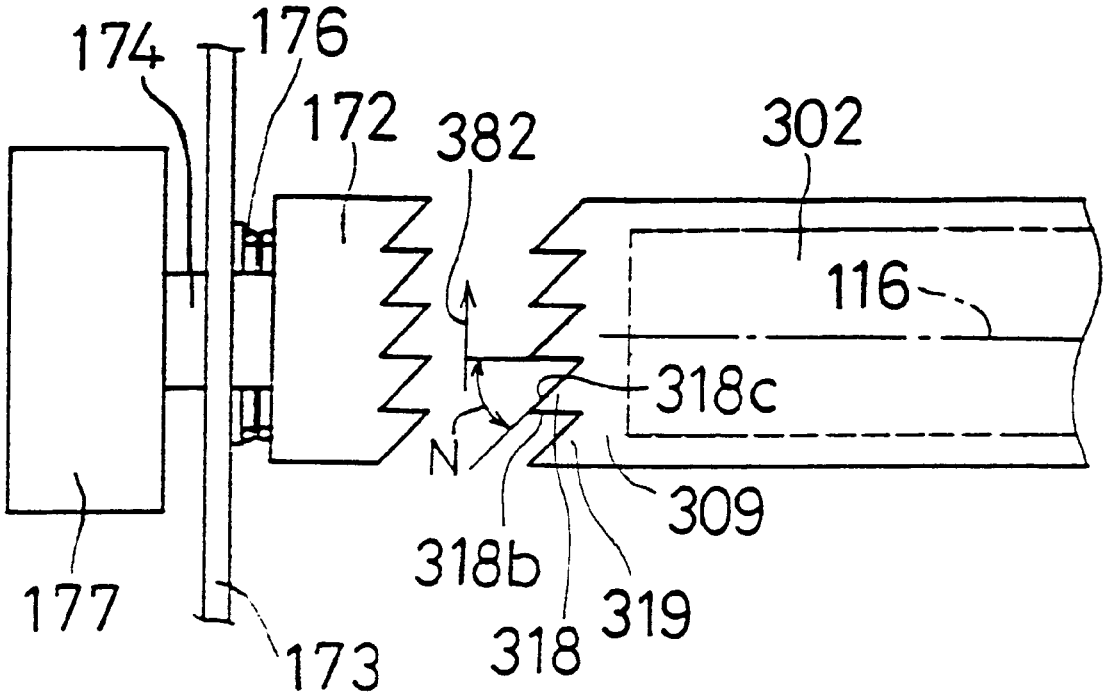
FIG. 70 is a side view of another embodiment of the invention.
Figure 71:
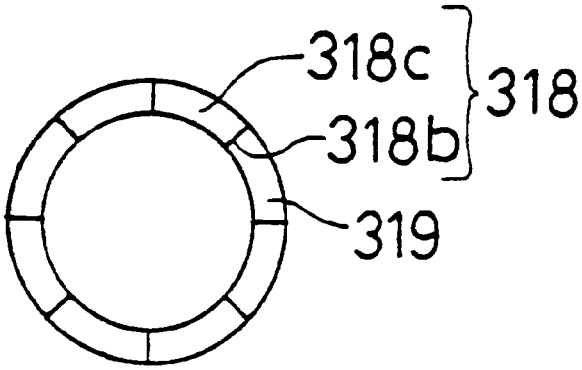
FIG. 71 is a plan view of projections 318 and depressions 319 of the driven portion 309 of FIG. 5.

FIG. 70 is a side view of another embodiment of the invention. This embodiment is similar to the above configuration, and the same parts bear the same numerals. The feature of this embodiment is that the upstream surface 118*b* with respect to the rotation direction 382 of the projection 318 is nearly parallel to the rotation axis 116 or inclined to the upstream side of the rotation direction toward the axially outward direction (toward the left direction in FIG. 70). In this configuration, the joint member 172 is fitted to the driven portion 309. According to an experiment of the inventor, an angle N made by the upstream surface 318*b* with respect to the rotation direction of the projection 318 and the downstream surface 318*c* is preferably 45 to 90 degrees. According to the configuration, even when a torque of 40 kgf·cm or larger functions on the supporting body 302 for rotation driving, the rotation power can be securely transmitted from the joint member 172 to the driven member 309. FIG. 71 illustrates the constitution of the projections 318 and the depressions 319 of the driven portion 309 apparently.

Figure 72:
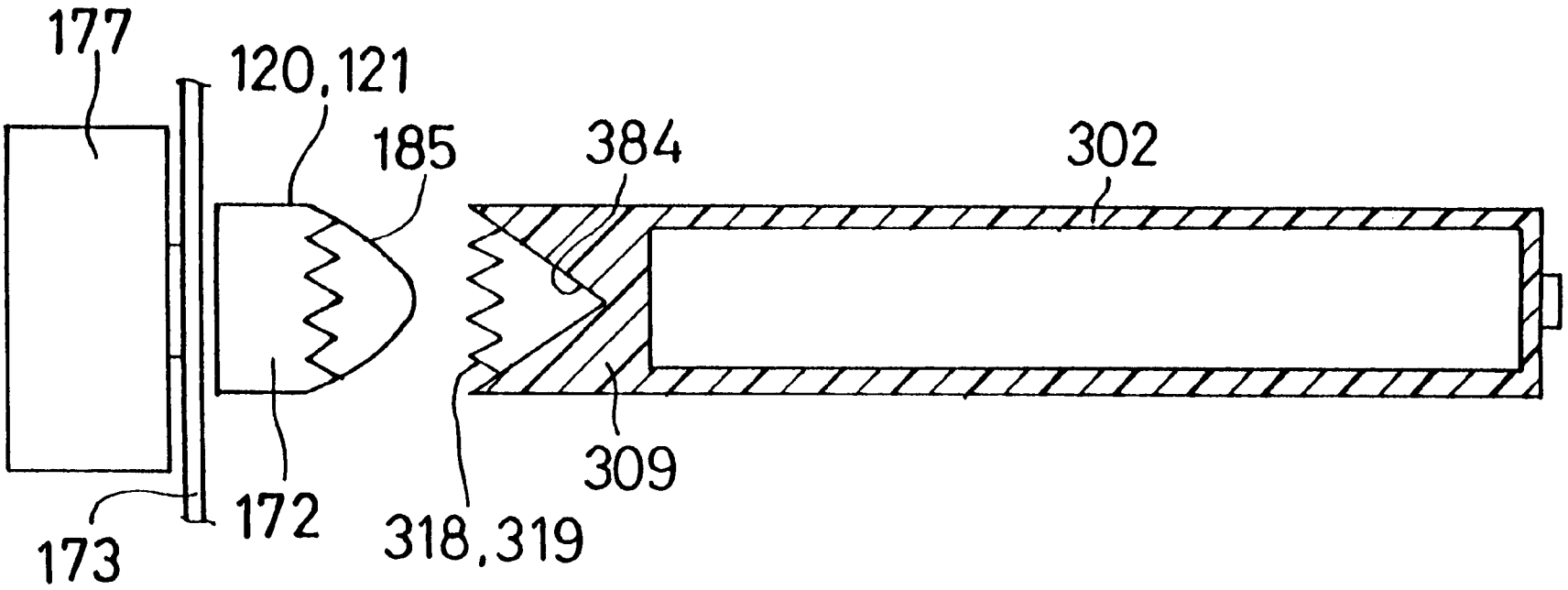
FIG. 72 is a sectional view of still another embodiment of the invention.

FIG. 72 is a sectional view of still another embodiment of the invention. The inner circumferential surface of the driven portion 309 of the supporting body 302 is formed to be a nearly conical guiding surface 384 where the inner diameter enlarges toward the axially outward direction (the left side of FIG. 72). In a joint member 172 is formed a nearly conical guiding projection 185 to be fitted to the guiding surface 384.

Figure 73:
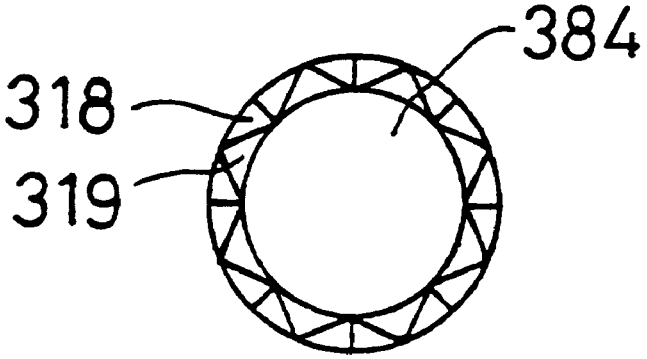
FIG. 73 is a plan view of the driven portion 309 of the supporting body 302 of the embodiment shown in FIG. 7 viewed from the left side.

FIG. 73 is a plan view of the driven portion 309 of the supporting body 302 of FIG. 72 viewed from the left side. The driven portion 309 are formed projections 318 and depressions 319, and this configuration is similar to the embodiments mentioned above.

Figure 74:
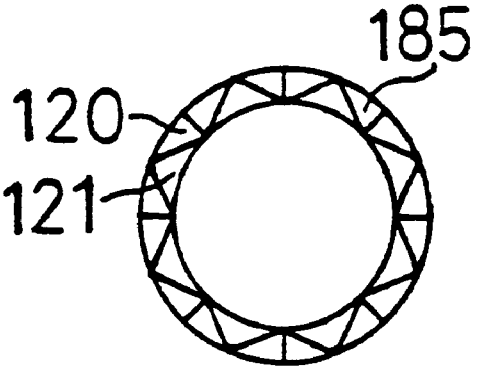
FIG. 74 is a plan view of the joint member 172 shown in FIG. 7 viewed from the right side.

FIG. 74 is a plan view of the joint member 172 of FIG. 72 viewed from the right side. A guiding projection 185 is formed inwardly in the radial direction with respect to projections 318 and depressions 319.

Figure 75:
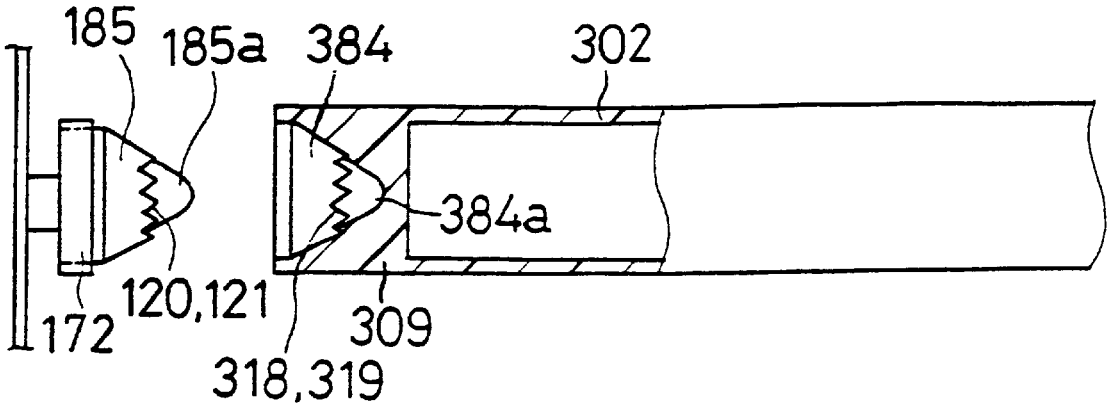
FIG. 75 is a sectional view of still another embodiment of the invention.

FIG. 75 is a sectional view of still another embodiment of the invention. The feature of this embodiment is that projections 318 and depressions 319 are formed at a position located midway in a guiding surface 384 formed in the driven portion 309 in the axial direction. In the joint member 172 is formed a guiding projection 185, and driving depressions 120 and driving projections 121 are formed at positions located midway of the joint member 172 in the axial direction.

Figure 76:
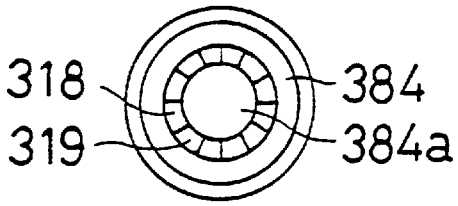
FIG. 76 is a plan view of the driven portion 309 of the supporting body 302 of FIG. 10 viewed from the left side.
Figure 77:
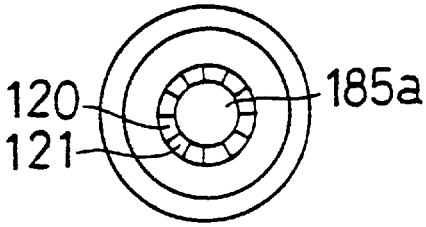
FIG. 77 is a plan view of the joint member 172 of FIG. 10.

FIG. 76 is a plan view of the driven portion 309 of the supporting body 302 of FIG. 75, and FIG. 77 is a plan view of the joint member 172 of FIG. 75 viewed from the right side. The guiding surface 384 comprises a guiding surface 384*a* further elongating inwardly in the axial direction (toward the right side of FIG. 75) with respect to the projections 318 and the depressions 319. The edge portions 185*a* of a guiding projection 185 is guided and fitted to the guiding surface 384*a*.

Figure 78:
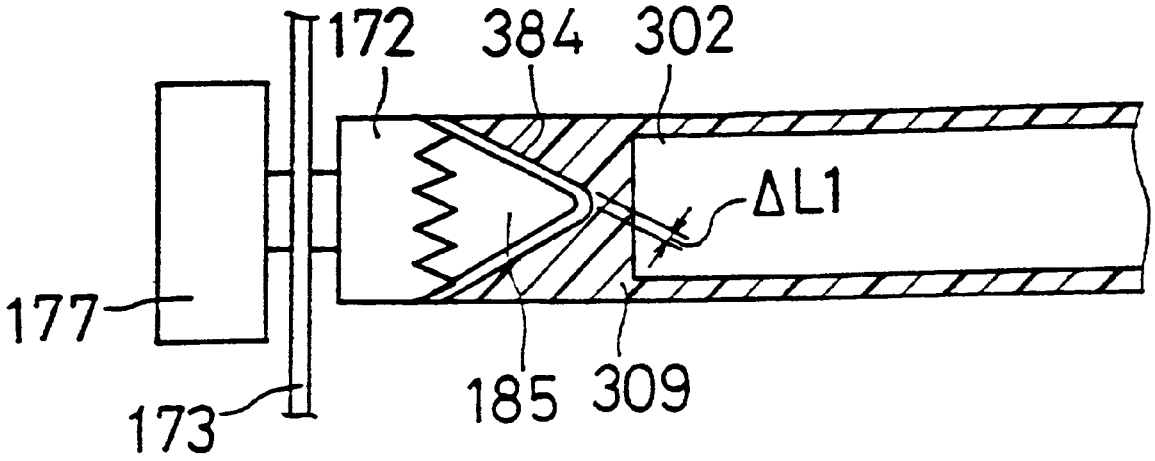
FIG. 78 is a sectional view of still another embodiment of the invention.

FIG. 78 is a partial sectional view of still another embodiment of the invention. The feature of this embodiment is that a gap ΔL is provided between a guiding surface 384 formed in a driven portion 309 of a supporting body 302 and the inner circumferential surface of a guiding projection 185 of a joint member 172. ΔL is, for example, 0.2 to 0.5 mm. The gap prevents a radially outward force applied on the driven portion 309, and thus breakage thereof can be prevented.

Figure 79:
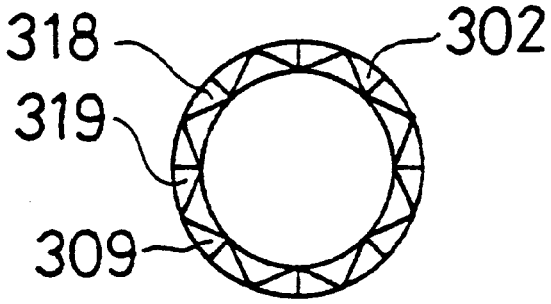
FIG. 79 is a plan view of the driven portion 309 of the supporting body 302 of FIG. 13 viewed from the left side.

FIG. 79 is a plan view of the end of the supporting body 302 of the embodiment shown in FIG. 78. As in the above configuration, the driven portion 309 comprises projections 318 and depressions 319.

Figure 80:
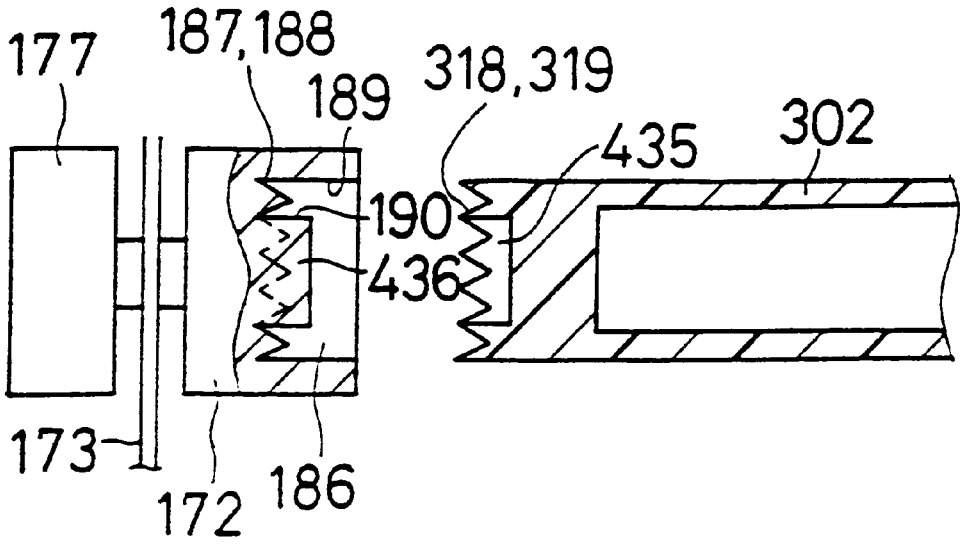
FIG. 80 is a partial sectional view of still another embodiment of the invention.
Figure 81:
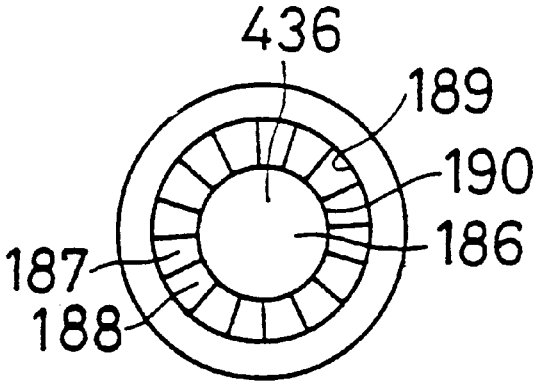
FIG. 81 is a plan view of the joint member 172 of the embodiment shown in FIG. 15.

FIG. 80 is a side view of still another embodiment of the invention, and FIG. 81 is a plan view of the joint member 172 of the embodiment shown in FIG. 80 viewed from the right side. The joint member 172 comprises a dent portion 186 being axially dent for being fitted with the driven portion 309 of the supporting body 302. Driving depressions 187 and driving projections 188 are formed at the bottom of the dent portion 186 to engage with projections 318 and depressions 319 of the driven portion 309. According to this configuration, the outer circumferential surface and the inner circumferential surface of the driven portion 109 are supported by radially facing surfaces 189, 190 of the dent portion 186, and thus the strength can be improved.

The driven portion 309 comprises a fitting depression 435, and a guiding dent portion 186 comprises a supporting projection 436. Since the fitting projection 436 is fitted with the fitting depression 435, the outer circumferential surface and the inner circumferential surface facing to the fitting depression 435 of the driven portion 309 are supported by the joint member 172, and thus the strength can be improved without backlash to achieve a stable rotation.

Figure 82:
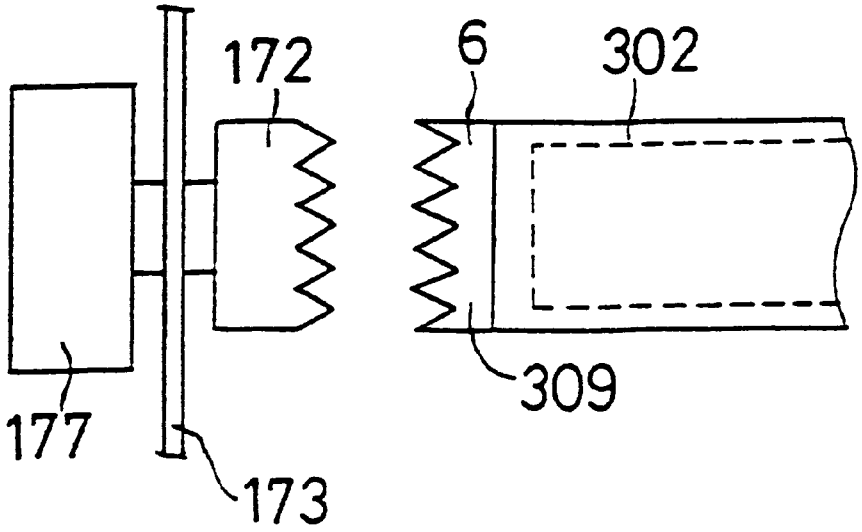
FIG. 82 is a side view of another embodiment of the invention.

FIG. 82 is a side view of another embodiment of the invention. A driven portion 309 of a supporting body 302 comprises a reinforcing layer 6. Reinforcing layers 6, 7 are synthetic resin films made of polyethylene terephthalate or the like, which is commercially available as "Mylar tape". The reinforcing layers 6, 7 are prepared by winding such a tape around the outer circumferential surface of the ends 309, 112 of the supporting body 302 as one layer or a plurality of layers. Therefore, since the reinforcing layers 6, 7 are formed in non-image formation areas, which have nothing to do with image formation of the supporting body 302, generation of crack, crazing or breakage of the supporting body 302 by the stress on the end 309 of the supporting body 302 at the time of fitting the joint member 172 and the driven portion 302 can be prevented, and thus the strength can be improved.

Figure 83:
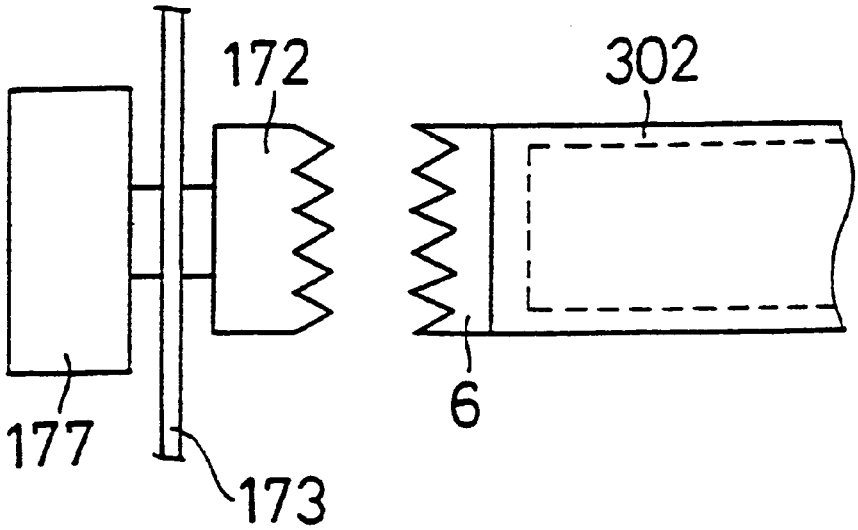
FIG. 83 is a partial side view of still another embodiment of the invention.

In still another embodiment of the invention shown in FIG. 83, a driven portion 309 includes a conductive coating layer composed of a reinforcing layer 6.

By this process, the strength can be improved as well as the end 309 of the supporting body 302 and the driven member 3 can be securely connected electrically.

Figure 84:
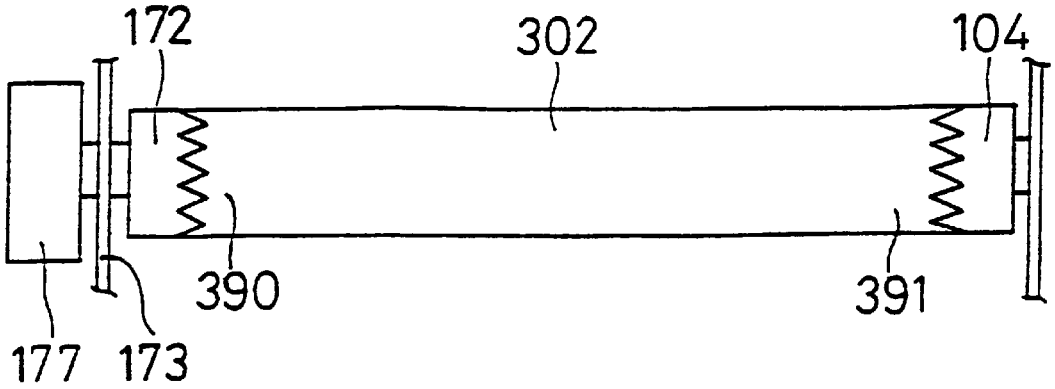
FIG. 84 is a side view of still another embodiment of the invention.

FIG. 84 is a side view of still another embodiment of the invention. In this embodiment, both the axial ends 390, 391 of a supporting body 302 have the same configuration. One end 390 is engaged with a joint member 172, and the other end 391 is engaged with a supporting member 104.

Figure 85:
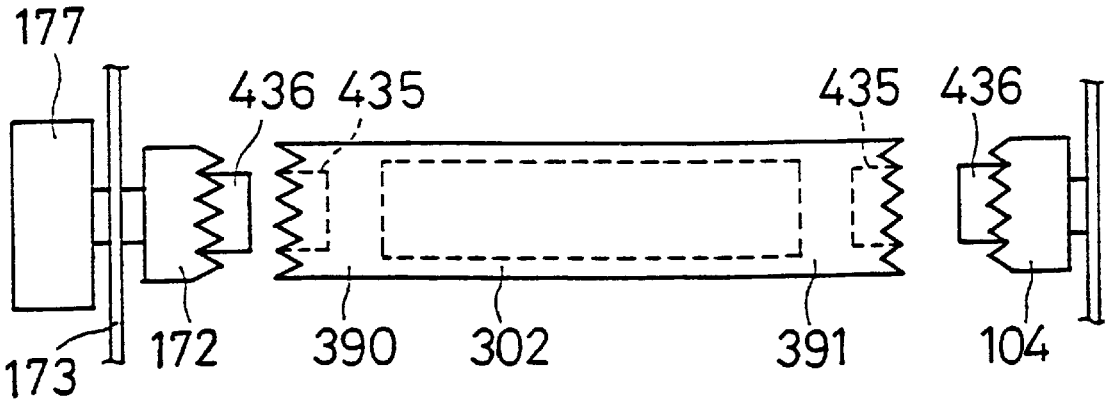
FIG. 85 is a side view of still another embodiment of the invention.

FIG. 85 is a sectional view of still another embodiment of the invention. The end 390 of the supporting body 302 has a configuration as in the embodiment shown in FIGS. 80 and 81, including the configuration of mounting the other end 391 and the supporting member 104. According to the configuration shown in FIG. 85, the supporting body 302 can be accurately supported by the joint member 172 and the supporting member 104, and thus can rotate stably.

Figure 86:
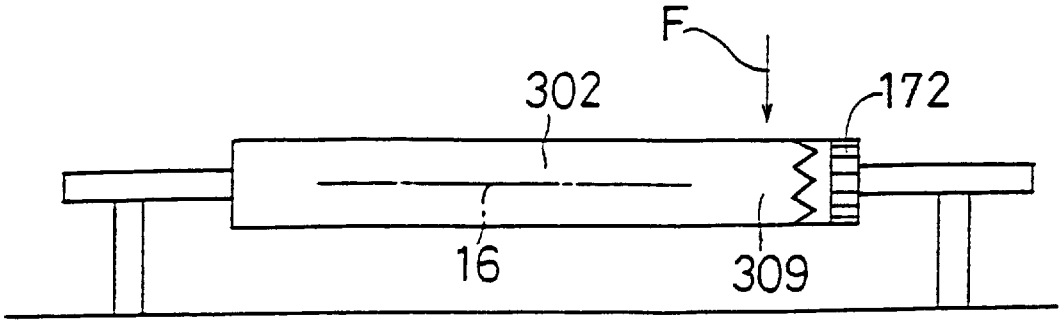
FIG. 86 is a schematic diagram illustrating the experiment conducted by the inventor.

FIG. 86 is a diagram illustrating an experiment conducted by the inventor. The size of the load at which a driven portion 309 and a joint member 172 break was measured by applying a load F perpendicular to the axis 16 of the supporting body 302. The experiment results are shown in Table 3.

TABLE 3

Figure 89:
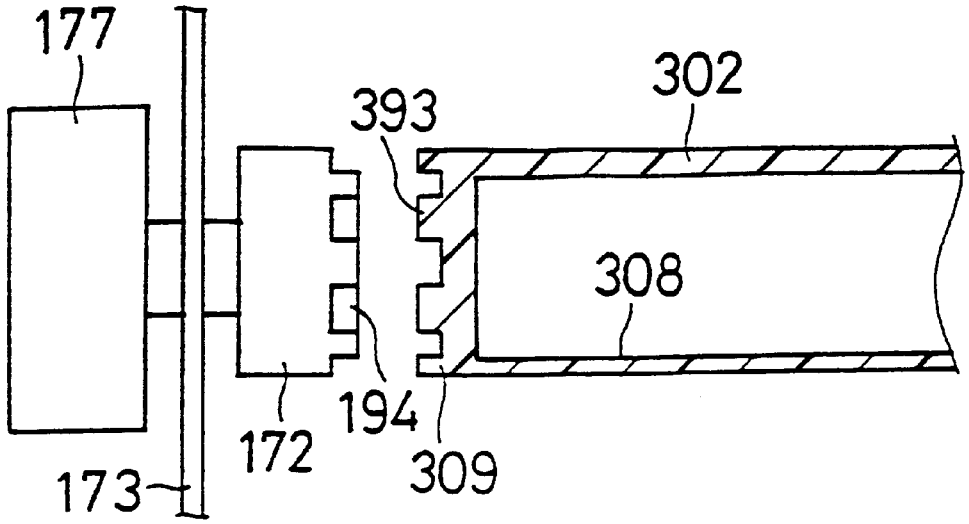
FIG. 89 is a side view of still another embodiment of the invention.

| Embodiment | Breaking load F(kgf) |
|---|---|
| FIG. 66 | 23 |
| FIG. 89 | 23 |
| FIG. 80 | 25 |
| FIG. 82 | 24 |
| FIG. 83 | 24 |

It was learned that the embodiment shown in FIG. 80 is strongest among the embodiments in Table 3.

Figure 87:
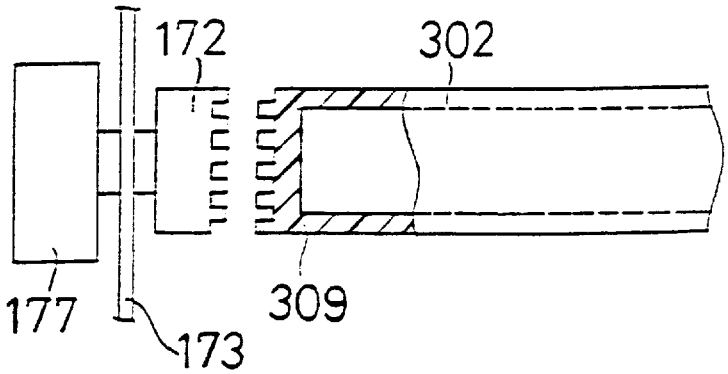
FIG. 87 is a partial sectional view of still another embodiment of the invention.
Figure 88:
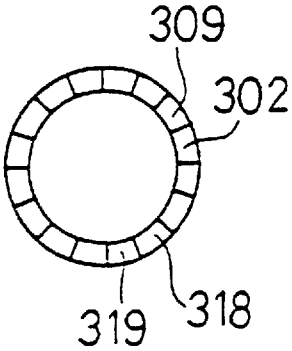
FIG. 88 is a plan view of projections 318 and depressions 319 of the driven portion 309 of FIG. 22.

FIG. 87 is a sectional view of still another embodiment of the invention. As illustrated in FIG. 88, in the driven portion 309 of the supporting body 302 are formed a plurality of projections 118 and depressions 319 at regular intervals in the circumferential direction. The joint member 172 comprises driving depressions 120 and driving projections 121 to be engaged with the projections 118 and the depressions 319 respectively.

Figure 90:
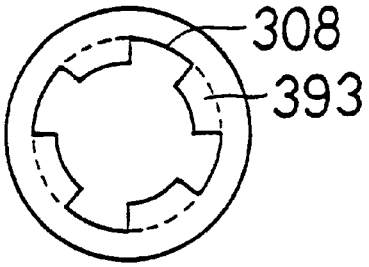
FIG. 90 is a sectional view of the driven portion 309 of the supporting body 302 shown in FIG. 24.
Figure 91:
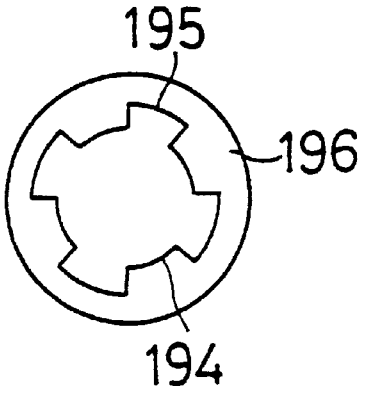
FIG. 91 is a plan view illustrating the fitting portion 194 of the joint member 172 of FIG. 89.

FIG. 89 is a sectional view of still another embodiment of the invention. As shown in FIG. 90, in the the driven portion 309 of the supporting body 302 are formed projections 393 protruding from the inner circumferential surface 308 inwardly in the radial direction. Driving projections 195 for fitting to the inner circumferential surface 308 and driving depressions 196 for being fitted by the projections 193 are formed in the fitting portion 194 of the joint member 172 as shown in FIG. 91. According to this configuration, the strength can be improved with a minimum amount of a synthetic resin material of the supporting body 102.

Embodiments explained with reference to FIGS. 66 to 91 can be applied similarly to the embodiments shown in FIGS. 54 to 65 and 28 to 34.

The time of the usage of an electrostatic photography apparatus to generate a crack in a supporting body 302 with a driven portion 309 having a configuration shown in FIGS. 64A to 64D as in the embodiment in FIG. 64 was found according to an experiment conducted by the inventor. Results are as shown in Table 4.

TABLE 4

| Fig. | 64A | 64B | 64C | 64D |
|---|---|---|---|---|
| Time(h) | 7 | 22 | 52 | 65 or more |

As apparent from the results of Table 4, it was learned when a joint member 172 shown in FIG. 63 was used, a configuration of a supporting body 302 comprising a large number of dents and projections formed at regular intervals in the circumferential direction to be fitted accurately as shown in FIG. 64D can be used continuously in a long duration.

Figure 92:
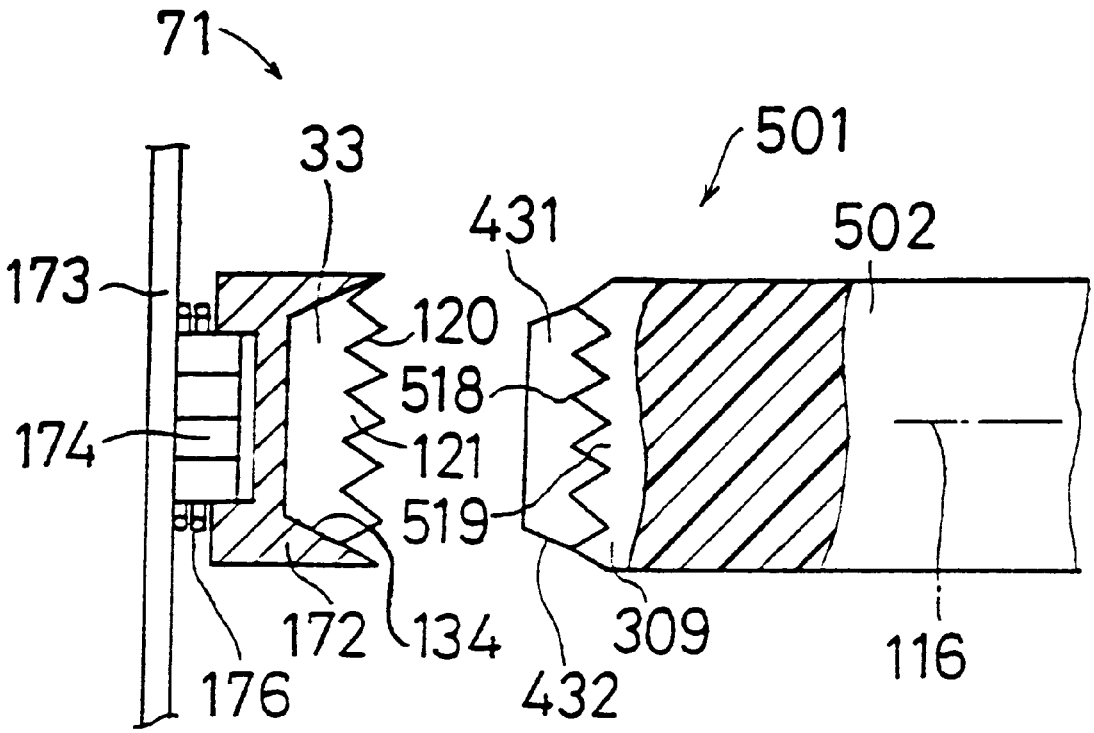
FIG. 92 is a sectional view illustrating a photosensitive element for electrophotography 501 of one embodiment of the invention.

FIG. 92 is a sectional view of a photosensitive element for electrophotograpy 1 of one embodiment of the invention. The photosensitive element for electrophotography 1 is used for forming electrostatic latent images in electrophotography apparatus such as a copying machine or a laser printer later described. The photosensitive element 501 basically comprises a conductive synthetic resin supporting body 502 and driving means 171 to drive at one axially end of the axis 116 of the supporting body 502. The driving means 171 comprises a joint member 172. The supporting body 502 is nearly columnar and solid in the almost entire axial length. The outer diameter of the supporting body 502 is axially parallel.

Figure 93:
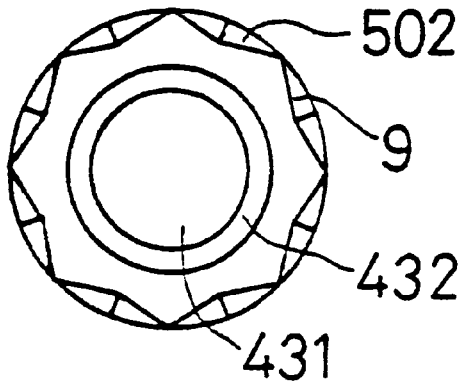
FIG. 93 is a plan view of the supporting member 502 of FIG. 92 viewed from the left side.

FIG. 93 is a plan view of the supporting body 2 of FIG. 1 viewed from the left side. In the driven portion 9 are alternately formed a plurality of projections 18 and depressions 19 to be adjacent to each other in the circumferential direction. The projections 18 and the depressions 19 are arranged toward outer direction with respect to the axis 16 (the left side of FIG. 1, or the upper direction from the paper surface of FIG. 2). The joint member 72 comprises driving depressions 20 and driving projections 21 to be engaged with the projections 18 and the depressions 19, and the joint member 72 shares the axis 16 with the supporting body 2 in a fitted state. At the end 9 is formed a truncated-conical shaped guiding portion 131 formed more inwardly in the radial direction than the projections 18 and the depressions 19. The outer diameter of the inclined guiding surface 132 of the guiding portion 131 tapers to the outward in the axial direction of the supporting body 2 (toward the left direction of FIG. 1).

Figure 94:
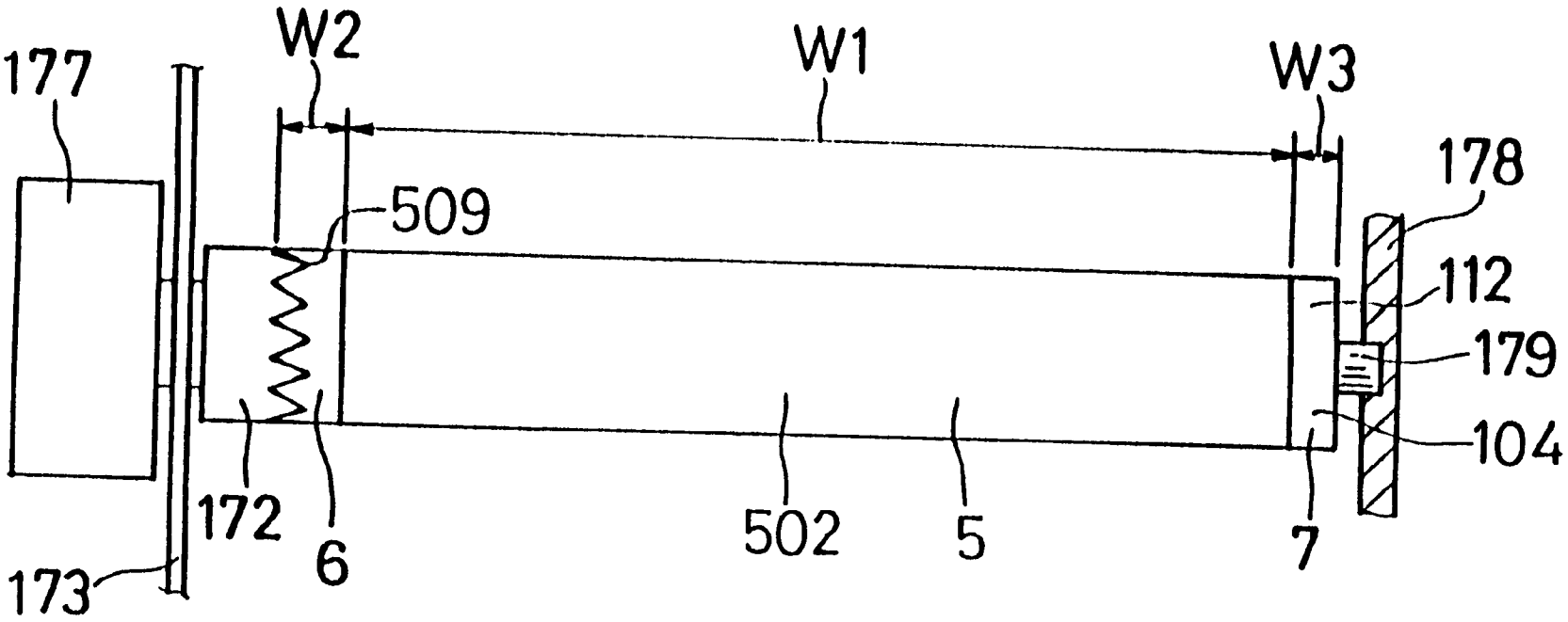
FIG. 94 is a side view of the embodiment of the invention shown in FIGS. 92 and 93.

FIG. 94 is a side view of the embodiment shown in FIGS. 92 and 93. A photosensitive layer 5 comprising an organic photosensitive material is formed in the pixel formation area W1 on the outer circumferential surface of the supporting body 2. Reinforcing layers 6, 7 are provided in the non-image formation areas W2, W3 next to both the axial ends of the photosensitive layer 5.

A supporting member 104 is provided removably or fixed at the end 112 opposite to the end having a driven portion 509 of the supporting member 502, and the supporting member 104, which may be formed integrally with the supporting body 502, is supported rotatably by a bearing 179 at the side wall 178 of the electrophotography apparatus.

The size of the supporting body 2 can be, for example, 270 to 280 mm in the entire length and 30 mm ϕ in the outer diameter.

Figure 95A:
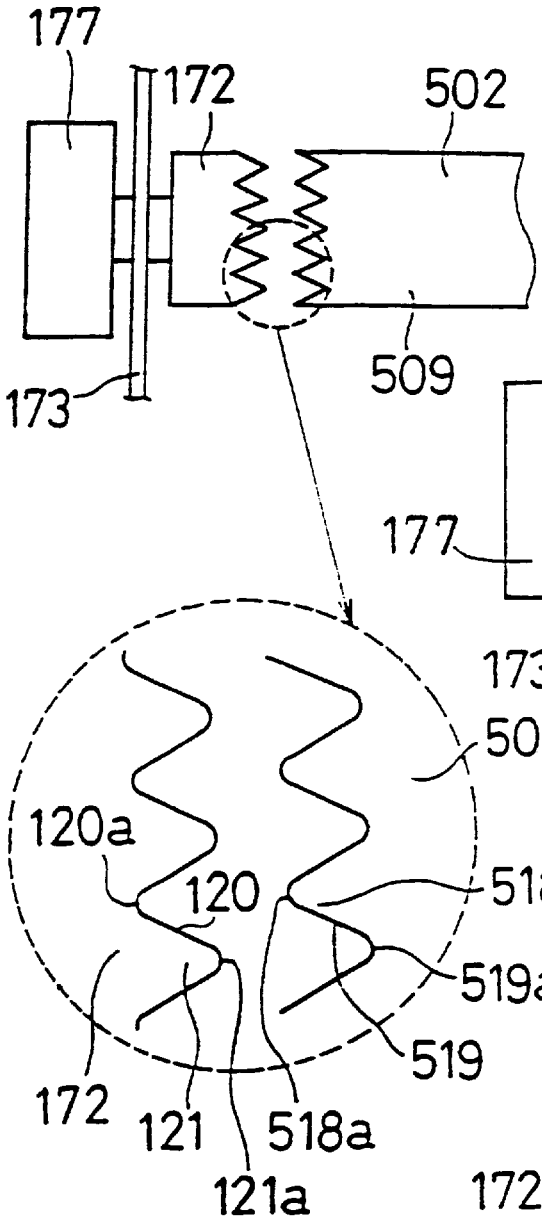
FIGS. 95A and 95B are side views illustrating a vicinity of a driven portion 509 of a supporting body 502 of the invention.

FIG. 95 is a side view illustrating the vicinity of the driven portion 509 of a supporting body 502 of the invention. As shown in FIG. 95A, the edge portion 518*a* of the projection 518 of the driven portion 509 and the bottom 519*a* of the depression 519 are curved. Similarly, the bottom 120*a* and the edge portion 121*a* of the driving depression 120 and the driving projection 121 are curved as well. Accordingly, the projection 518 is smoothly fitted to the driving depression 120, and the depression 519 is smoothly fitted to the driving projection 121 so that the attachment is secured and the risk of damaging the supporting body 502 can be avoided.

Figure 95B:
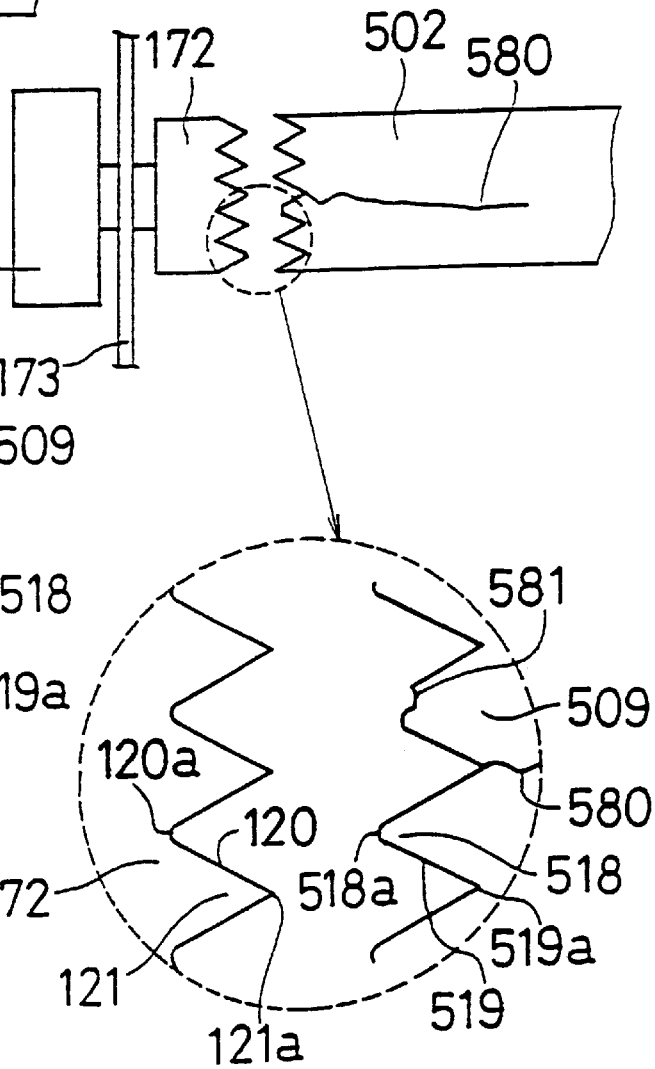

As shown in FIG. 95B, in the case the edge portion 518*a* of the projection 518 and the bottom 519*a* of the depression 519 are sharp, and similarly the bottom 120*a* of the driving depression 120 and the edge portion 121*a* of the driving projection 121 are sharp, crack 580 or chip 581 is liable to generate. However, such configuration shown in FIG. 95B is also included in the spirit of the invention.

The edge portion 518*a* of the depression 518 and the bottom 120*a* of the driving depression 120 do not contact to each other, and neither do the bottom 519*a* of the depression 519 and the edge portion 121*a* of the driving projection 121 so that the damage can be prevented further securely.

The joint member 172 comprises a guiding dent portion 133 for fitting with the guiding portion 531. In the guiding dent portion 133 is formed a truncated-conical shape guiding surface 134 to contact with the guiding surface 532. The outer end in the axis 116 direction of the guiding portion 531 and the bottom of the guiding dent portion 133 do not contact with each other, and accordingly, the guiding surfaces 532 and 134 are fitted and supported accurately.

Figure 96:
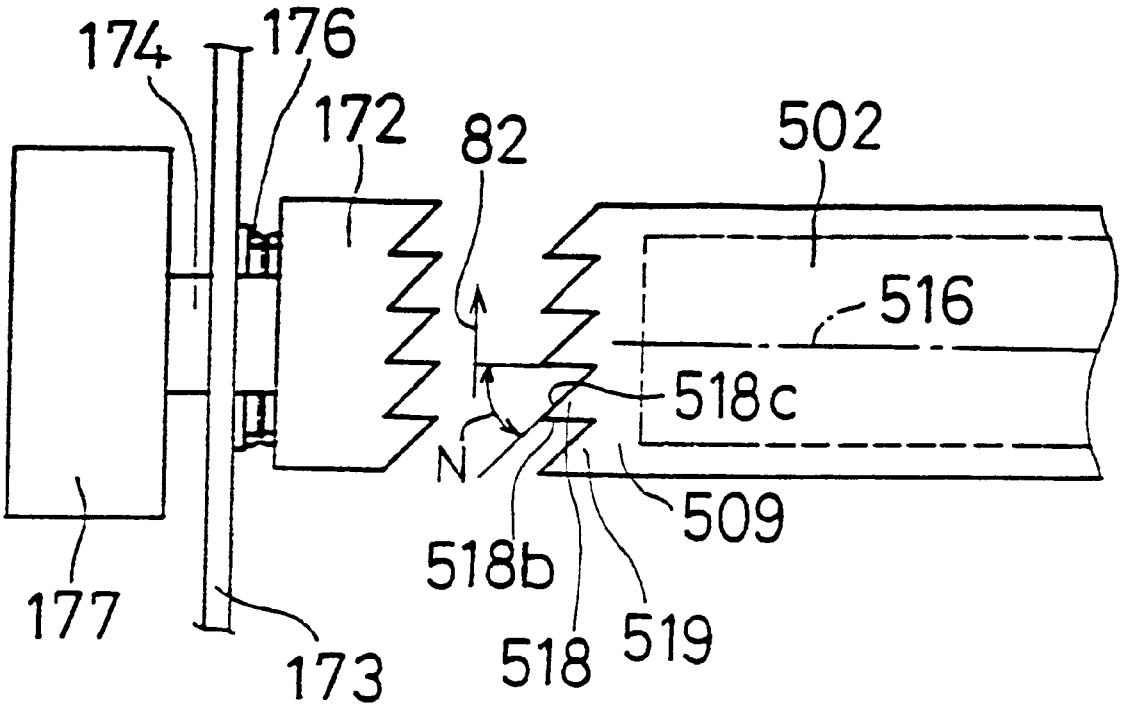
FIG. 96 is a side view of another embodiment of the invention.
Figure 97:
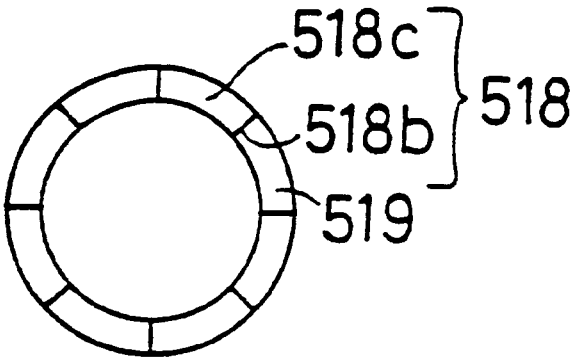
FIG. 97 is a plan view of projections 518 and depressions 519 of the driven portion 509 of FIG. 96.

FIG. 96 is a side view of another embodiment of the invention. This embodiment is similar to the above configuration, and the same parts bear the same numerals. The feature of this embodiment is that the upstream surface 518*b* with respect to the rotation direction 582 of the projection 518 is nearly parallel to the rotation axis 116 or inclined toward the upstream side of the rotation direction to the outward in the axial direction (toward the left direction in FIG. 96). In this configuration, the joint member 172 is to be fitted to the driven portion 509. According to the experiment of the inventor, an angle N made by the surface upstream of the rotation direction 518*b* of the projection 518 and the downstream surface 518*c* is preferably 45 to 90 degrees. According to the configuration, even when a torque of 40 kgf·cm or larger functions on the supporting body 502 for rotation driving, the rotation power can be securely transmitted from the joint member 172 to the driven member 509. FIG. 97 illustrated the constitution of the projection 518 and the depression 519 of the driven portion 509 apparently.

Figure 98:
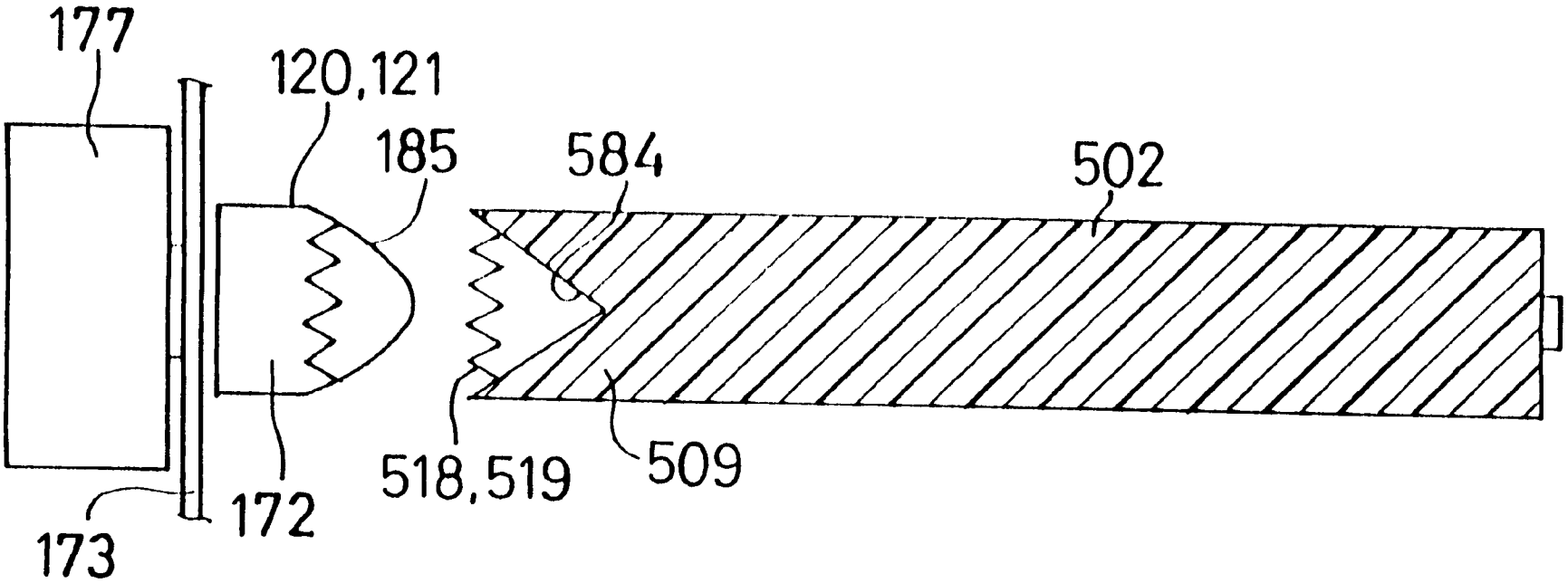
FIG. 98 is a sectional view of still another embodiment of the invention.

FIG. 98 is a sectional view of still another embodiment of the invention. The inner circumferential surface of a driven portion 509 of a supporting body 502 forms a conical guiding surface 584 where the inner diameter enlarges to the outward in the axial direction (the left side of FIG. 98). A joint member 172 comprises a nearly conical guiding projection 185 to be fitted to the guiding surface 184.

Figure 99:
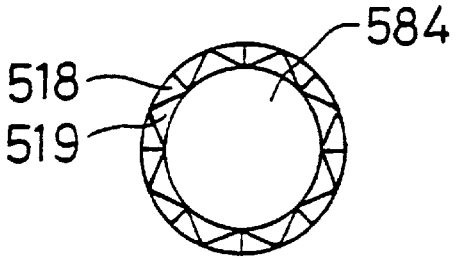
FIG. 99 is a plan view of the driven portion 509 of the supporting body 502 of the embodiment shown in FIG. 98 viewed from the left side.

FIG. 99 is a plan view of the driven portion 509 of the supporting body 502 of FIG. 98 viewed from the left side. In the driven portion 509 are formed projections 518 and depressions 519, and this configuration is similar to the embodiments mentioned above.

Figure 100:
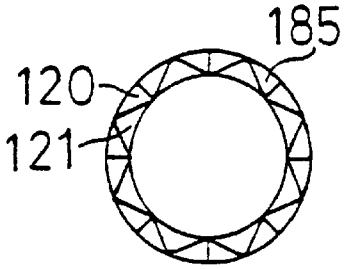
FIG. 100 is a plan view of a joint member 172 of FIG. 7 viewed from the right side.

FIG. 100 is a plan view of the joint member 172 of FIG. 98 viewed from the right side. A guiding projection 185 is formed more inwardly in the radial direction than projections 518 and depressions 519.

Figure 101:
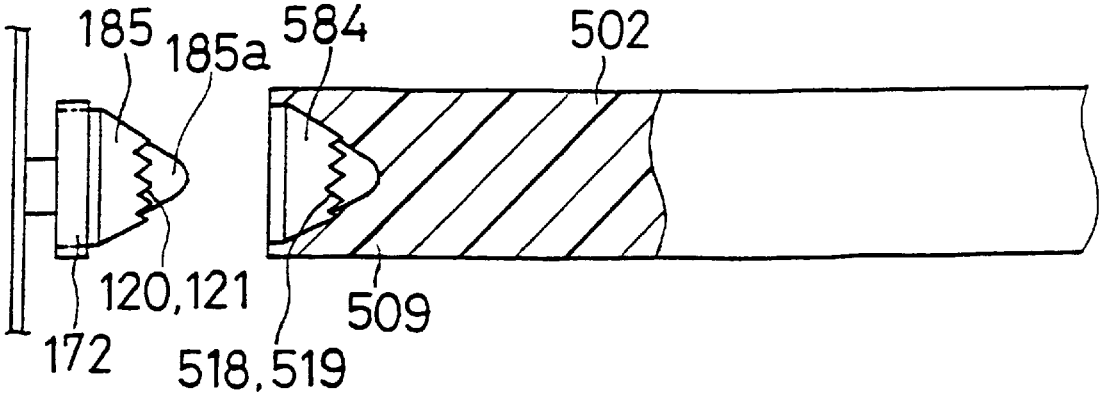
FIG. 101 is a sectional view of still another embodiment of the invention.

FIG. 101 is a sectional view of still another embodiment of the invention. The feature of this embodiment is that projections 518 and depressions 519 are formed at positions located midway in the axial direction of a guiding surface 584 formed in the driven portion 509. In the joint member 172 is formed a guiding projection 185, and driving depressions 120 and driving projections 121 are formed at positions located midway of the joint member 172 in the axial direction.

Figure 102:
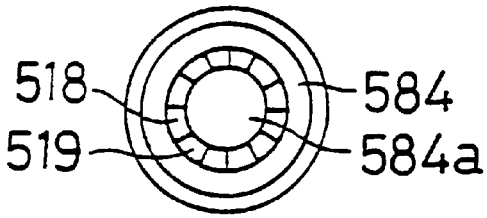
FIG. 102 is a plan view illustrating the vicinity of the driven portion 509 of the supporting body 502 of FIG. 10 viewed from the left side.
Figure 103:
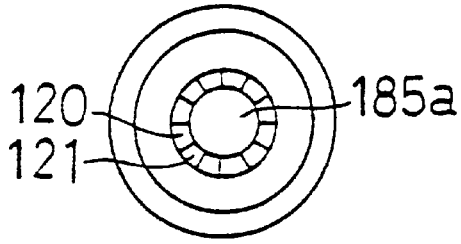
FIG. 103 is a plan view of the joint member 172 of FIG. 10.

FIG. 102 is a plan view of the driven portion 509 of the supporting body 502 of FIG. 101, and FIG. 103 is a plan view of the joint member 172 of FIG. 101 viewed from the right side. The guiding surface 584 comprises a guiding surface 584*a* further elongating inwardly in the axial direction (to the right side of FIG. 101) with respect to the projections 518 and the depressions 519. The edge portion 185*a* of a guiding projection 185 is guided and fitted to the guiding surface 584*a*.

Figure 104:
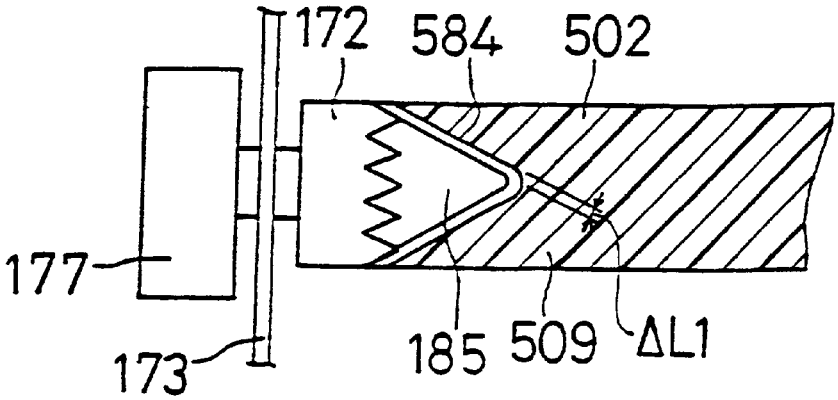
FIG. 104 is a sectional view of still another embodiment of the invention.

FIG. 104 is a partial sectional view of still another embodiment of the invention. The feature of this embodiment is that a gap ΔL is provided between a guiding surface 584 formed in a driven portion 509 of a supporting body 502 and the inner circumferential surface of a guiding projection 185 of a joint member 172. ΔL is, for example, 0.2 to 0.5 mm. The gap avoids a radially outward force on the driven portion 509, and thus breakage thereof can be prevented.

Figure 105:
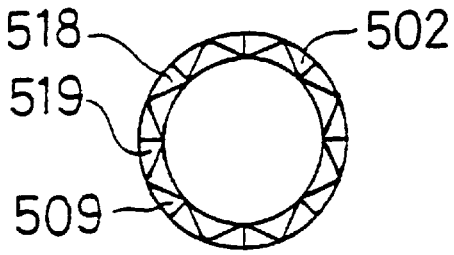
FIG. 105 is a plan view of the driven portion 509 of the supporting body 2 of FIG. 13 viewed from the left side.

FIG. 105 is a plan view of the end of the supporting body 502 of the embodiment shown in FIG. 104. As in the above configuration, projections 518 and depressions 519 are formed in the driven portion 509.

Figure 106:
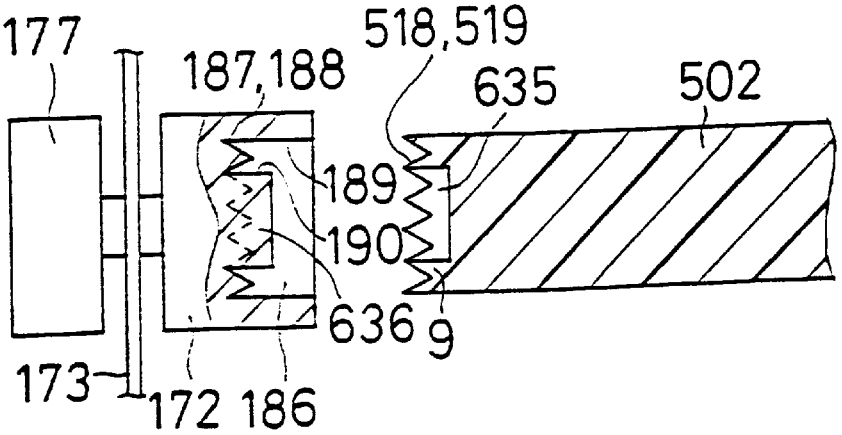
FIG. 106 is a partial sectional view of still another embodiment of the invention.
Figure 107:
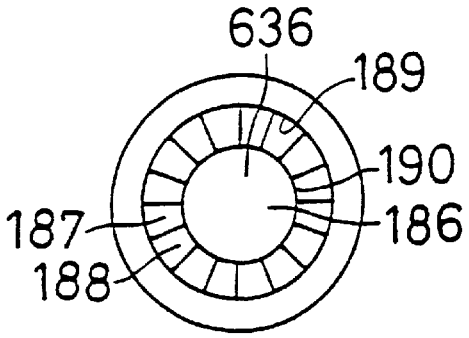
FIG. 107 is a plan view of the joint member 172 of the embodiment shown in FIG. 15.

FIG. 106 is a side view of still another embodiment of the invention, and FIG. 107 is a plan view of the joint member 172 of the embodiment shown in FIG. 106 viewed from the right side. The joint member 172 comprises a dent portion 186 axially dented for being fitted by the driven portion 509 of the supporting body 502. Driving depressions 187 and driving projections 188 are formed at the bottom of the dent portion 186 to engage with projections 518 and depressions 519 of the driven portion 509. According to this configuration, the outer circumferential surface and the inner circumferential surface of the driven portion 509 are supported by the surfaces 189, 190 facing the dent portion 186 radially, and thus the strength can be improved. In the driven portion 509 is formed a fitting depression 135, and in the guiding dent portion 86 is formed a supporting projection 136. Since the fitting projection 136 is formed in the fitting depression 135, the outer circumferential surface and the inner circumferential surface facing to the fitting depression 135, of the driven portion 9 are supported by the joint member 72, and thus the strength can be improved without backlash to achieve a stable rotation.

Figure 108:
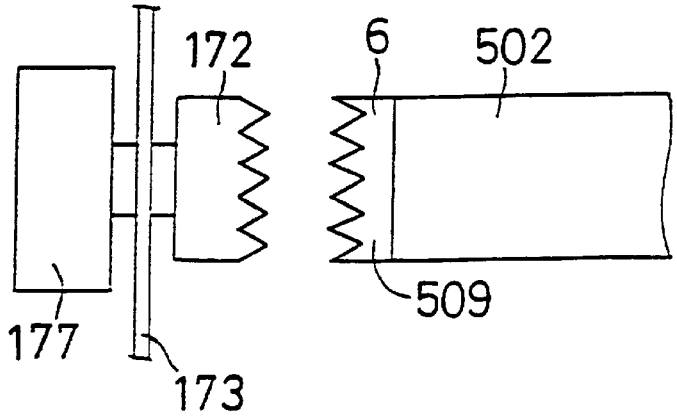
FIG. 108 is a side view of another embodiment of the invention.

FIG. 108 is a side view of still another embodiment of the invention. In a driven portion 509 of a supporting body 502 is formed a reinforcing layer 6. Reinforcing layers 6, 7 are synthetic resin films made of polyethylene terephthalate or the like, which is commercially available as Mylar tape. The reinforcing layers are prepared by winding such a tape around the outer circumferential surface of the ends 509, 112 of the supporting body 502 as one layer or a plurality of layers. Therefore, since the reinforcing layers 6, 7 are formed in non-image formation areas, which have nothing to do with image formation of the supporting body 502, generation of crack, crazing or breakage of the supporting body 502 by the stress on the end 509 of the supporting body 502 in fitting the joint member 172 and the driven portion 502 can be prevented, and thus the strength can be improved.

Figure 109:
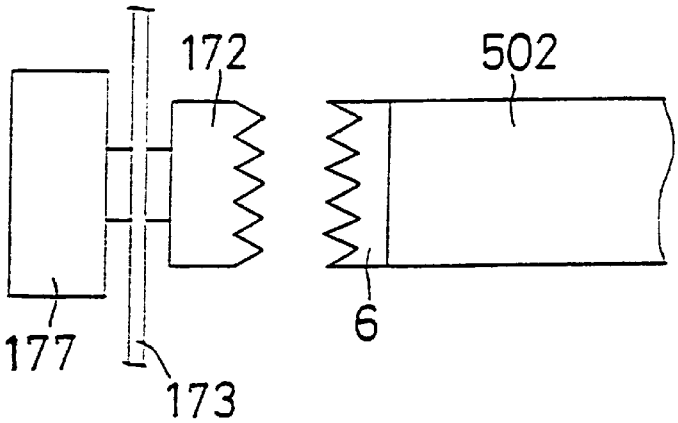
FIG. 109 is a partial side view of still another embodiment of the invention.

In still another embodiment of the invention shown in FIG. 109, in a driven portion 509 is formed a reinforcing layer 6 composed of a conductive coating layer.

By this process, the strength can be improved as well as the end 509 of the supporting body 502 and the driven member 3 can be securely connected electrically.

Figure 110:
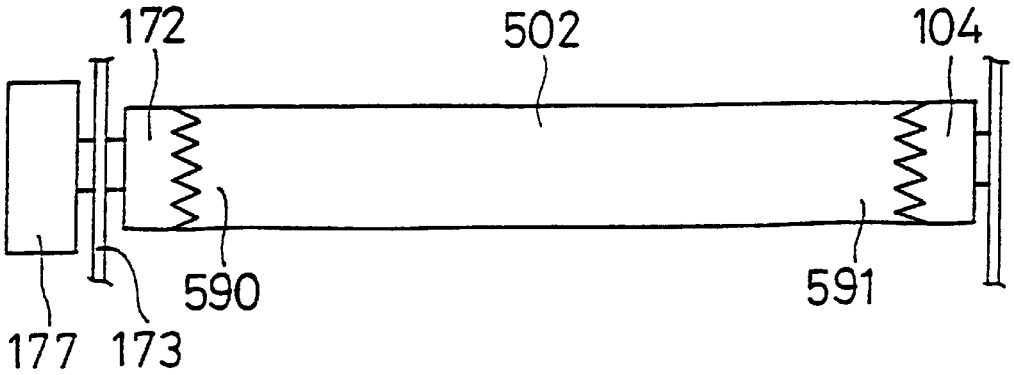
FIG. 110 is a side view of still another embodiment of the invention.

FIG. 110 is a side view of still another embodiment of the invention. In this embodiment, both axial ends 590, 591 of a supporting body 502 have the same configuration. One end 590 is engaged with a joint member 172, and the other end 591 is engaged with a supporting member 104.

Figure 111:
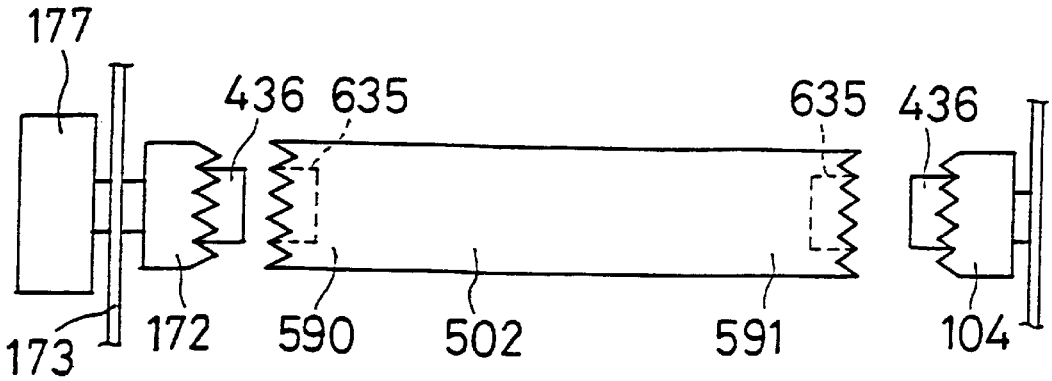
FIG. 111 is a side view of still another embodiment of the invention.
Figure 112:
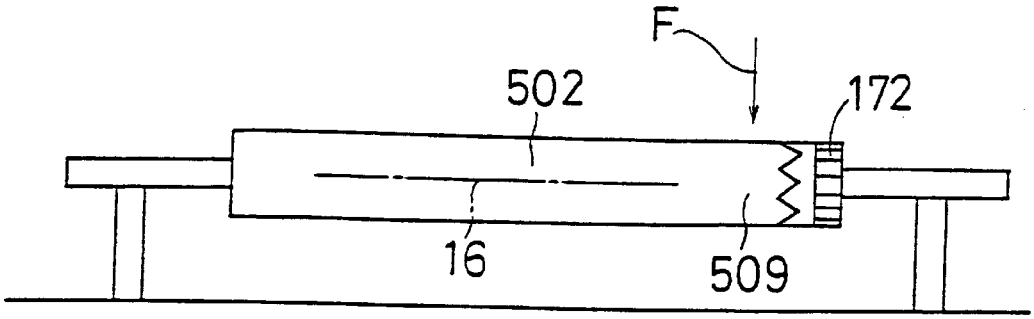
FIG. 112 is a schematic diagram illustrating the experiment conducted by the inventor.

FIG. 111 is a sectional view of still another embodiment of the invention. The end 590 of the supporting body 502 has a configuration as in the embodiment shown in FIGS. 106 and 107, including the mounting configuration of the other end 591 and the supporting member 104. According to the configuration shown in FIG. 111, the supporting body 502 can be accurately supported by the joint member 172 and the supporting member 104, and thus can rotate stably.

FIG. 21 is a diagram illustrating an experiment conducted by the inventor. The magnitude of the load at which a driven portion 9 and a joint member 72 break was measured by a load F applied perpendicular to the axis 16 of the supporting body 2. The experiment results are shown in Table 5.

TABLE 5

Figure 115:
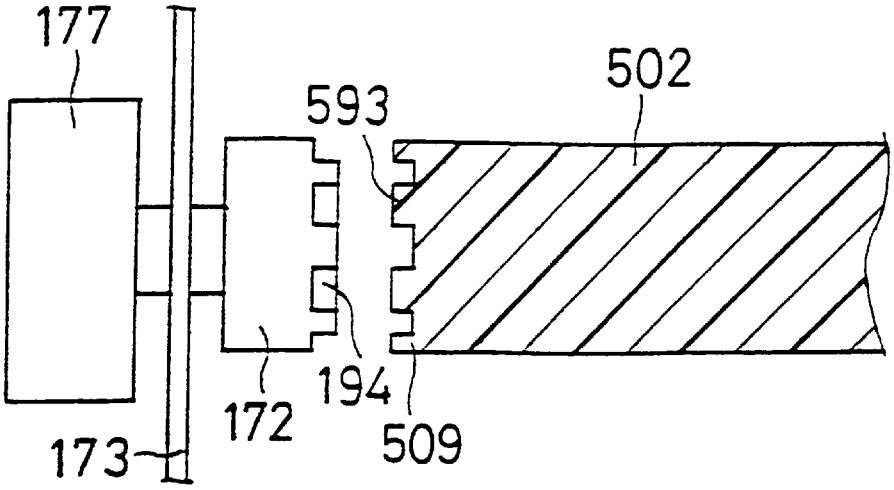
FIG. 115 is a sectional view of still another embodiment of the invention.

| Embodiment | Breaking load F(kgf) |
|---|---|
| FIG. 92 | 23 |
| FIG. 115 | 23 |
| FIG. 106 | 25 |
| FIG. 108 | 24 |
| FIG. 109 | 24 |

It was learned that the embodiment shown in FIG. 106 is most preferable among the embodiments in Table 5 with respect to the strength.

Figure 113:
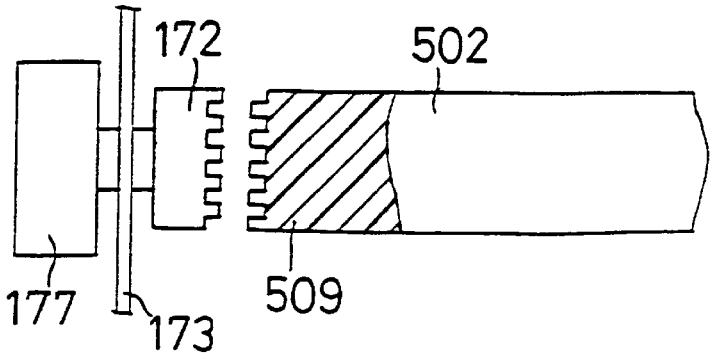
FIG. 113 is a partial sectional view of still another embodiment of the invention.
Figure 114:
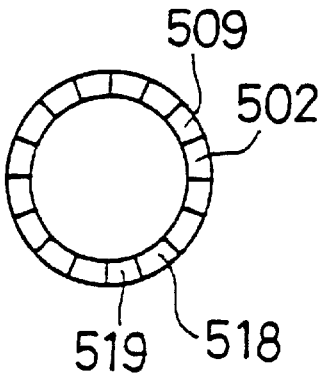
FIG. 114 is a plan view illustrating the projections 518 and the depressions 519 of the driven portion 509 of FIG. 22.

FIG. 113 is a sectional view of still another embodiment of the invention. As illustrated in FIG. 114, in the driven portion 509 of the supporting body 502 are formed a plurality of projections 518 and depressions 519 in the circumferential direction. The joint member 172 comprises driving depressions 120 and driving projections 121 to be engaged with the projections 518 and the depressions 519 respectively.

Figure 116:
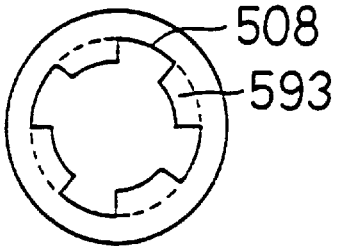
FIG. 116 is a plan view of the driven portion 509 of the supporting body 502 of FIG. 115.

FIG. 115 is a sectional view of still another embodiment of the invention. As shown in FIG. 116, in the driven portion 509 of the supporting body 502 is formed a protruding projection 593 protruding inwardly in the radial direction. Driving projections 195 for fitting to the inner circumferential surface 508 and driving depressions 196 for being fitted by the projections 593 are formed in the fitting portion 194 of the joint member 172 as shown in FIG. 91. According to this configuration, the strength can be improved with a minimum amount of a synthetic resin material of the supporting body 502.

Embodiments explained with reference to FIGS. 92 to 115 can be applied to the embodiments shown in FIGS. 54 to 65 and 28 to 32.

The time of the usage of an electrostatic photography apparatus to generate a crack in a supporting body 502 with a driven portion 509 having a configuration shown in FIGS. 64A to 64D as in the embodiment in FIG. 64 was found according to an experiment conducted by the inventor. Results are as shown in Table 6.

TABLE 6

| Fig. | 103A | 103B | 104C | 103D |
|---|---|---|---|---|
| Time(h) | 7 | 22 | 52 | 65 or more |

As apparent from the results of Table 6, it was learned when a joint member 172 shown in FIG. 63 was used, a configuration of a supporting body 502 in which a large number of dents and projections to be accurately fitted are formed at regular intervals in the circumferential direction, as shown in FIG. 64D can be used continuously in a long duration.

The supporting bodies 102, 302 and 502 described in the above embodiments are made of a material the same as or similar to that of a supporting body 2 mentioned above. In the explanation of the embodiments of the invention, the parts bearing the same numerals have a same or similar configuration and the same composition.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A photosensitive element for electrophotography comprising a cylindrical supporting body made of a synthetic resin, the cylindrical supporting body having an outer diameter uniform in the axial direction thereof and an inner diameter gradually tapering in the axial direction, a driven member fixed to an end having a smaller inner diameter of the cylindrical supporting body, the driven member being rotated around the axis to be driven, and a photosensitive layer formed on the outer circumferential surface of the cylindrical supporting body.

2. The photosensitive element for electrophotography of claim 1, wherein the end of the supporting body has projections protruding inwardly in the radial direction with respect to the inner circumferential surface tapered with respect to its axis, and the driven member is fitted into the end, and comprises a fitting portion where stopping grooves to be engaged with the projections are formed.

3. The photosensitive element for electrophotography of claim 2, wherein the fitting portion includes a supporting hole having a common axis, through which a supporting shaft is inserted, and a first edge position located in the inward of the supporting body in the axial dirction, at which the inner circumferential surface of the end of the supporting body and the fitting portion contact each other, and a second position at which the inner circumferential surface of the supporting hole and the supporting shaft contact each other have substantially the same coordinate with respect to the axial direction.

4. The photosensitive element for electrophotography of claim 2, wherein the outer circumferential surface of the fitting portion is formed tapering inwardly in the axial direction of the supporting body to have a smaller diameter.

5. The photosensitive element for electrophotography of claim 1, wherein at the end of the supporting body are formed a plurality of notches axially elongating in the circumferential direction at intervals, and the driven member includes stopping projections axially elongating to be engaged with the notches, and a fitting portion to be fitted into the end.

6. The photosensitive element for electrophotography of claim 1, wherein only the inner circumferential surface of the end of the supporting body is formed nearly parallel to the axis, and a fitting portion is interlocked to the end.

7. The photosensitive element for electrophotography of claim 1, wherein a reinforcing layer having an outer diameter nearly equal to the outer diameter of the photosensitive layer is formed in the outer circumferential surface of the end.

8. The photosensitive element for electrophotography of claim 1, wherein at the end of the supporting body are formed a plurality of stopping grooves at intervals in the circumferential direction, the plurality of stopping grooves being dent from the outer circumferential surface having a round section in the plane perpendicular to the axis thereof, and the driven member includes projections protruding toward the axis direction to be engaged with the respective stopping grooves.

9. A photosensitive element for electrophotography comprising a cylindrical supporting body made of a synthetic resin, the cylindrical supporting body having an outer diameter uniform in the axial direction thereof and an inner diameter gradually tapering in the axial direction, and a coaxial supporting hole formed in an insertion part inserted into an end having a larger inner diameter of the supporting body, wherein a supporting shaft is inserted into the supporting hole, and wherein a first edge position located in the inward of the supporting body in the axial direction thereof, where the inner circumferential surface of the end of the supporting body and a fitting portion of the insertion part contact each other, and a second edge position where an inner circumferential surface of the supporting hole and the supporting shaft contact each other have substantially the same coordinate with respect to the axis of the supporting body.

10. A photosensitive element for electrophotography comprising a cylindrical supporting body made of a synthetic resin, the cylindrical supporting body having an outer diameter uniform in the axial direction thereof and an inner diameter gradually tapering in the axial direction, wherein the end having a smaller inner diameter of the cylindrical supporting body is fitted into a groove dent in the axial direction, the groove being formed in an end face of a driven member rotated around the axis to be driven.

11. A photosensitive device for eletrophotography comprising:

(a) a photosensitive element having a cylindrical supporting body made of a synthetic resin, the cylindrical supporting body having an outer diameter uniform in the axial direction thereof and an inner diameter gradually tapering in the axial direction, a driven member fixed to the end having a smaller inner diameter of the cylindrical supporting body, the driven member being rotated around the axis to be driven and having a gear protruding outwardly in the axial direction of the cylindrical supporting body from the cylindrical supporting body, and a photosensitive layer formed on the outer circumferential surface of the cylindrical supporting member, and (b) driving means having a driving gear to be engaged with the gear to provide rotation driving force.

12. An electrophotography apparatus for forming electrostatic latent images in a photosensitive element provided in a photosensitive device, developing the electrostatic latent images with a developer of a developing device, and transferring and fixing the developed images on a recording sheet, wherein the photosensitive device includes:

a photosensitive element and driving means, the photosensitive element including a cylindrical supporting body made of a synthetic resin, the cylindrical supporting body having an outer diameter uniform in the axial direction thereof and an inner diameter gradually tapering in the axial direction, a driven member fixed to the end having a smaller inner diameter of the cylindrical supporting body, the driven member being rotated around the axis to be driven, a photosensitive layer formed on an outer circumferential surface of the cylindrical supporting member, and a reinforcing layer formed on an outer circumferential surface of the end, the photosensitive layer and the reinforcing layer having a nearly equal outer diameter, the driving means rotating the driven member around the axis of the supporting body; and the developing device includes a casing to accommodate a developer so as to surround a developing roller arranged to face the photosensitive element, the casing being provided with a developer-scattering prevention sheet contacting the photosensitive layer and the reinforcing layer on an upstream side in a rotation direction of the photosensitive element with respect to the developing roller.

13. A photosensitive element for electrophotography comprising:

a cylindrical supporting body made of a synthetic resin and having an outer circumferential surface on which a photosensitive layer is formed:

a driven portion provided at an end of the cylindrical supporting body so as to face outwardly in the axial direction of the supporting body, the driven portion having a plurality of projections and depressions formed alternately so as to be adjacent to each other in the circumferential direction of the supporting body; and driving means for rotating and driving the supporting body around the axis of the supporting body, the driving means being provided with a joint member to be removably engaged with the projections and depressions, and having the same axis as that of the supporting body, wherein the supporting body is solid only in a vicinity of the end or the driven portion of the supporting body is thicker than the rest thereof.

14. The photosensitive element for electrophotography of claim 13, wherein each projection is formed to protrude outwardly in the axial direction and taper gradually toward the outward in the axial direction.

15. The photosensitive element for electrophotography of claim 14, wherein the edge portions of the projections and the bottoms of the depressions are formed to be curved.

16. The photosensitive element for electrophotography of claim 14, wherein the upstream side surfaces of the projections are nearly parallel to the rotation axis or inclined to the upstream side of the rotation direction toward the axially outer direction.

17. The photosensitive element for electrophotography of claim 13, wherein the driven portion and the rest of the supporting body are connected to each other to form an obtuse angle in the inner circumferential surface of the supporting body.

18. The photosensitive element for electrophotography of claim 13, wherein the driven portion of the supporting body comprises a conical guiding surface arranged more inwardly than the projections and depressions in the radial direction, the conical guiding surface having an outer diameter gradually tapering toward the outward in the axial direction.

19. The photosensitive element for electrophotography of claim 13, wherein in the inner circumferential surface of the supporting body in the vicinity of the driven portion is formed a conical guiding surface having an inner diameter gradually enlarging toward the axially outer direction.

20. The photosensitive element for electrophotography of claim 13, wherein the projections of the driven portion of the supporting body are formed to protrude inwardly from the inner circumferential surface of the supporting body excluding the driven portion in the radial direction.

21. The photosensitive element for electrophotography of claim 13, wherein a reinforcing layer having an outer diameter nearly equal to that of the photosensitive layer is formed on the outer circumferential surface in the vicinity of the driven portion.

22. The photosensitive element for electrophotography of claim 13, wherein an inner diameter of the supporting body is axially tapered toward the driven portion.

23. The photosensitive element for electrophotography of claim 13, wherein the driven portions are arranged at both ends of the supporting body.

24. A photosensitive device for electrophotography comprising:

(a) a photosensitive element having a cylindrical supporting body made of a synthetic resin, having a photosensitive layer formed on the outer circumferential surface and a driven portion with a plurality of projections and depressions formed alternately to be adjacent to each other in the circumferential direction, the driven portion being arranged at an axially end of the supporting body so as to face the outward in the axial direction; and (b) driving means including a joint member sharing an axis with the supporting body to be engaged removably with projections and depressions of the driven portions, a spring for providing a spring force applied to the direction the driven portion and the joint member of the supporting body come closer, and a driving power source to rotate the joint member around the rotation axis to be driven.

25. The photosensitive device for electrophotography of claim 24, wherein the projections are formed so as to protrude outwardly in the axial direction and taper outwardly in the axial direction.

26. The photosensitive device for electrophotography of claim 25, wherein a conical guiding surface arranged more inwardly than the projections and depressions in the radial direction, having an outer diameter tapering toward the outward in the axial direction, is formed in the driven portion of the supporting body, and a joint member comprises a conical receiving surface to be fitted with the guiding surface in a state the axis of the supporting body and the rotation axis of the joint member are on a straight line.

27. The photosensitive device for electrophotography of claim 25, wherein a conical guiding surface having the inner diameter enlarging to the outward in the axial direction is formed in the inner circumferential surface of the supporting body in the vicinity of the driven portion, and the joint member comprises a guiding projection to be fitted to the guiding surface having an outer diameter smaller than that of the guiding surface so as to have a gap formed with the inner surface of the guiding surface in a fitted state.

28. The photosensitive device for electrophotography of claim 24, wherein the joint member includes a dent portion being axially dent to fit with the driven portion of the supporting body, and driving depressions and driving projections to be engaged respectively with the projections and depressions of the driven portion are formed at the bottom of the dent portion.

29. The photosensitive device for electrophotography of claim 24, wherein the supporting body having the driven portion is made of a conductive synthetic resin, and the joint member is made of a conductive material.

30. The photosensitive device for electrophotography of claim 24, wherein the supporting body having the driven portion is made of a material softer than that of the joint member.

31. The photosensitive device for electrophotography of claim 24, wherein driving depression and driving projections formed in the joint member to be engaged with projections and depressions of the driven portion are formed in a number obtained by multiplying the number of the projections and the depressions of the driven portion by two or more, and thereby the joint member can be applied commonly to a plurality of kinds of driven portions.

32. An electrophotography apparatus for forming electrostatic latent images in a photosensitive element in a photosensitive device, developing the electrostatic latent images with a developer of a developing device, transferring and fixing the developed images on a recording sheet, wherein the photosensitive device includes:

a photosensitive element; and driving means, the photosensitive element including:

a cylindrical supporting body made of a synthetic resin, having a photosensitive layer formed on the outer circumferential surface thereof, and a driven portion with a plurality of projections and depressions formed alternately to be adjacent to each other in the circumferential direction, the driven portion being arranged at an axially end of the supporting body so as to face the outward in the axial direction, a reinforcing layer having an outer diameter nearly equal to the outer diameter of the photosensitive layer being formed on the outer circumferential surface of a vicinity of the driven portion the end, the driving means including:

a joint member sharing an axis with the supporting body to be engaged removably with projections and depressions of the driven portions, a spring for providing a spring force applied to the direction the driven portion and the joint member of the supporting body come closer, and a driving power source for rotating and driving the joint member around the rotation axis; and wherein the developing device includes a casing to accommodate a developer so as to surround a developing roller arranged to face the photosensitive element, the casing being provided with a developer-scattering prevention sheet contacting the photosensitive layer and the reinforcing layer on an upstream side in a rotation direction of the photosensitive element with respect to the developing roller.

33. A photosensitive element for electrophotography comprising:

a nearly cylindrical supporting body made of a synthetic resin and having an outer circumferential surface on which a photosensitive layer is formed; and a driven portion provided at an end of the nearly cylindrical supporting body so as to face outwardly in the axial direction of the supporting body, the driven portion having a plurality of projections and depressions formed alternately so as to be adjacent to each other in the circumferential direction of the supporting body, wherein the supporting body is solid only in a vicinity of the end or the driven portion of the supporting body is thicker than the rest thereof, and rotated to be driven around the axis of the supporting body by driving means which is provided with a joint member to be removably engaged with the projections and depressions, and has the same axis as that of the supporting body.

34. The photosensitive element for electrophotography of claim 33, wherein each projection is formed so as to protrude outwardly in the axial direction and taper gradually to the outward in the axial direction.

35. The photosensitive element for electrophotography of claim 34, wherein the edge portions of the projections and the bottoms of the depressions are formed to have a curve shape.

36. The photosensitive element for electrophotography of claim 34, wherein the upstream side surfaces of the projections are nearly parallel to the rotation axis, or the more outwardly in the axial direction, the more inclined to the upstream side of the rotation direction.

37. The photosensitive element for electrophotography of claim 33, wherein in the driven portion of the supporting body is formed a conical guiding surface arranged more inwardly than the projections and depressions in the radial direction, having an outer diameter gradually tapering toward the axially outer direction.

38. The photosensitive element for electrophotography of claim 33, wherein in the vicinity of the driven portion of the supporting body is formed a conical guiding surface having an inner diameter gradually enlarging toward the axially outer direction.

39. The photosensitive element for electrophotography of claim 33, wherein a guiding surface having an inner diameter gradually enlarging toward the axially outward direction is formed in the driven portion of the supporting body, and a plurality of projections and depressions are alternately formed in the circumferential direction at a position located midway in the guiding surface in the axial direction or at a position located inwardly in the guiding surface in the axial direction, so as to face outwardly in the axial direction and be adjacent to each other in the circumferential direction.

40. The photosensitive element for electrophotography of claim 33, wherein the projections of the driven portion of the supporting body are formed so as to protrude inwardly in the radial direction.

41. The photosensitive element for electrophotography of claim 33, wherein a reinforcing layer having an outer diameter nearly equal to that of the photosensitive layer is formed on the outer circumferential surface in the vicinity of the driven portion.

42. The photosensitive element for electrophotography of claim 33, wherein the driven portions are arranged at both ends of the supporting member.

43. The photosensitive element for electrophotography of claim 33, wherein a supporting depression of which an inner circumferential surface is concentric with the outer circumferential surface of the supporting body is formed in the middle of the driven portion so as to face outwardly in the axial direction.

44. A photosensitive device for electrophotography comprising:

(a) a photosensitive element including:

a cylindrical supporting body made of a synthetic resin, having a a photosensitive layer on the outer circumferential surface thereof, and a driven portion having a plurality of projections and depressions formed alternately so as to be adjacent to each other in the circumferential direction, the driven portion being provided at one end of the supporting body in the axial direction so as to face outwardly in the axial direction, the cylindrical supporting body being solid only in a portion in the vicinity of the one end; and (b) driving means including:

a joint member removably to be engaged with projections and depressions of the driven portion, having the same axis as that of the supporting body, a spring for providing a spring force in a direction where the driven portion and the joint member of the supporting body come close to each other, and a driving power source for rotating and driving the joint member around a rotation axis.

45. The photosensitive device for electrophotography of claim 44, wherein each projection is formed so as to protrude outwardly in the axial direction and taper to the outward in the axial direction.

46. The photosensitive device for electrophotography of claim 45, wherein a conical guiding surface arranged more inwardly in the radial direction than the projections and depressions and having an outer diameter tapering to the outward in the axial direction is formed in the driven portion of the supporting body, and a joint member comprises a conical receiving surface to be fitted with the guiding surface in a state the axis of the supporting body and the rotation axis of the joint member are on a straight line.

47. The photosensitive device for electrophotography of claim 45, wherein a conical guiding surface having an inner diameter enlarging to the outward in the axial direction is formed in the inner circumferential surface of the supporting body in the vicinity of the driven portion, and the joint member comprises a guiding projection to be fitted to the guiding surface having an outer diameter smaller than that of the guiding surface so as to have a gap formed with the inner surface of the guiding surface in a fitted state.

48. The photosensitive device for electrophotography of claim 44, wherein the joint member includes a dent portion axially dent to fit with the driven portion of the supporting body, and driving depressions and driving projections to be engaged respectively with the projections and depressions of the driven portion are formed at the bottom of the dent portion.

49. The photosensitive device for electrophotography of claim 44, wherein a supporting depression having an inner circumferential surface concentric with the outer circumferential surface of the supporting body is formed in the middle of the driven portion so as to face the outward in the axial direction, and that the joint member has a supporting projection for supporting the supporting body by being engaged with the supporting depression.

50. The photosensitive device for electrophotography of claim 44, wherein the supporting body having the driven portion is made of a conductive synthetic resin, and the joint member is made of a conductive material.

51. The photosensitive device for electrophotography of claim 44, wherein the supporting body having the driven portion is made of a material softer than that of the joint member.

52. The photosensitive device for electrophotography of claim 44, wherein driving depressions and driving projections formed in the joint member to be engaged with projections and depressions of the driven portion are formed in a number obtained by multiplying the number of the projections and the depressions of the driven portion by two or more, and thereby the joint member can be applied commonly to a plurality of kinds of driven portions.

53. A photosensitive device for electrophotography comprising:

(a) a photosensitive element including:

a nearly cylindrical supporting body made of a synthetic resin, having a a photosensitive layer on the outer circumferential surface thereof, and a driven portion having a plurality of projections and depressions formed alternately so as to be adjacent to each other in the circumferential direction, the driven portion being provided at one end of the supporting body in the axial direction so as to face outwardly in the axial direction; and (b) driving means including:

a joint member removably to be engaged with projections and depressions of the driven portion, having the same axis as that of the supporting body, a spring for providing a spring force in a direction where the driven portion and the joint member of the supporting body come close to each other, and a driving power source for rotating and driving the joint member around a rotation axis.

54. An electrophotography apparatus for forming electrostatic latent images in a photosensitive element provided in a photosensitive device, developing the electrostatic latent images with a developer of a developing device, and transferring and fixing the developed images on a recording sheet, wherein the photosensitive device includes a photosensitive element and driving means, the photosensitive element including:

a nearly cylindrical supporting body made of a synthetic resin, having a photosensitive layer on the outer circumferential surface thereof, and a driven portion having a plurality of projections and depressions formed alternately so as to be adjacent to each other in the circumferential direction, the driven portion being provided at one end of the supporting body in the axial direction so as to face the outward in the axial direction, the nearly cylindrical supporting body being solid only in a portion in the vicinity of the one end;

a reinforcing layer having an outer diameter nearly equal to the outer diameter of the photosensitive layer, being formed on the outer circumferential surface in the vicinity of the driven portion, the driving means including:

a joint member sharing an axis with the supporting body to be engaged removably with projections and depressions of the driven portion, a spring for providing a spring force applied to the direction where the driven portion and the joint member of the supporting body come close to each other, and a driving power source for rotating and driving the joint member around a rotation axis; and wherein the developing device includes a casing to accommodate a developer surrounding a developing roller arranged so as to face the photosensitive element, in which casing a developer scattering prevention sheet contacting with the photosensitive layer and the reinforcing layer on the upstream side with respect to the developing roller in the rotation direction of the photosensitive element.

55. An electrophotography apparatus for forming electrostatic latent images in a photosensitive element provided in a photosensitive device, developing the electrostatic latent images with a developer of a developing device, and transferring and fixing the developed images on a recording sheet, wherein the photosensitive device includes a photosensitive element and driving means, the photosensitive element including:

a nearly cylindrical supporting body made of a synthetic resin, having a photosensitive layer on the outer circumferential surface thereof, and a driven portion having a plurality of projections and depressions formed alternately so as to be adjacent to each other in the circumferential direction, the driven portion being provided at one end of the supporting body in the axial direction so as to face outwardly in the axial direction;

a reinforcing layer having an outer diameter nearly equal to the outer diameter of the photosensitive layer, is formed on the outer circumferential surface in the vicinity of the driven portion, the driving means including:

a joint member sharing an axis with the supporting body to be engaged removably with projections and depressions of the driven portion, a spring for providing a spring force applied to the direction where the driven portion and the joint member of the supporting body come close to each other, and a driving power source for rotating and driving the joint member around a rotation axis; and wherein the developing device includes a casing to accommodate a developer surrounding a developing roller arranged so as to face the photosensitive element, in which casing a developer scattering prevention sheet contacting with the photosensitive layer and the reinforcing layer on the upstream side with respect to the developing roller in the rotation direction of the photosensitive element.

* * * * *